US012687090B2

(12) United States Patent
Hepburn et al.

(10) Patent No.: US 12,687,090 B2
(45) Date of Patent: Jul. 21, 2026

(54) MULTILATERAL JUNCTION INCLUDING AN EXPANDABLE SEALING ELEMENT

(71) Applicant: Halliburton Energy Services, Inc., Houston, TX (US)

(72) Inventors: Neil Hepburn, Stavanger (NO); Mark Christopher Glaser, Spring, TX (US); Justin Roberts, Calgary (CA); David Joe Steele, Carrollton, TX (US); Eulalio De Jesus Rosas Fermin, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/416,001

(22) Filed: Jan. 18, 2024

(65) Prior Publication Data

US 2025/0137356 A1 May 1, 2025

Related U.S. Application Data

(60) Provisional application No. 63/595,034, filed on Nov. 1, 2023.

(51) Int. Cl.
*E21B 41/00* (2006.01)
*E21B 33/128* (2006.01)

(52) U.S. Cl.
CPC ..... *E21B 41/0042* (2013.01); *E21B 33/128* (2013.01)

(58) Field of Classification Search
CPC ..... E21B 41/0042; E21B 33/128
See application file for complete search history.

(56) References Cited

U.S. PATENT DOCUMENTS

| | | | |
|---|---|---|---|
| 6,012,526 | A | 1/2000 | Jennings et al. |
| 6,062,306 | A | 5/2000 | Gano et al. |
| 6,209,644 | B1 | 4/2001 | Brunet |
| 6,209,648 | B1 | 4/2001 | Ohmer et al. |
| 6,863,129 | B2 | 3/2005 | Ohmer et al. |

(Continued)

FOREIGN PATENT DOCUMENTS

| | | | |
|---|---|---|---|
| EP | 3167142 | A4 | 3/2018 |
| GB | 2544911 | B | 12/2020 |
| WO | 2016171666 | A1 | 10/2016 |

OTHER PUBLICATIONS

Xin, L., et al., "A Numerical Analysis Method of Hydraulic Seals for Downhole Equipments," Advances in Mechanical Engineering, vol. 2013, Aug. 28, 2013, 15 pages, Hindawi Publishing Corporation.

*Primary Examiner* — D. Andrews
(74) *Attorney, Agent, or Firm* — Scott Richardson; Parker Justiss, P.C.

(57) ABSTRACT

Provided is a multilateral junction, a well system, and a method. The multilateral junction, in one aspect, includes a lateral branch template having a lateral window for positioning proximate a junction between a lateral wellbore and a main wellbore, and a lateral branch connector adapted to be sealably engaged to the lateral branch template, a portion of the lateral branch connector extending through the lateral window. The multilateral junction, according to this aspect, further includes one or more sealing elements configured to expand in volume located proximate a joint between the lateral branch template and the lateral branch connector.

20 Claims, 72 Drawing Sheets

(56) References Cited

U.S. PATENT DOCUMENTS

| | | | |
|---|---|---|---|
| 7,669,653 | B2 | 3/2010 | Craster et al. |
| 8,408,315 | B2 | 4/2013 | Docherty |
| 10,344,570 | B2 | 7/2019 | Steele |
| 10,385,654 | B2 | 8/2019 | Gibb |
| 10,472,933 | B2 | 11/2019 | Steele |
| 11,187,061 | B2 | 11/2021 | Glaser |
| 11,203,926 | B2 | 12/2021 | Steele et al. |
| 11,261,708 | B2 | 3/2022 | Steele et al. |
| 11,408,254 | B2 | 8/2022 | Steele et al. |
| 11,506,024 | B2 | 11/2022 | Steele et al. |
| 11,668,163 | B2 | 6/2023 | Asthana et al. |
| 2001/0025710 | A1 | 10/2001 | Ohmer et al. |
| 2008/0099201 | A1 | 5/2008 | Sponchia et al. |
| 2017/0234113 | A1 | 8/2017 | Steele |
| 2021/0332673 | A1 | 10/2021 | Fripp et al. |
| 2021/0372527 | A1* | 12/2021 | Fripp ..... E21B 17/042 |
| 2022/0205341 | A1 | 6/2022 | Asthana et al. |
| 2022/0381104 | A1* | 12/2022 | Eldho ..... E21B 33/1216 |

* cited by examiner

MULTILATERAL JUNCTION INCLUDING AN EXPANDABLE SEALING ELEMENT

CROSS-REFERENCE TO RELATED APPLICATION

This application claims the benefit of U.S. Provisional Application Ser. No. 63/595,034, filed on Nov. 1, 2023, entitled "MULTILATERAL JUNCTION INCLUDING AN EXPANDABLE SEALING ELEMENT," commonly assigned with this application and incorporated herein by reference in its entirety.

BACKGROUND

The oil and gas market is trending towards longer horizontal wells to increase reservoir contact. Multilateral wells offer an alternative approach to maximize reservoir contact. Multilateral wells include one or more lateral wellbores extending from a main wellbore. A lateral wellbore is a wellbore that is diverted from the main wellbore or another lateral wellbore.

BRIEF DESCRIPTION

Reference is now made to the following descriptions taken in conjunction with the accompanying drawings, in which.

Figure 6A:
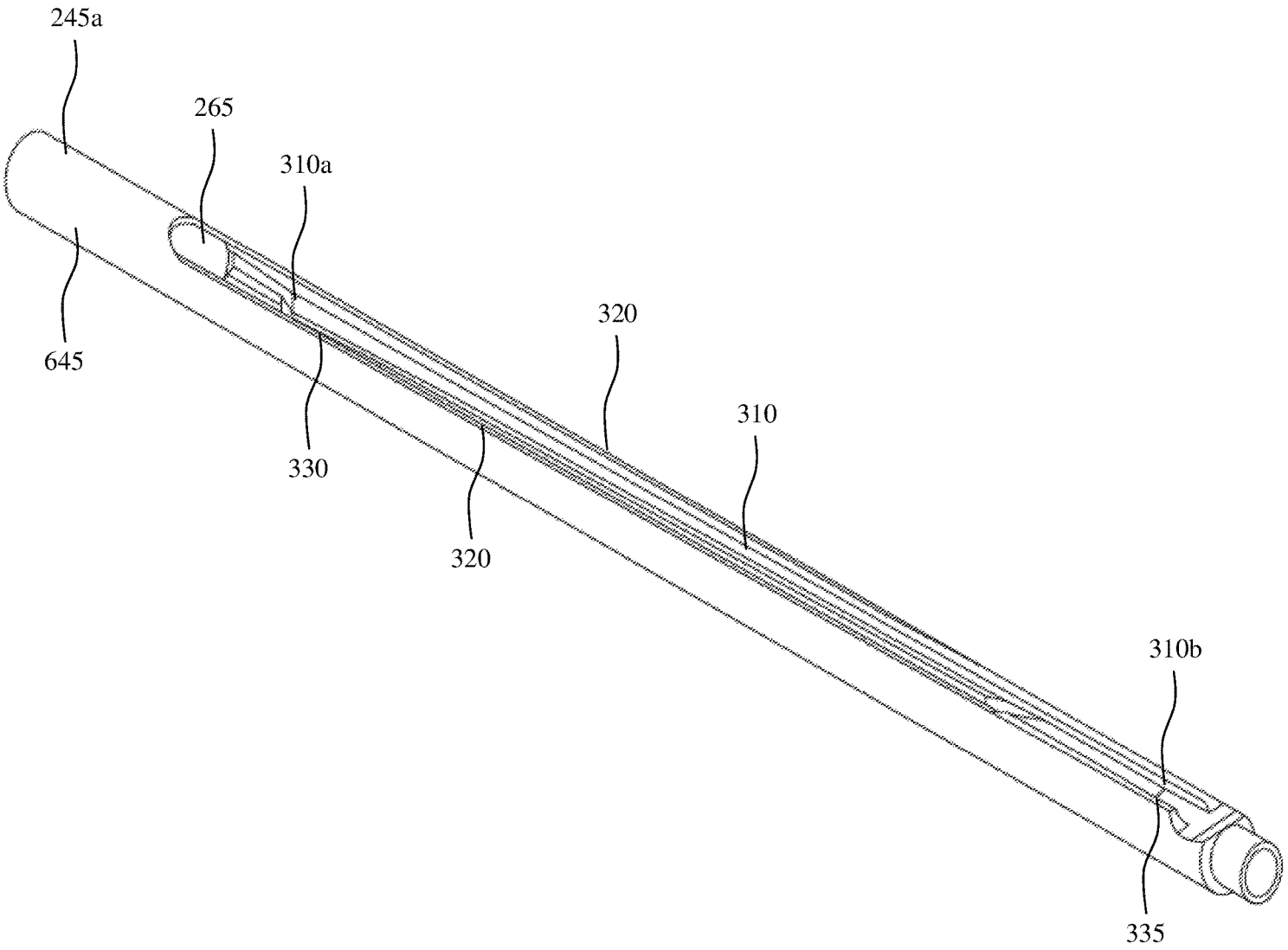
Figure 6B:
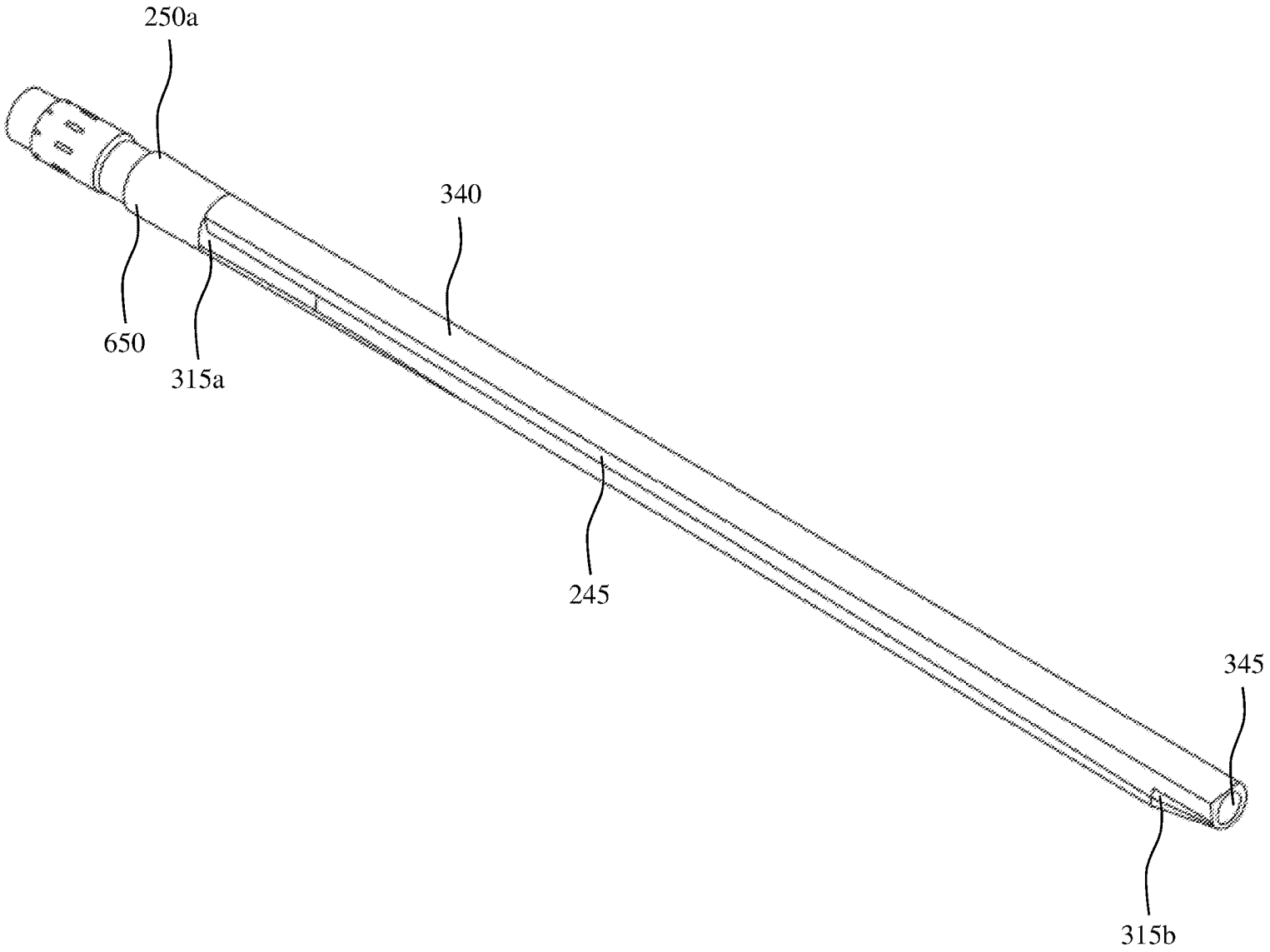
Figure 6C:
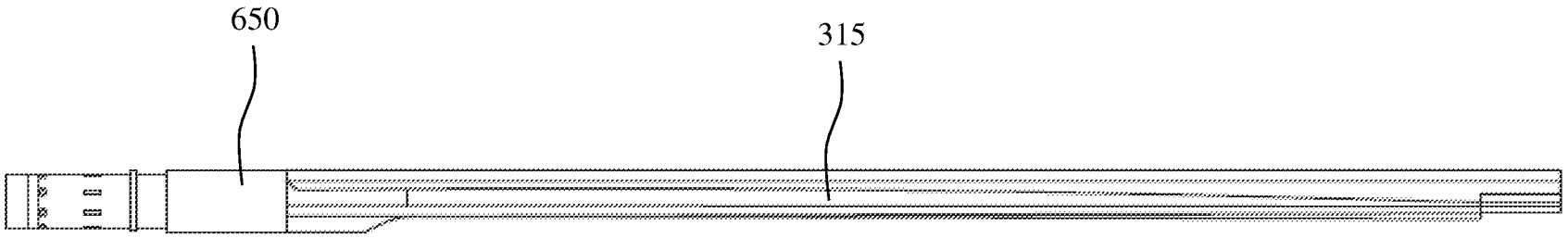
Figure 6D:
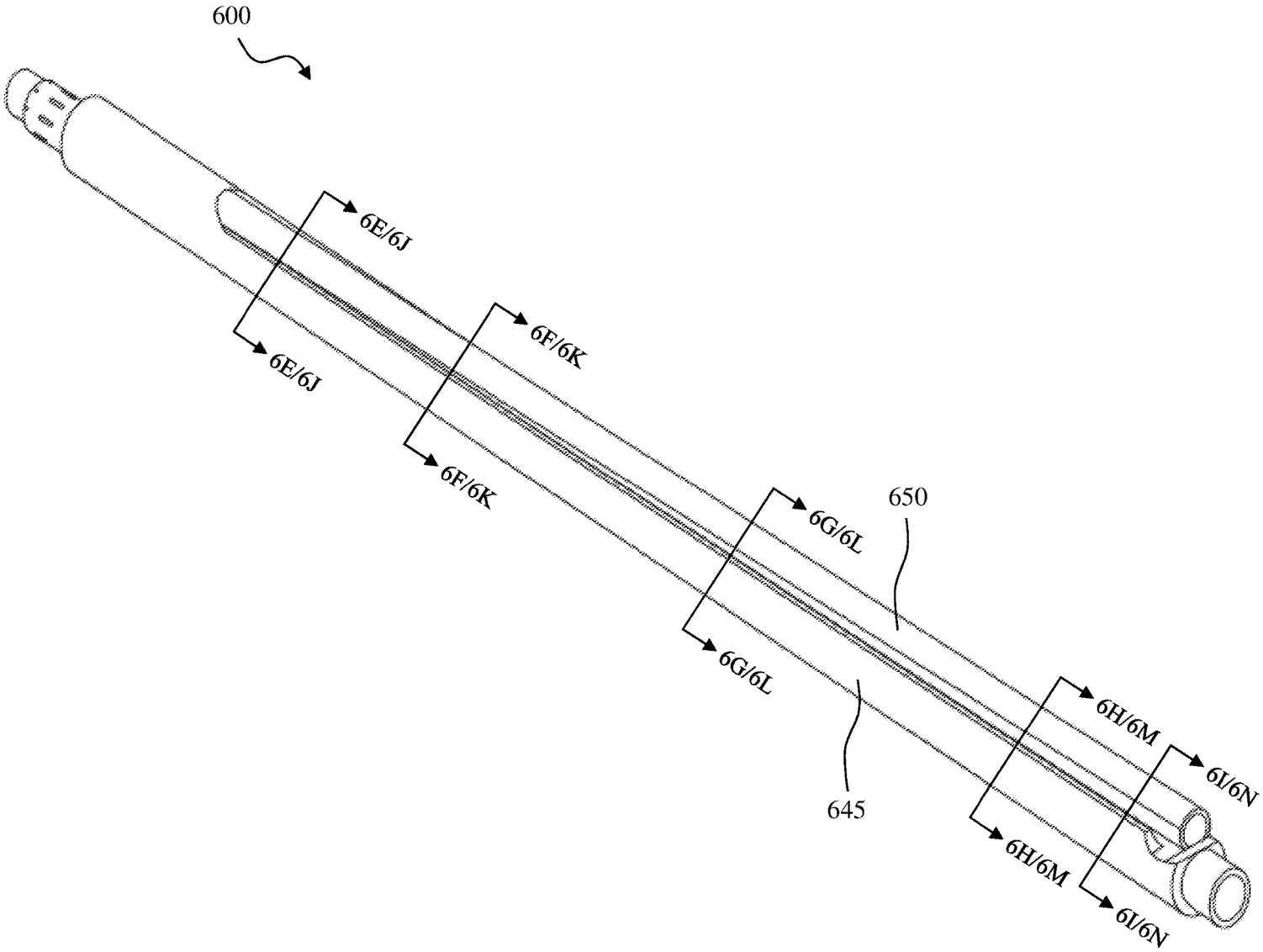
Figure 6E:
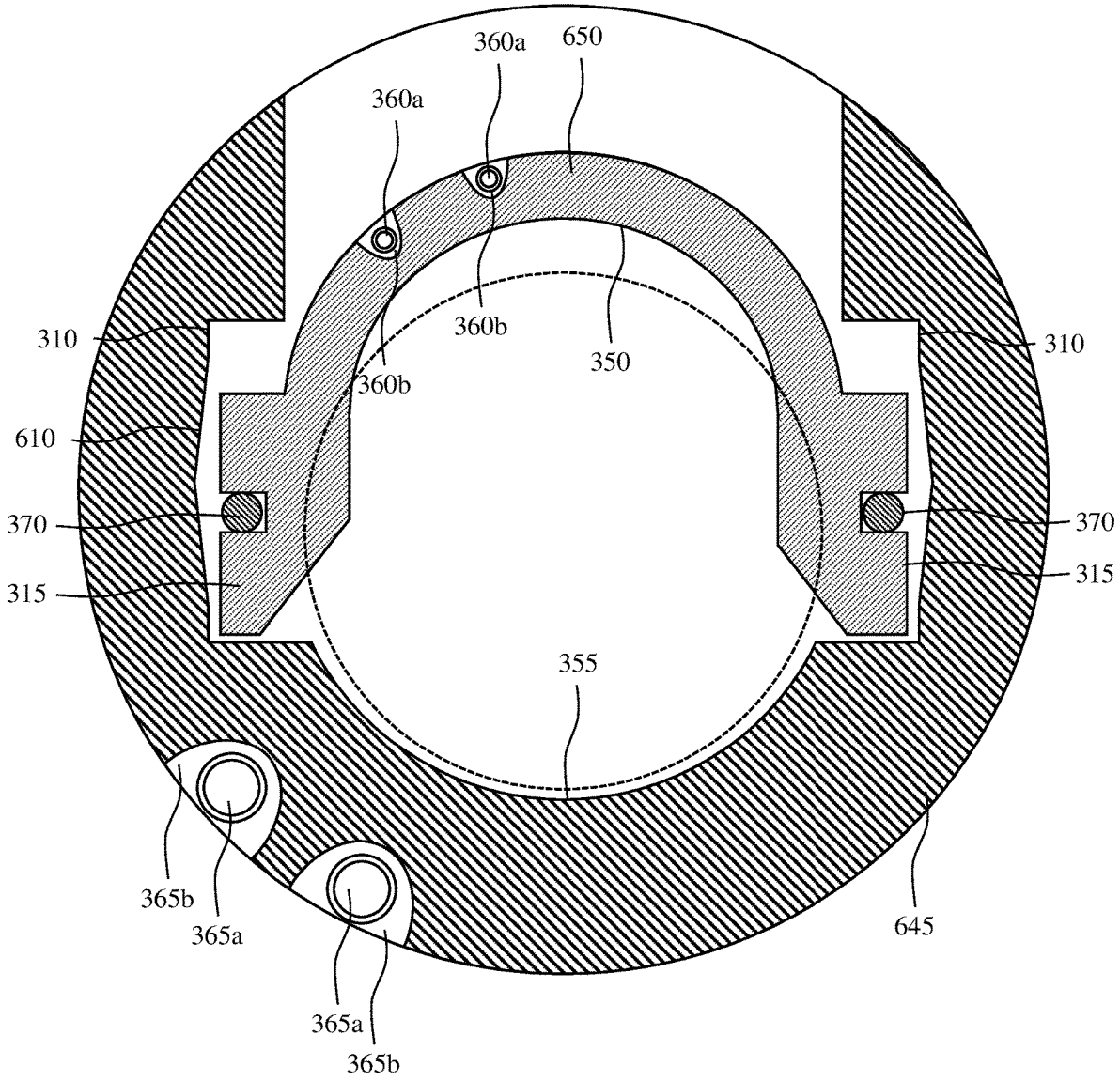
Figure 6F:
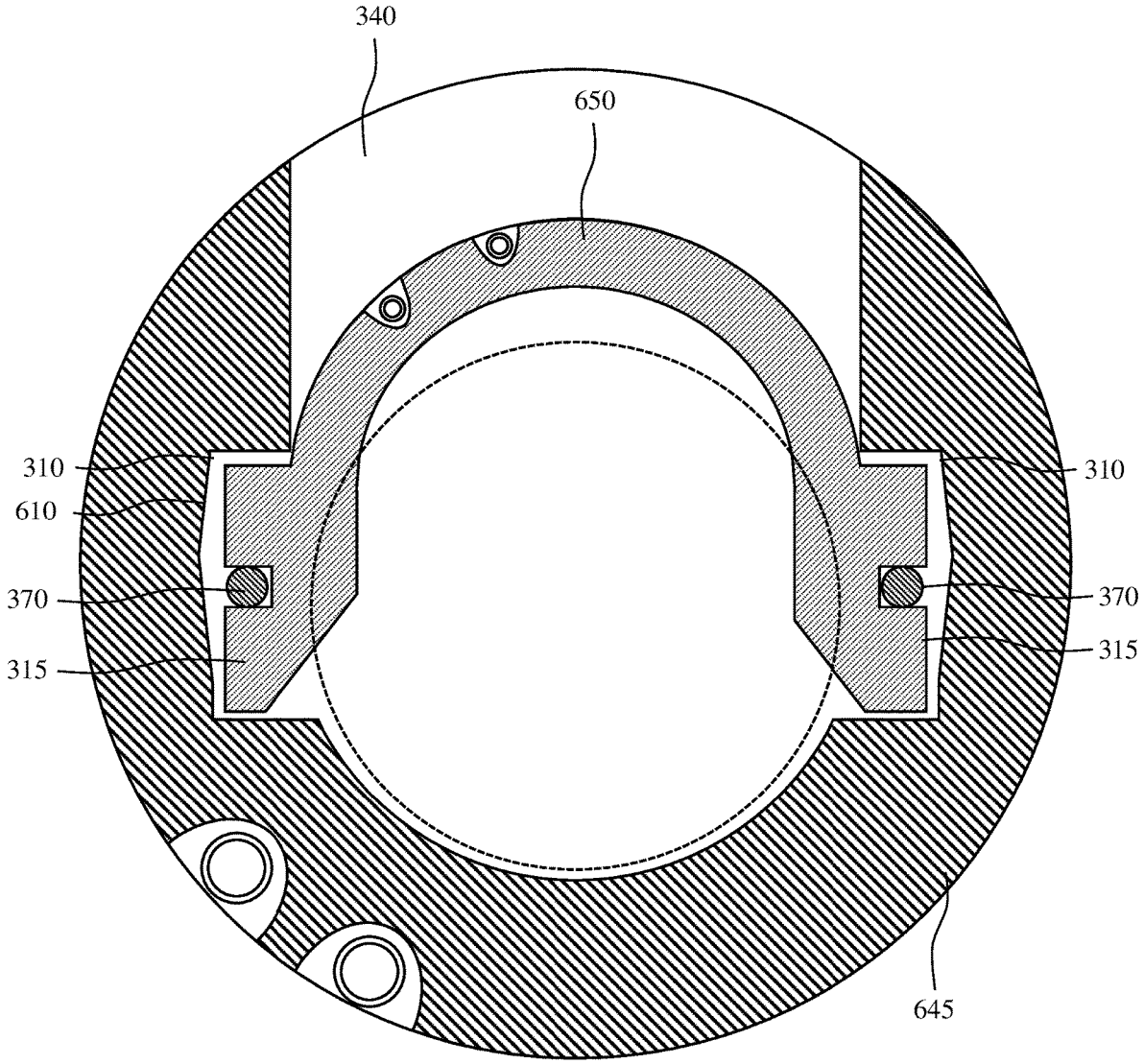
Figure 6G:
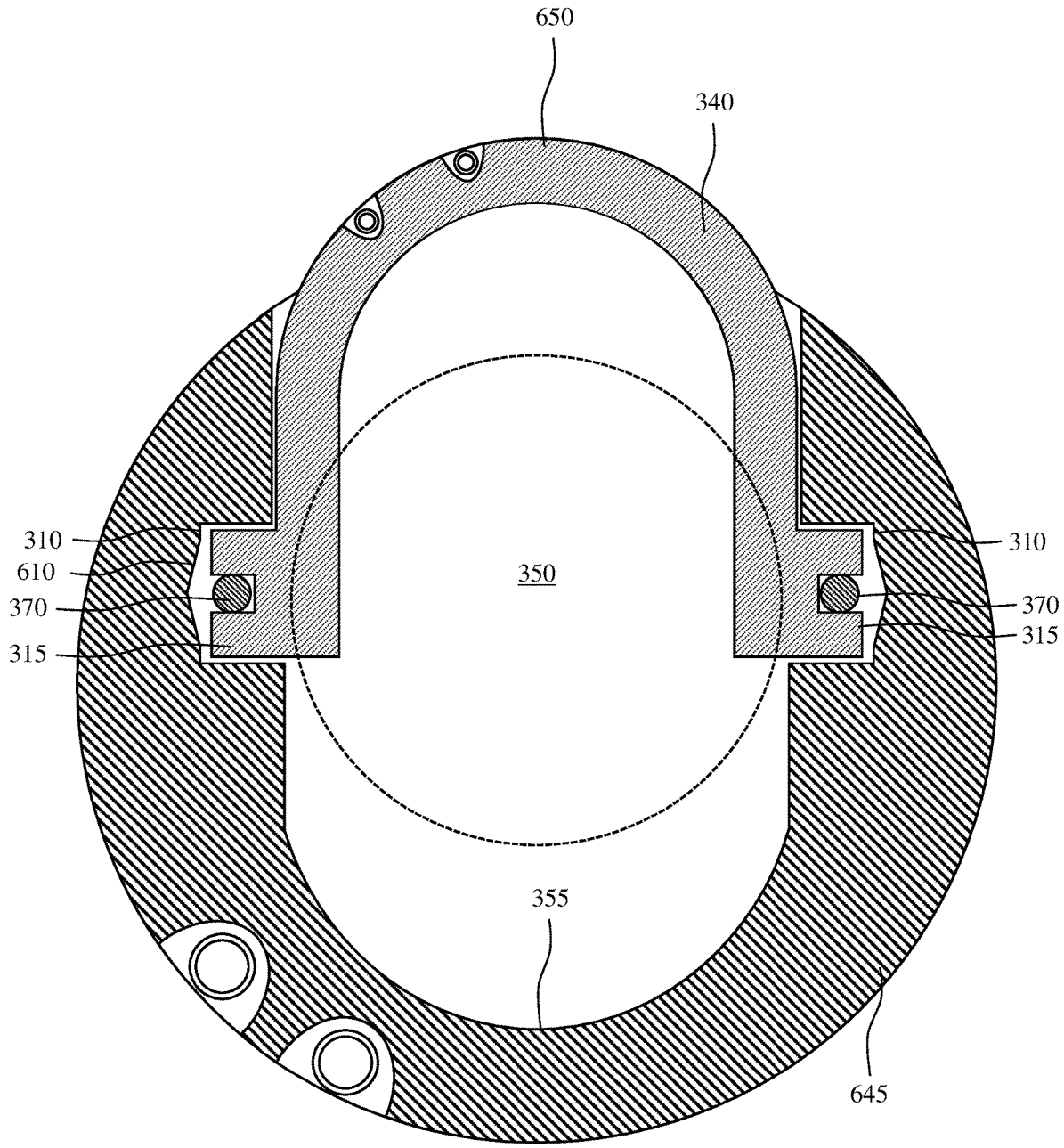
Figure 6H:
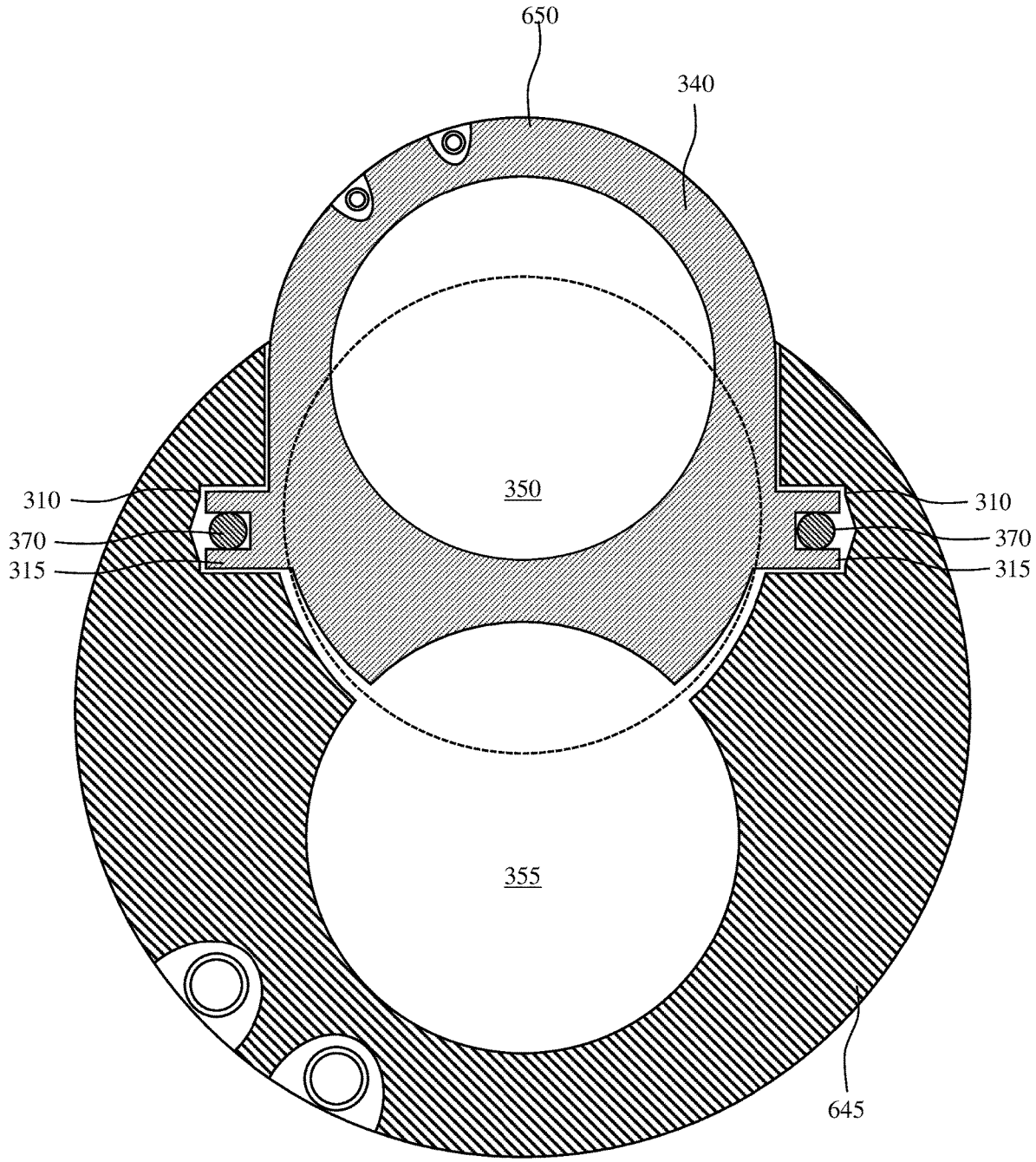
Figure 6I:
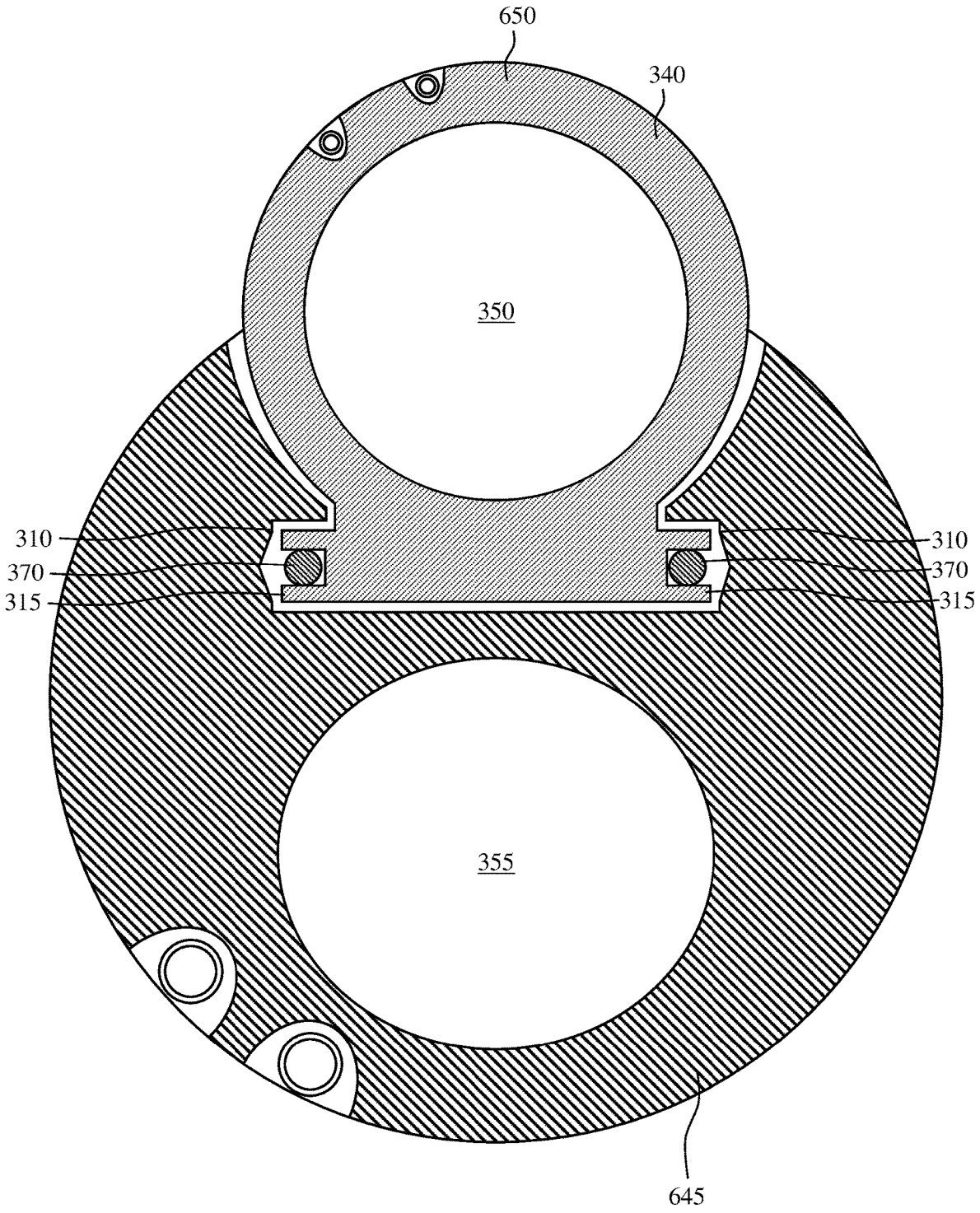
Figure 6J:
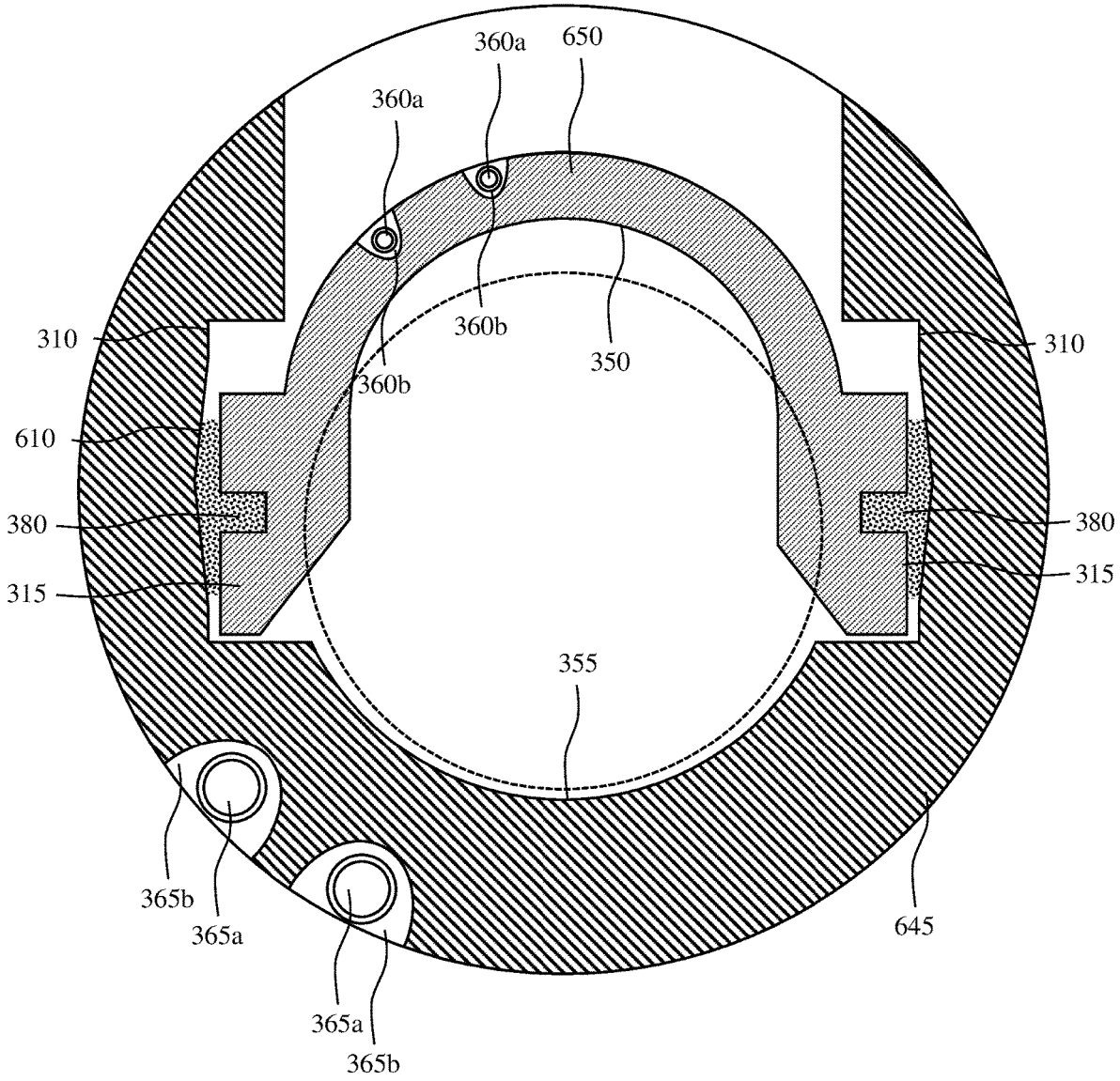
Figure 6K:
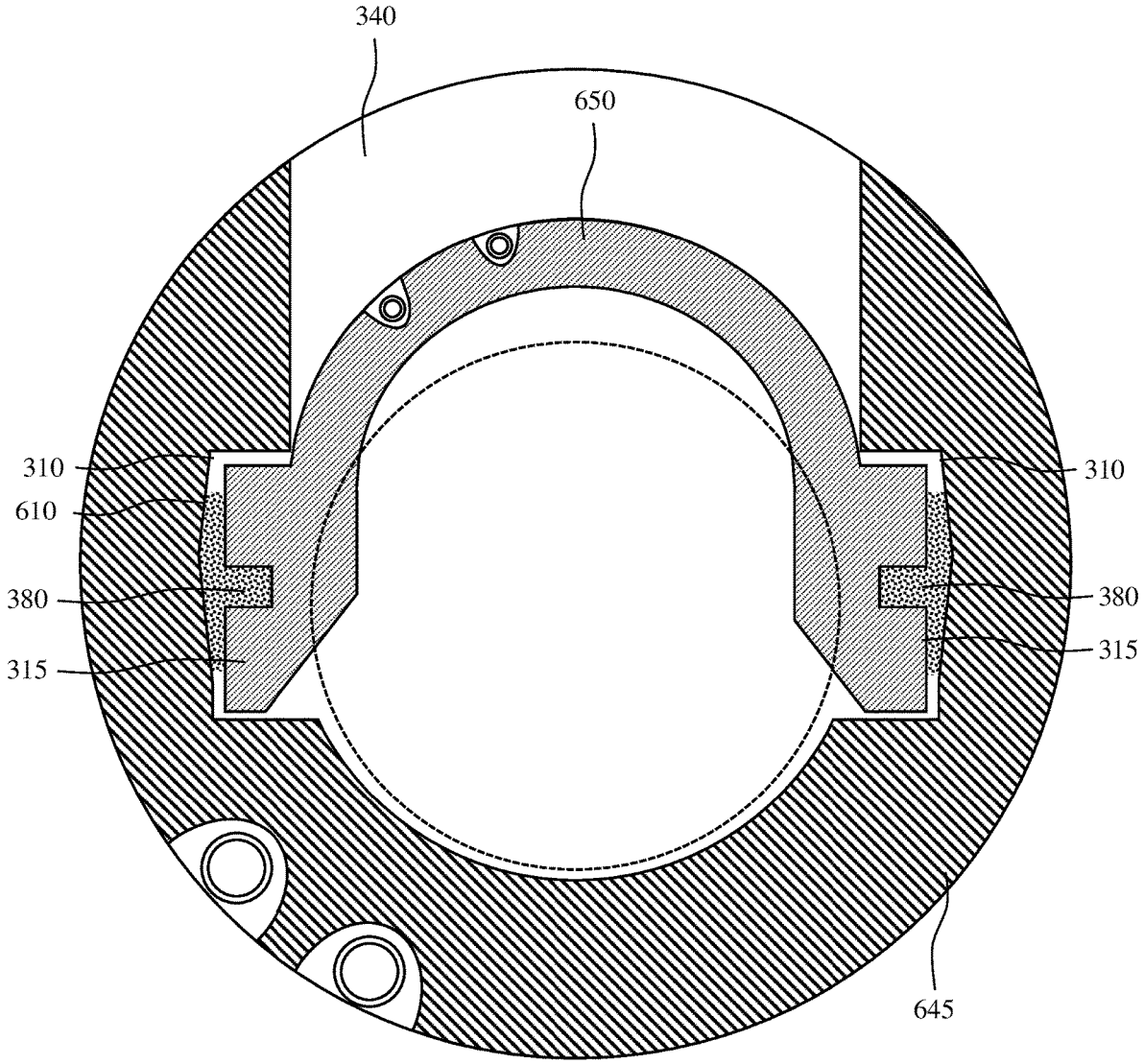
Figure 6L:
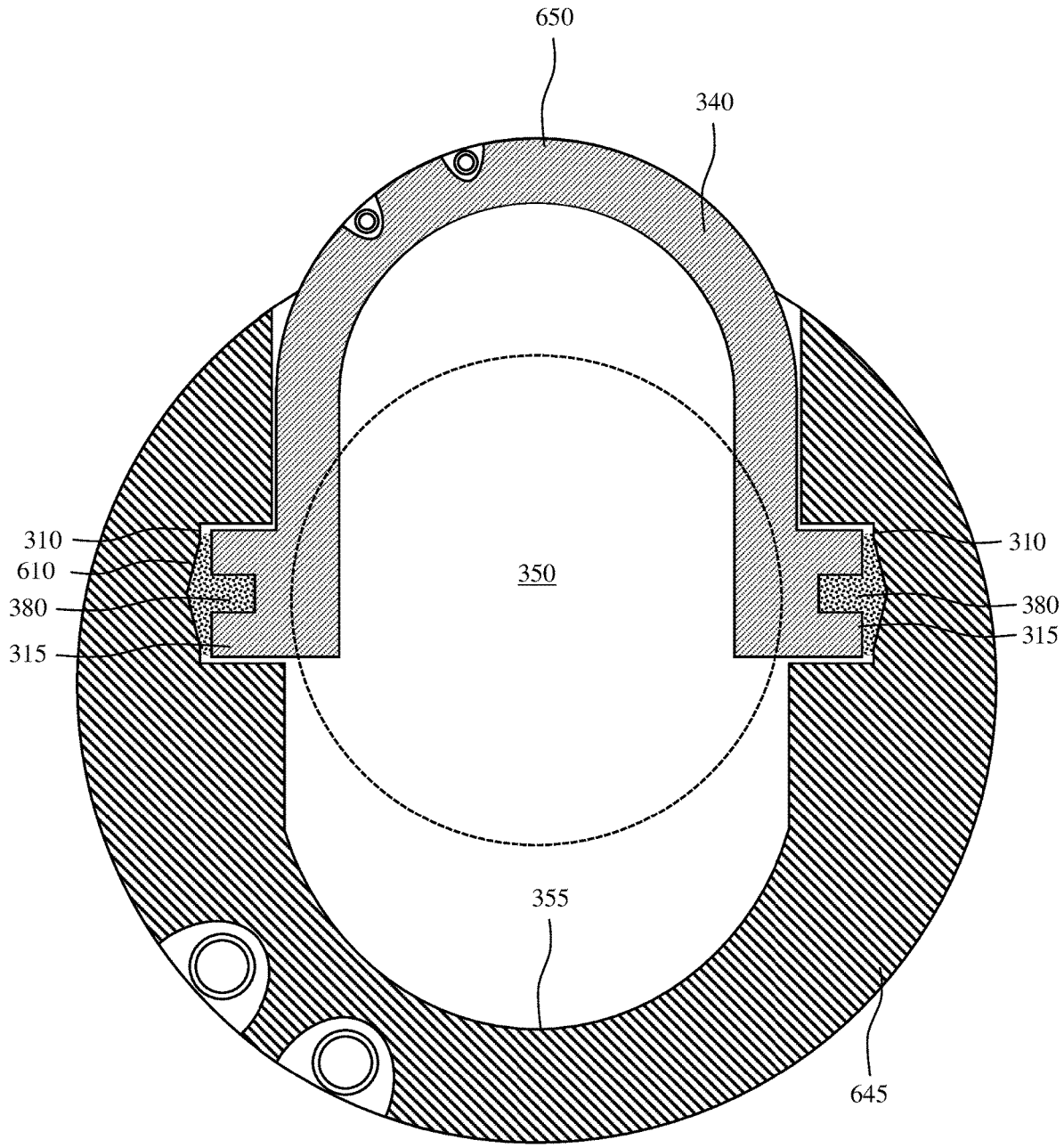
Figure 6M:
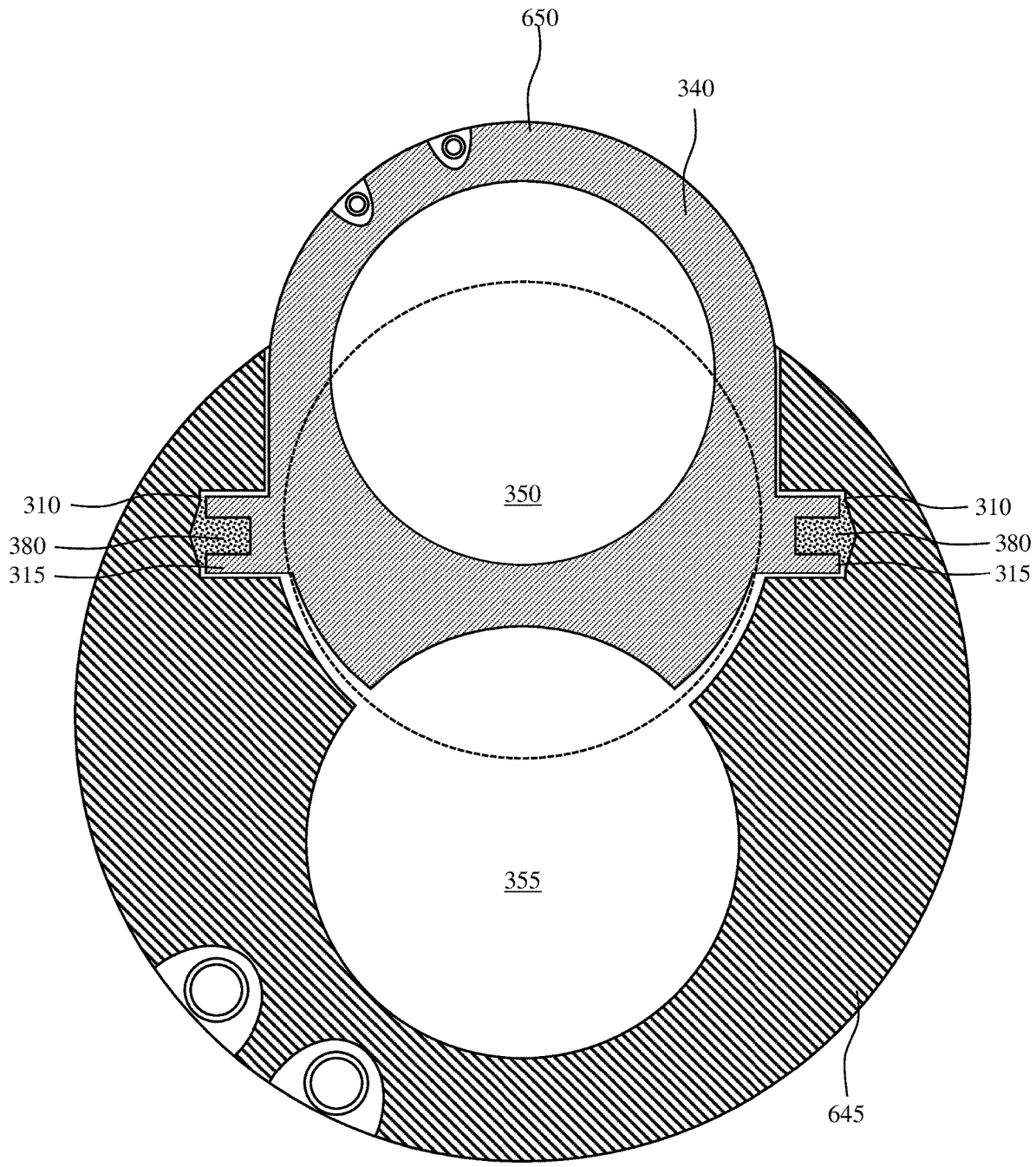
Figure 6N:
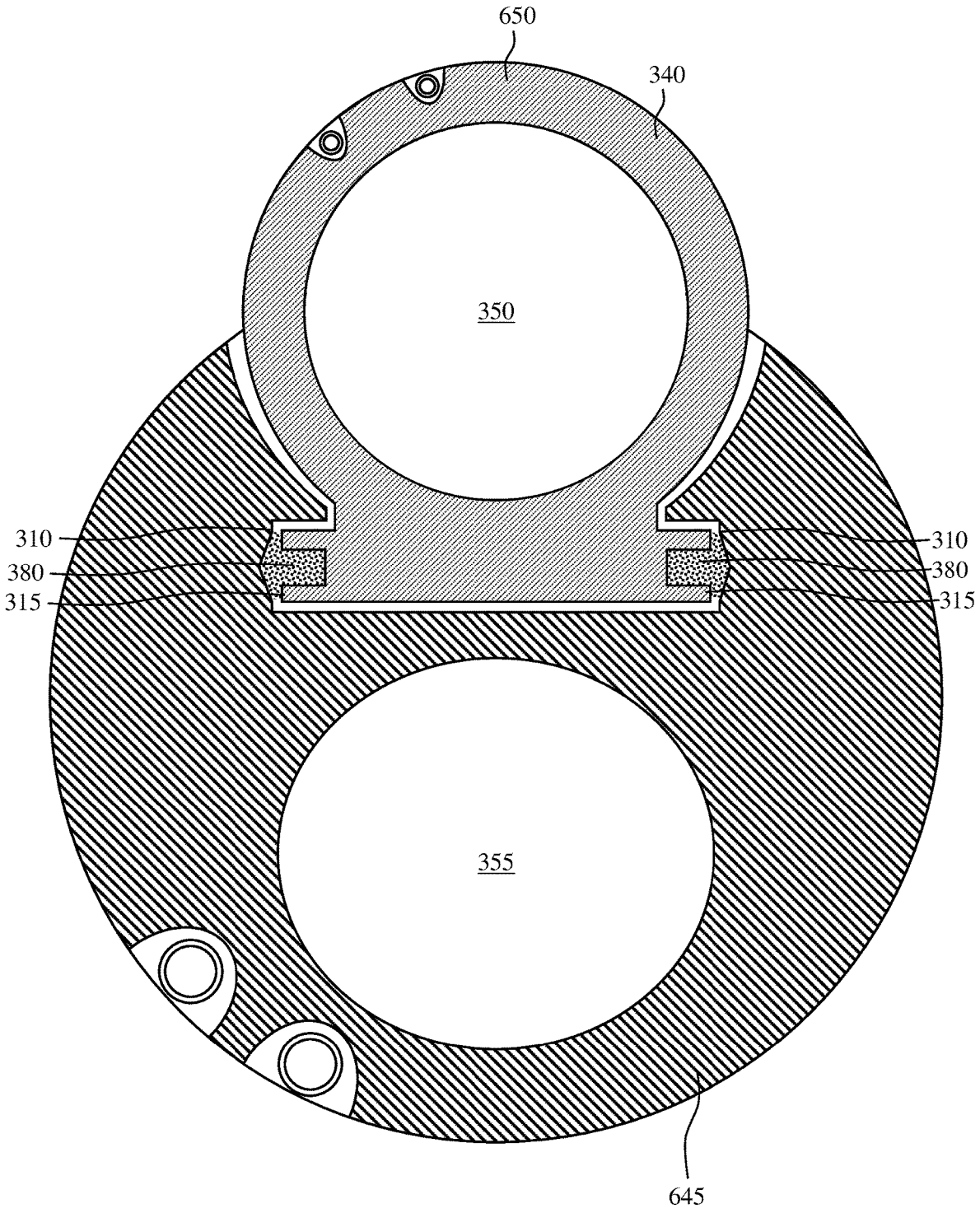
Figure 7A:
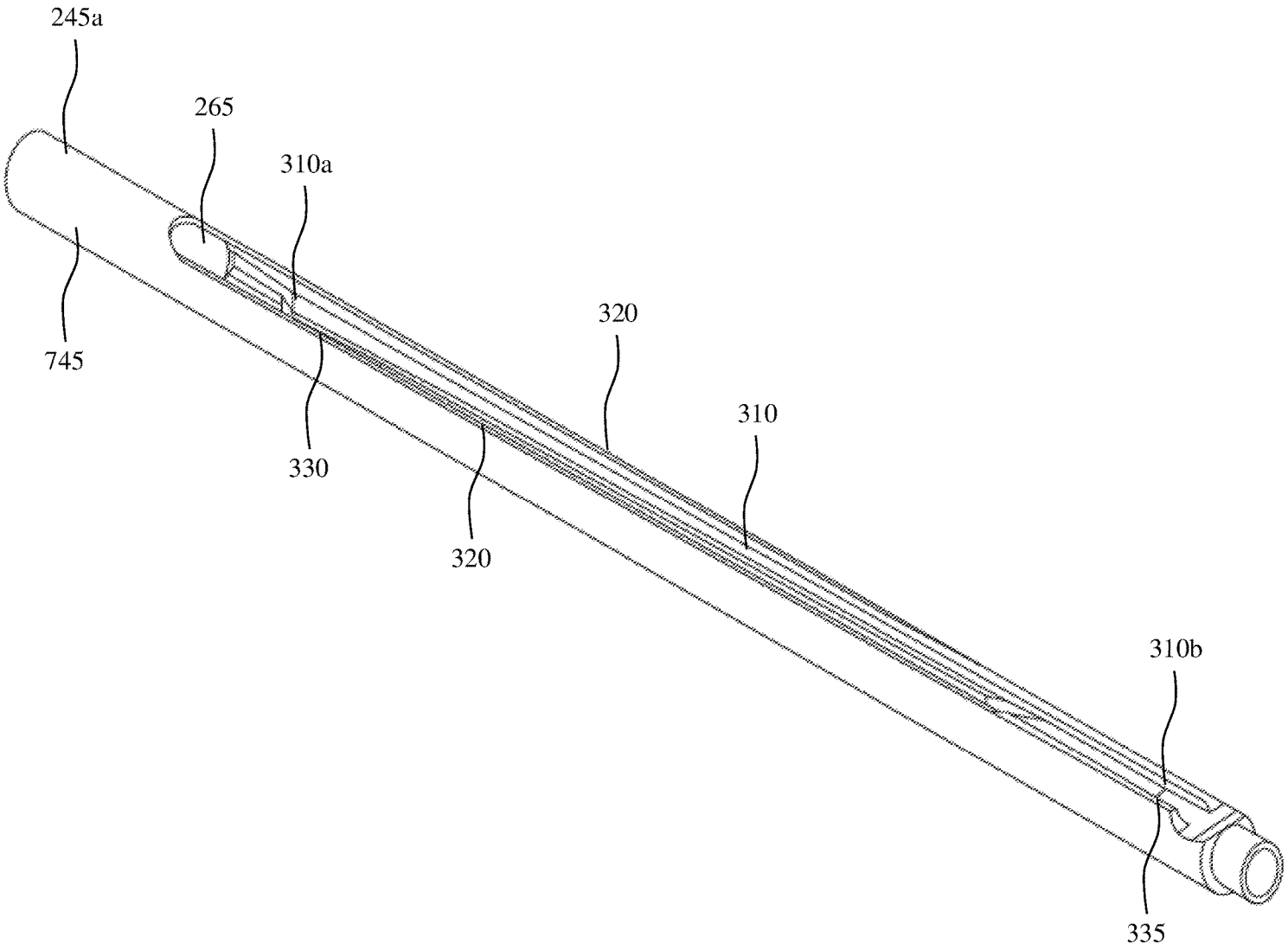
Figure 7B:
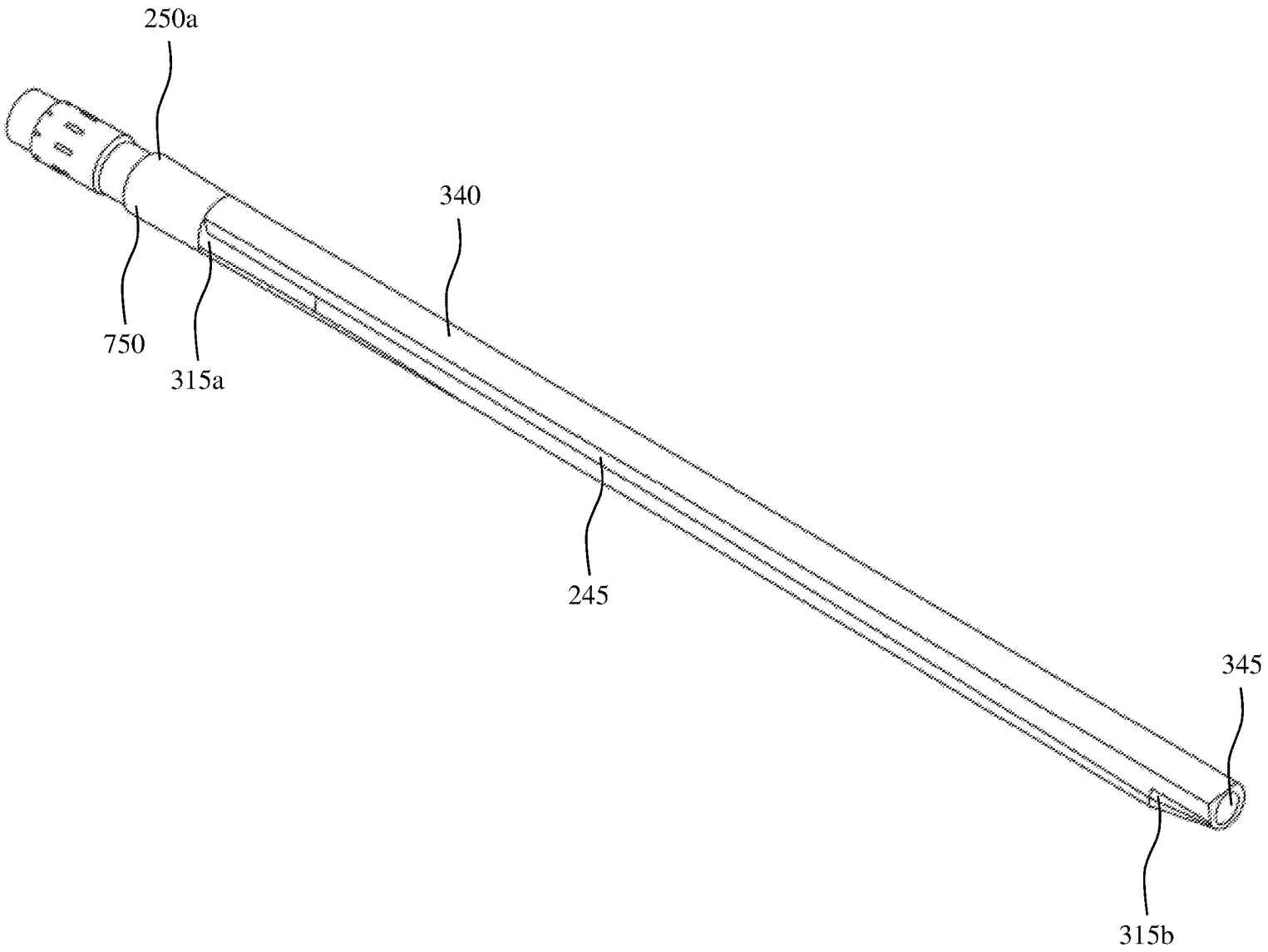
Figure 7C:
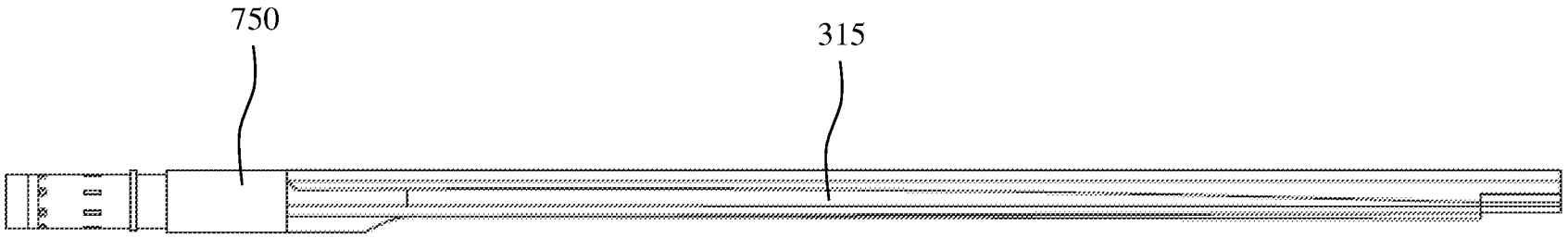
Figure 7D:
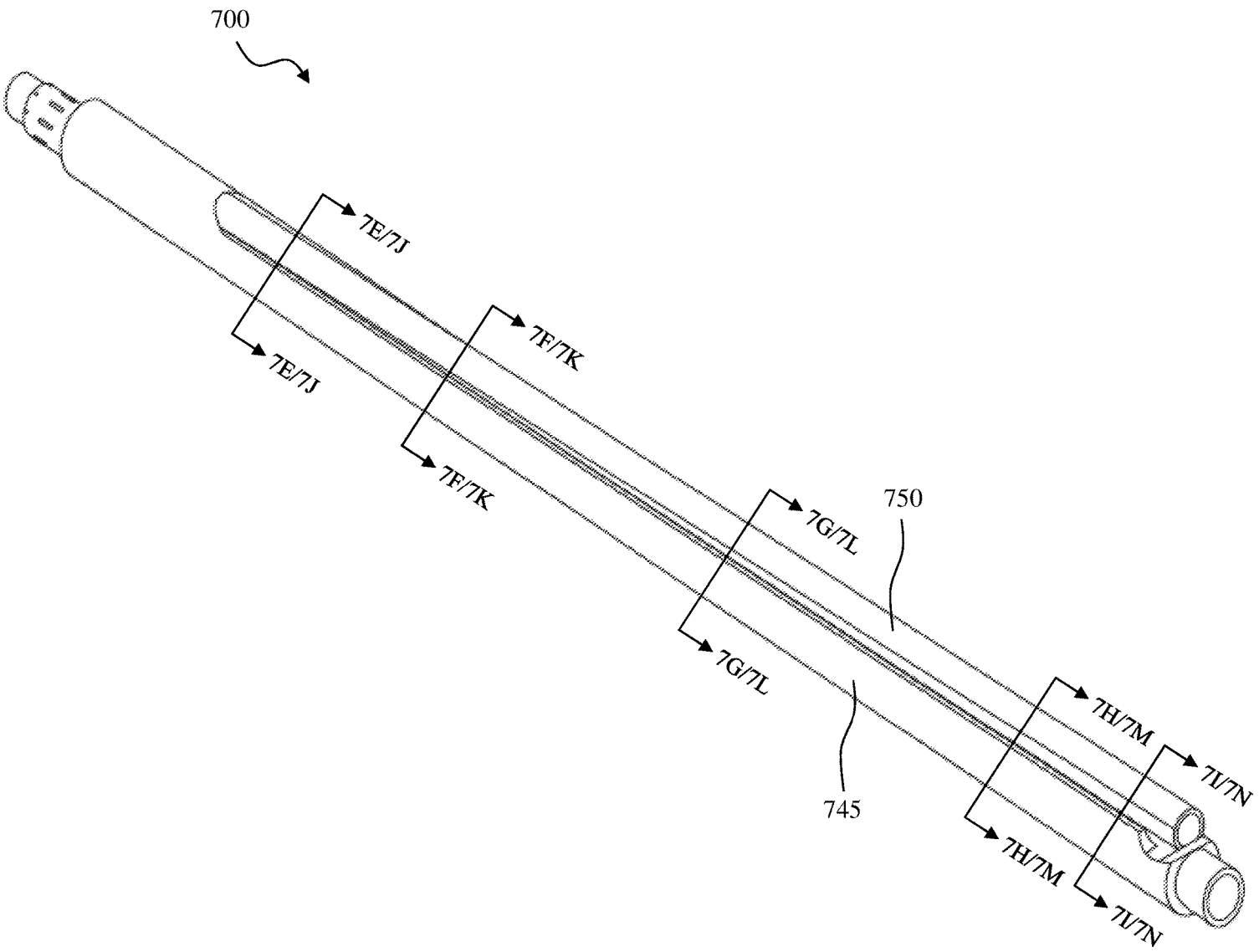
Figure 7E:
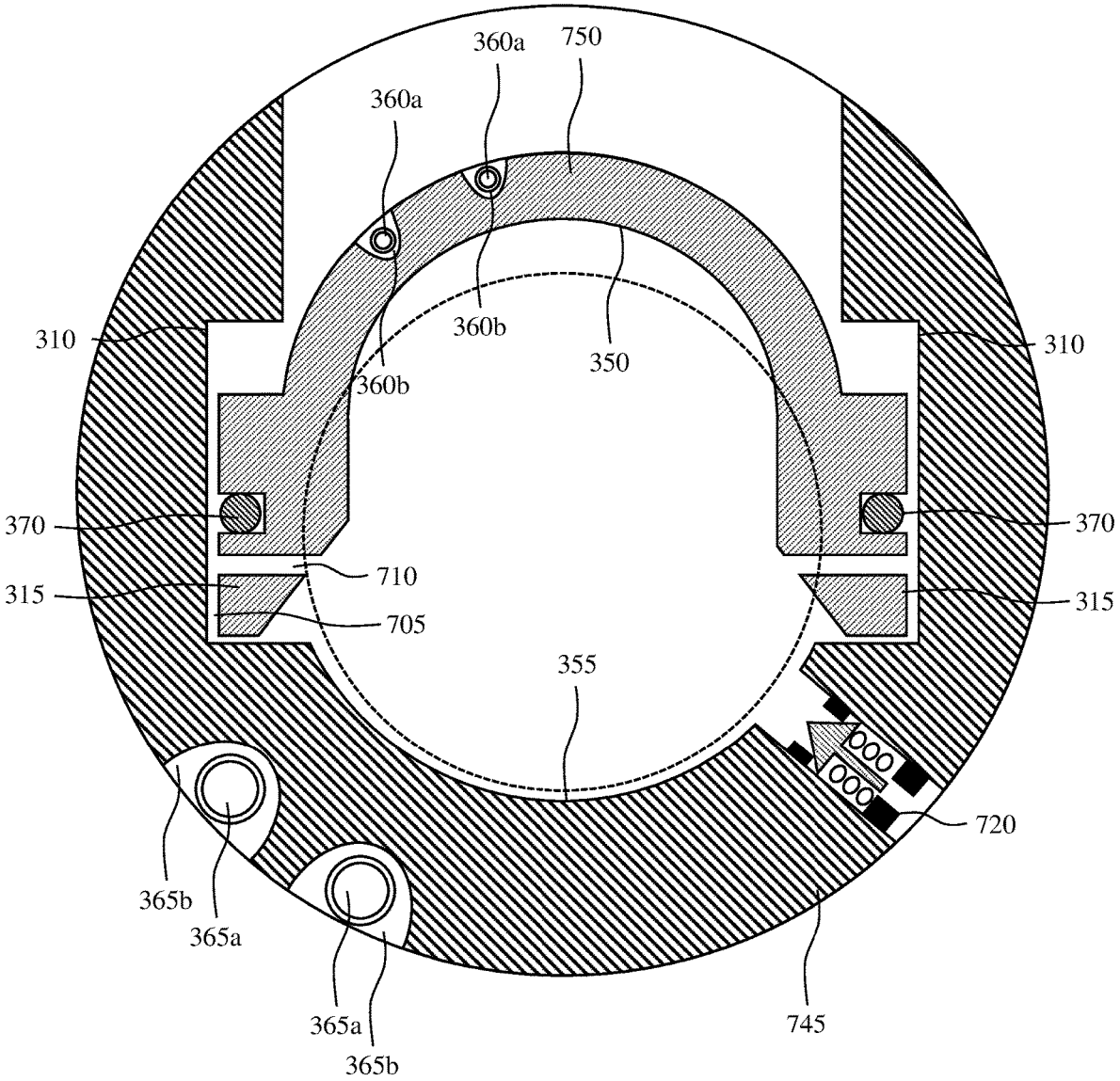
Figure 7F:
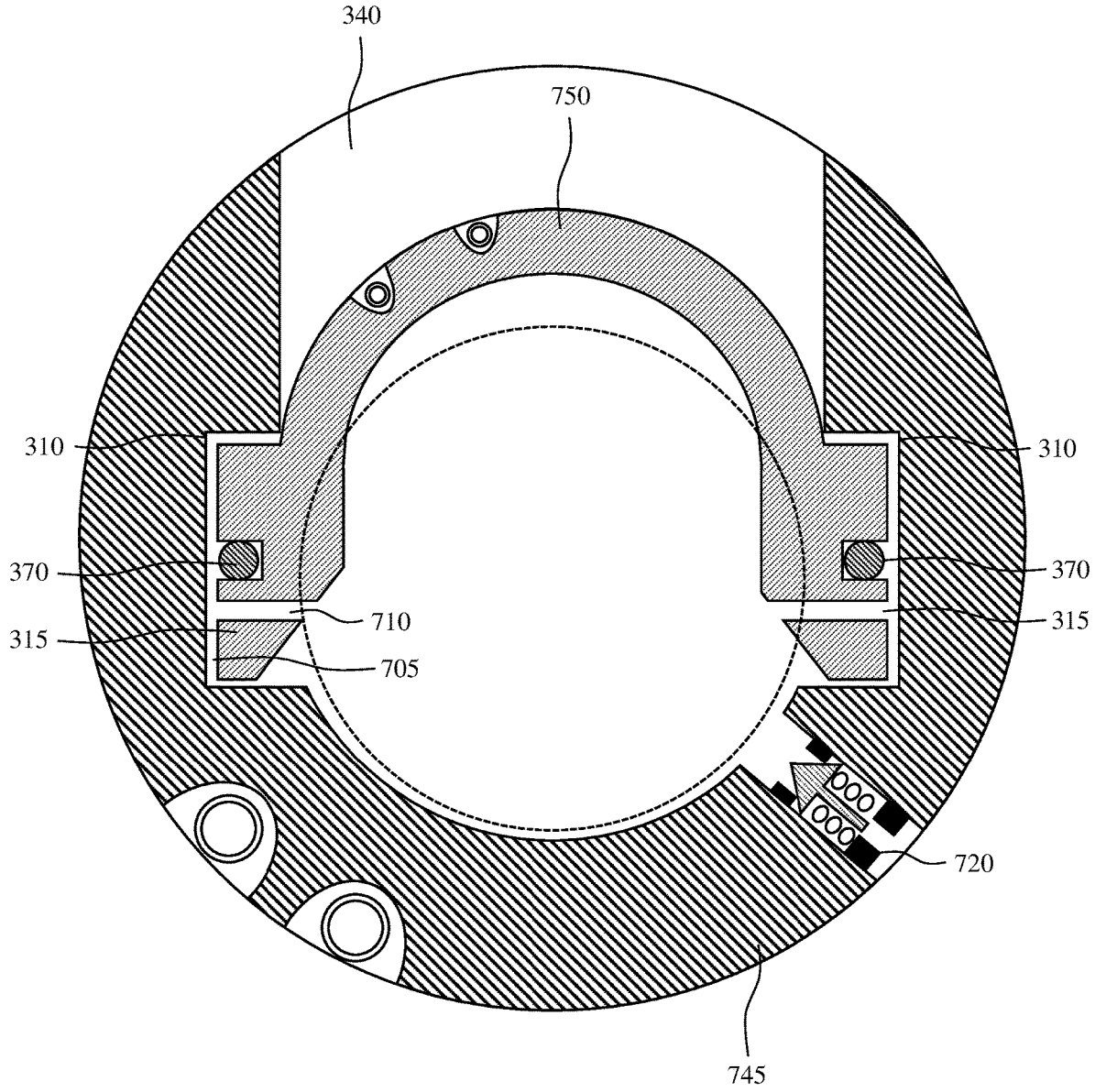
Figure 7G:
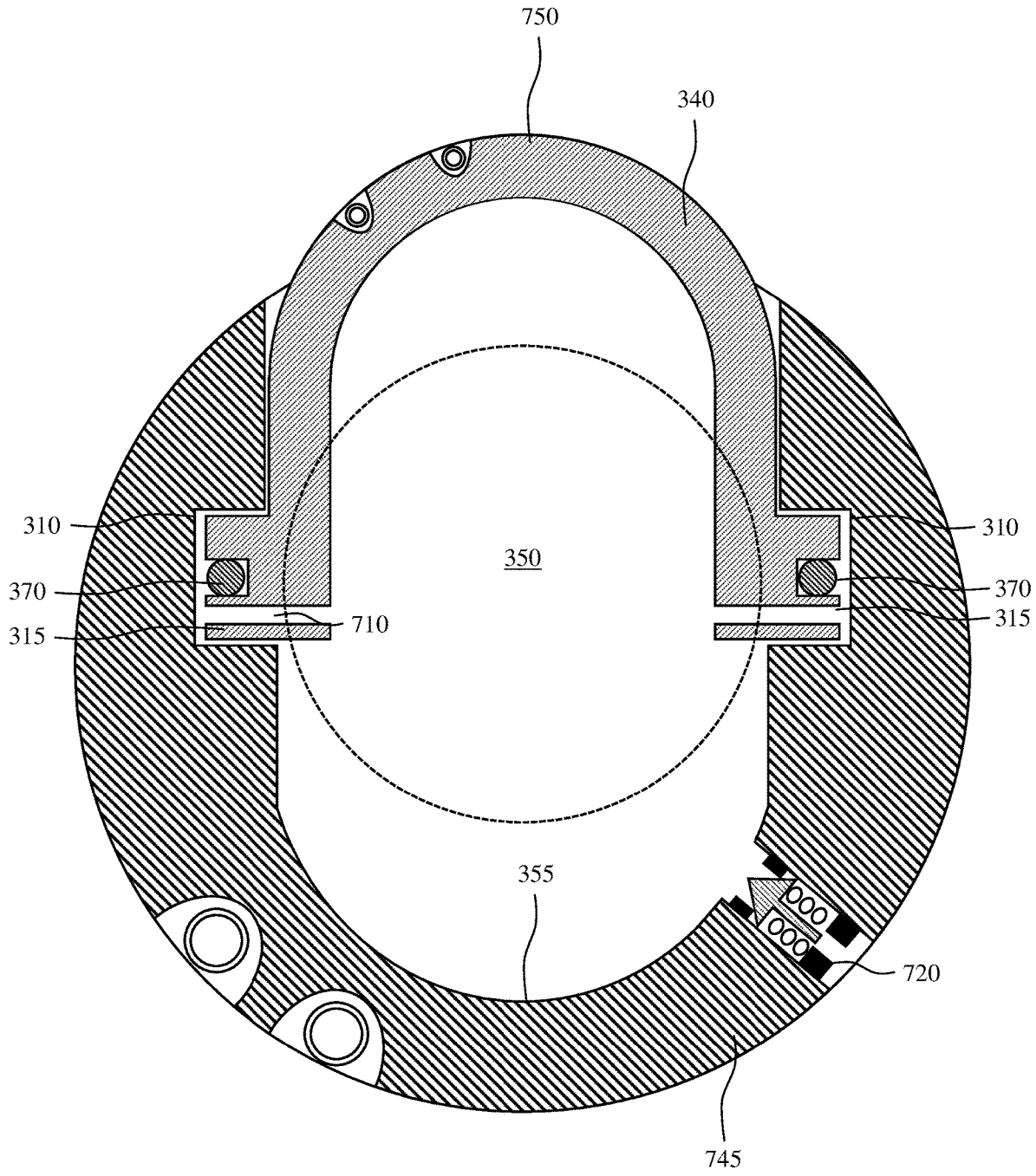
Figure 7H:
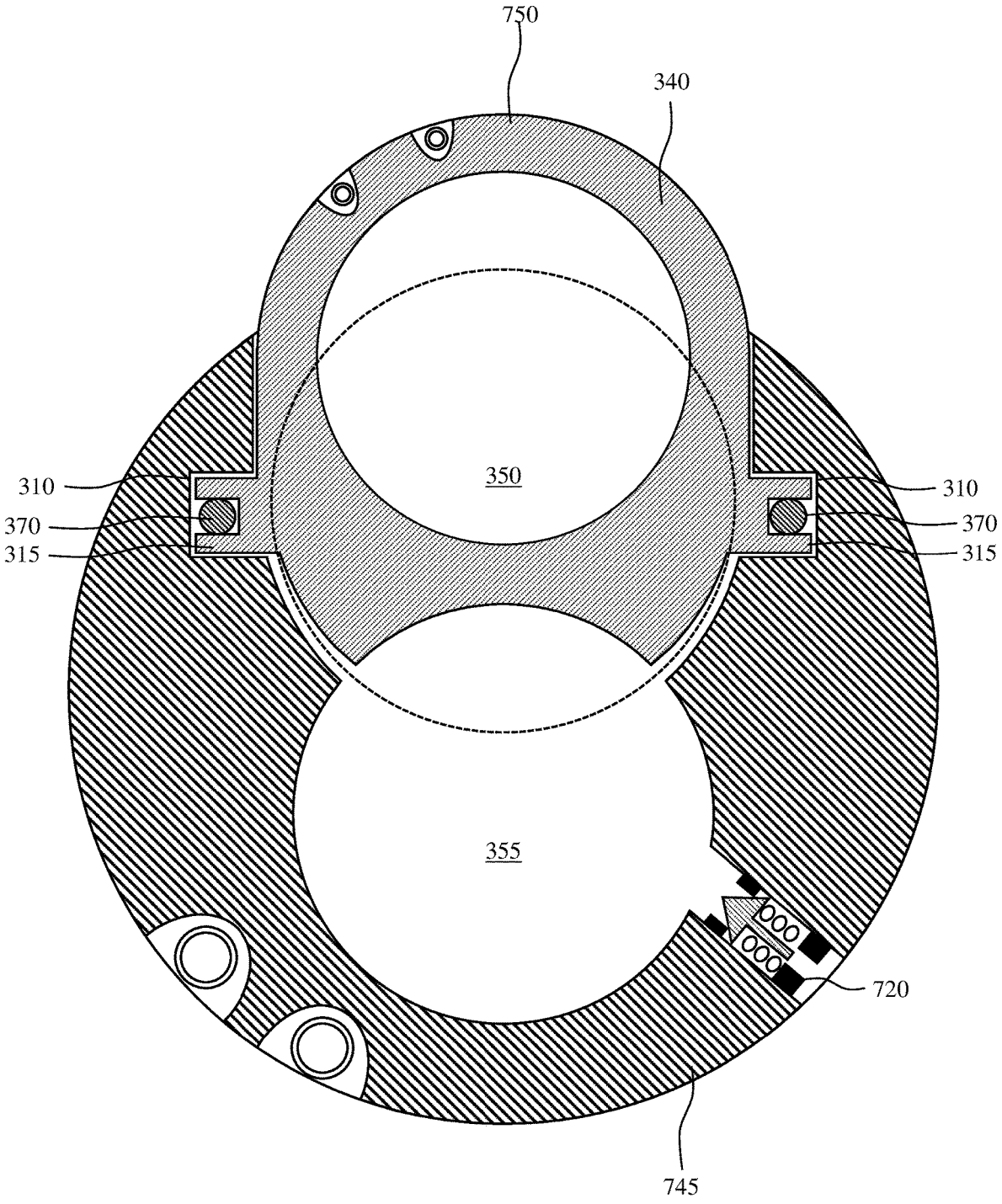
Figure 7I:
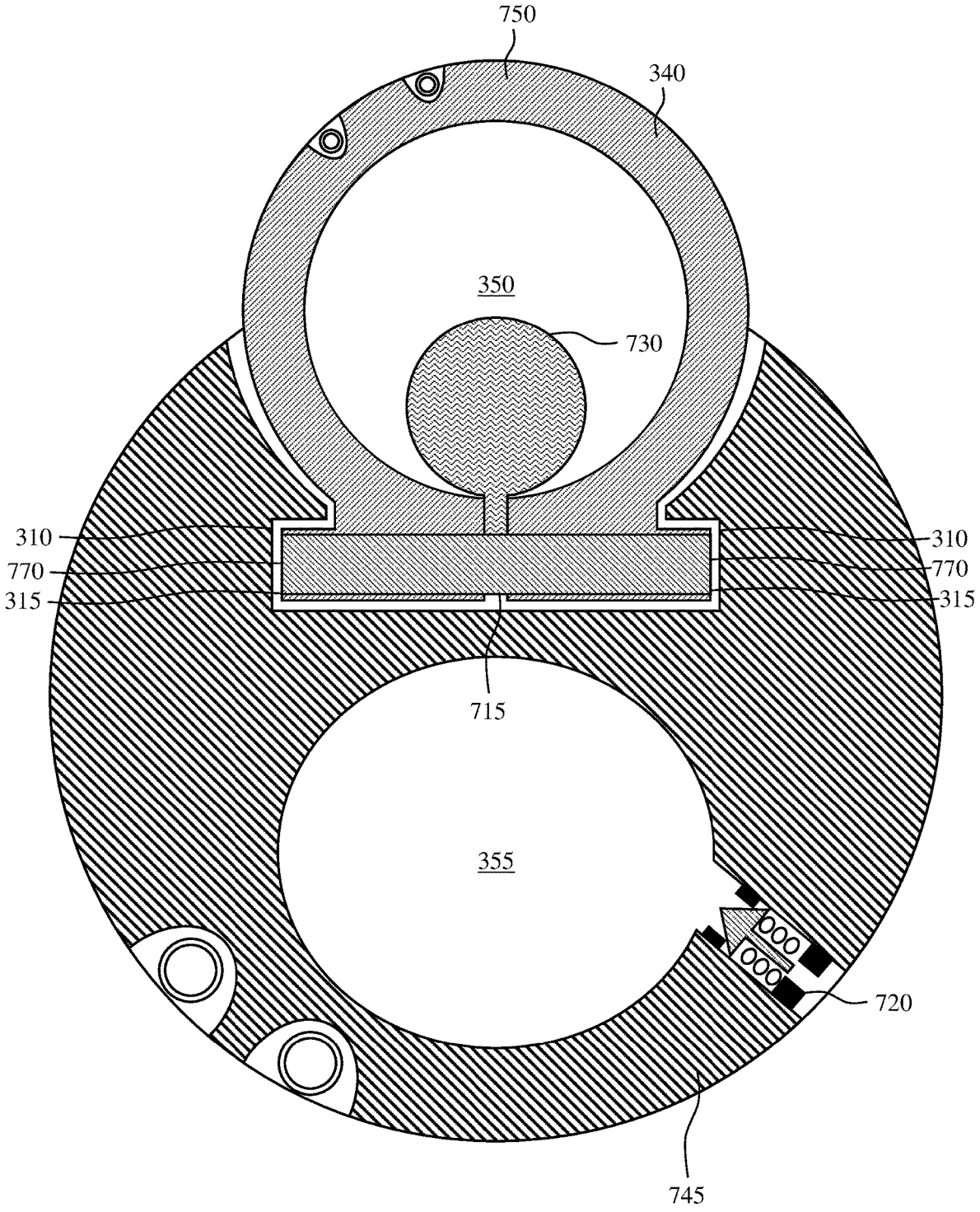
Figure 7J:
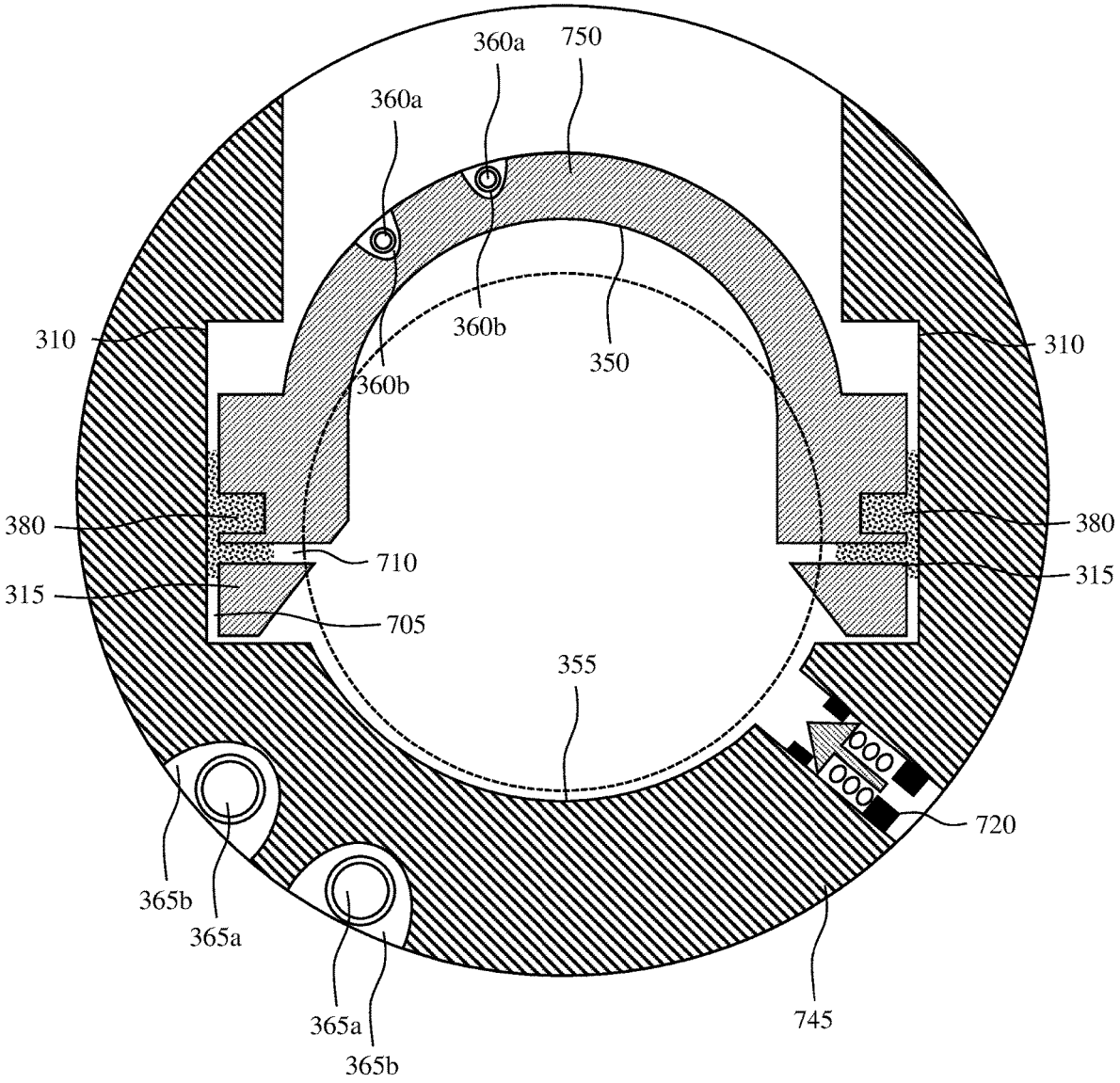
Figure 7K:
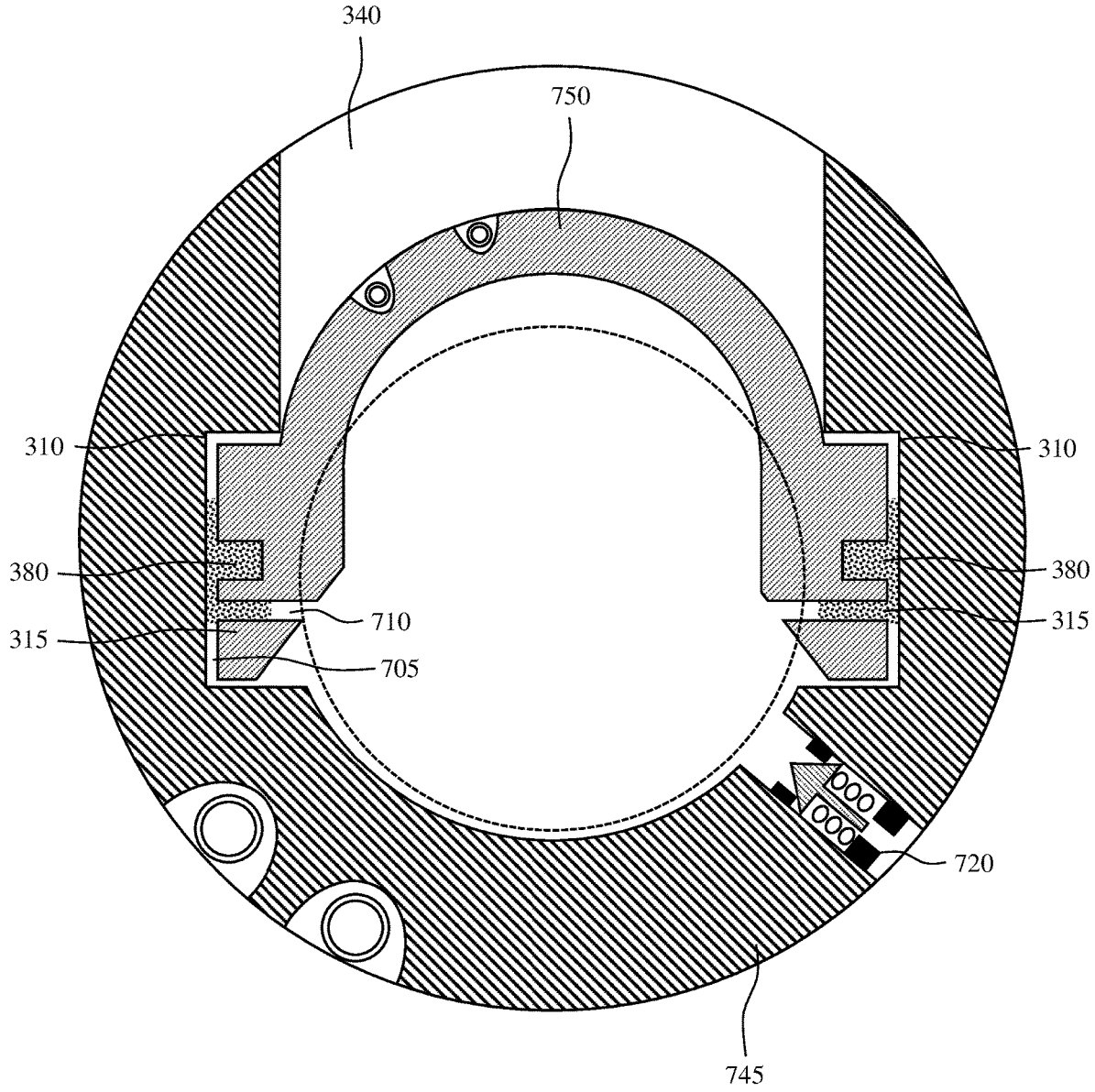
Figure 7L:
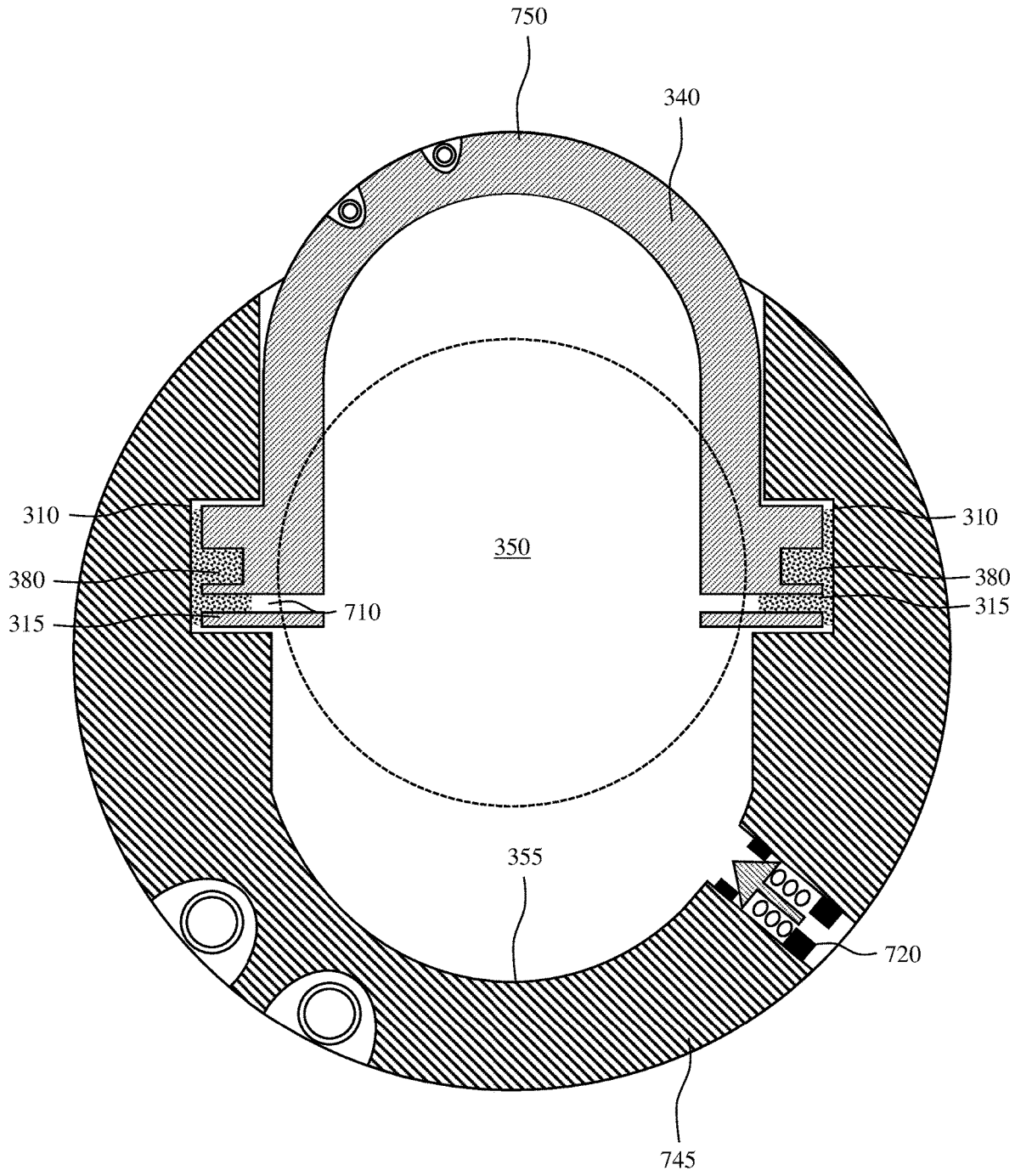
Figure 7M:
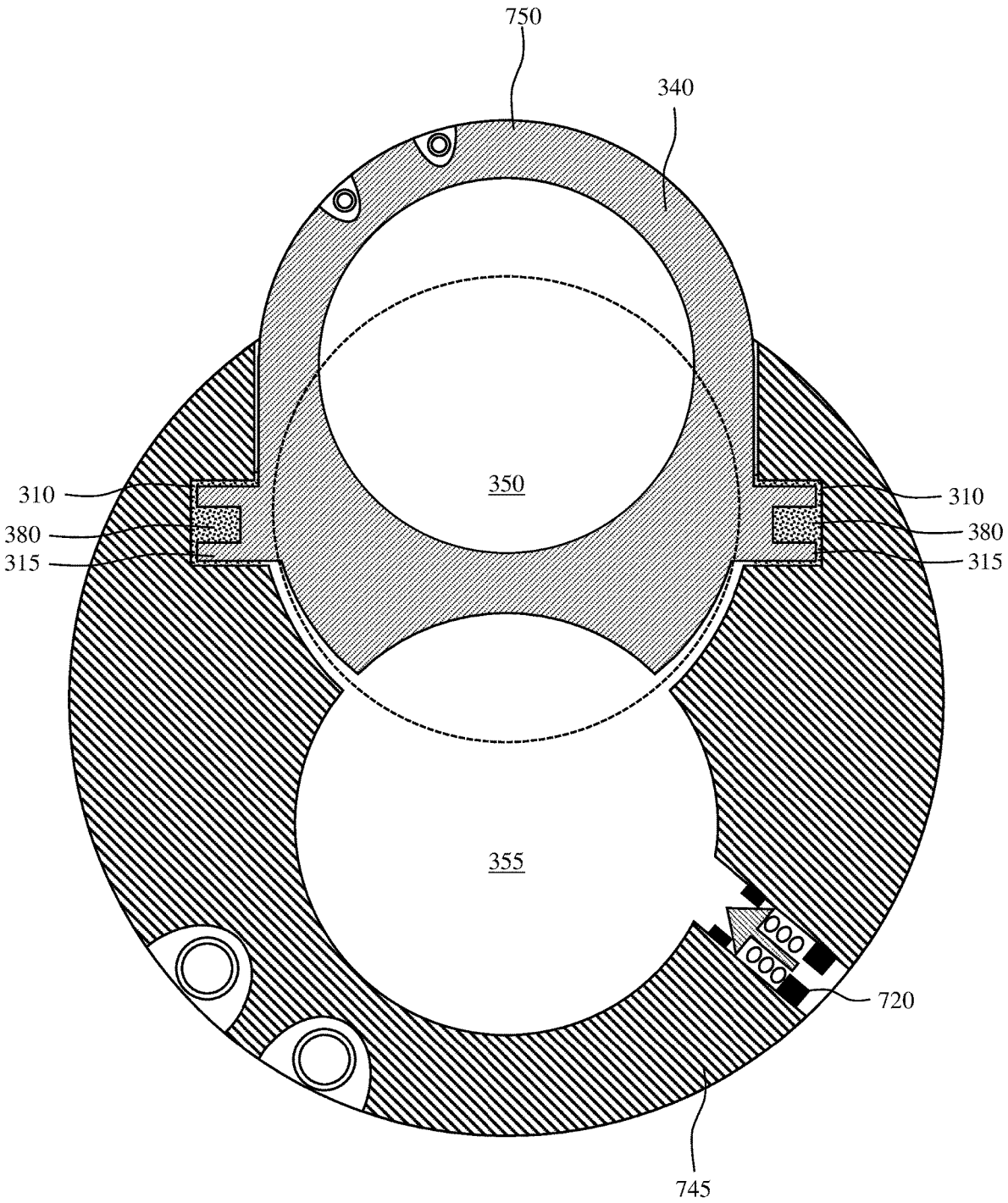
Figure 7N:
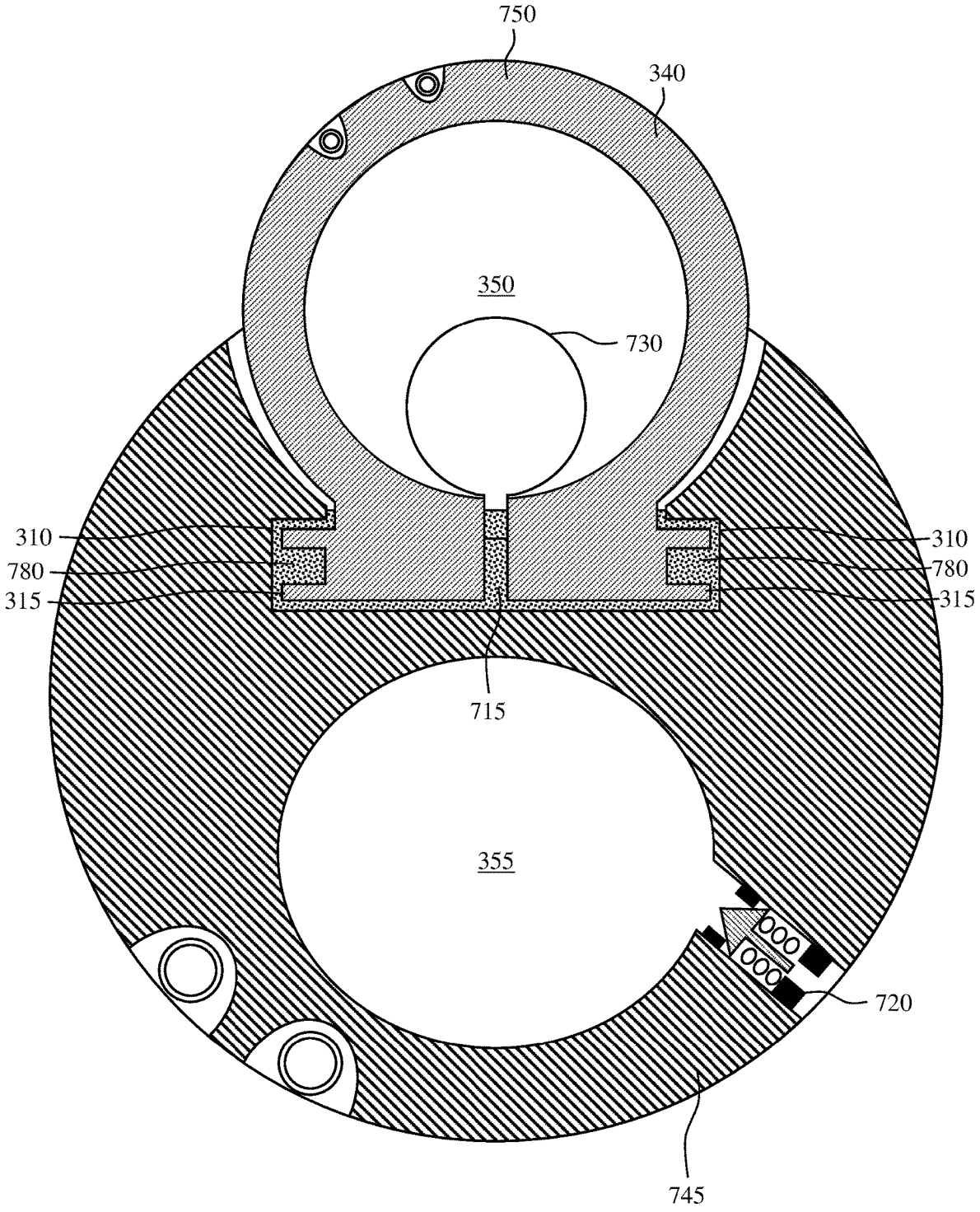

FIGS. 6A through 6N illustrate various different views of an alternative embodiment of a multilateral junction, including a lateral branch template and lateral branch connector, designed, manufactured and/or operated according to one or more embodiments of the disclosure; and FIGS. 7A through 7N illustrate various different views of an alternative embodiment of a multilateral junction, including a lateral branch template and lateral branch connector, designed, manufactured and/or operated according to one or more embodiments of the disclosure.

DETAILED DESCRIPTION

In the drawings and descriptions that follow, like parts are typically marked throughout the specification and drawings with the same reference numerals, respectively. The drawn figures are not necessarily to scale. Certain features of the disclosure may be shown exaggerated in scale or in somewhat schematic form and some details of certain elements may not be shown in the interest of clarity and conciseness. The present disclosure may be implemented in embodiments of different forms.

Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to a direct interaction between the elements and may also include an indirect interaction between the elements described. Unless otherwise specified, use of the terms "up," "upper," "upward," "uphole," "upstream," or other like terms shall be construed as generally away from the bottom, terminal end of a well; likewise, use of the terms "down," "lower," "downward," "downhole," "downstream," or other like terms shall be construed as generally toward the bottom, terminal end of the well, regardless of the wellbore orientation. Use of any one or more of the foregoing terms shall not be construed as denoting positions along a perfectly vertical axis. In some instances, a part near the end of the well can be horizontal or even slightly directed upwards. Unless otherwise specified, use of the term "subterranean formation" shall be construed as encompassing both areas below exposed earth and areas below earth covered by water, such as ocean or fresh water.

Figure 1:
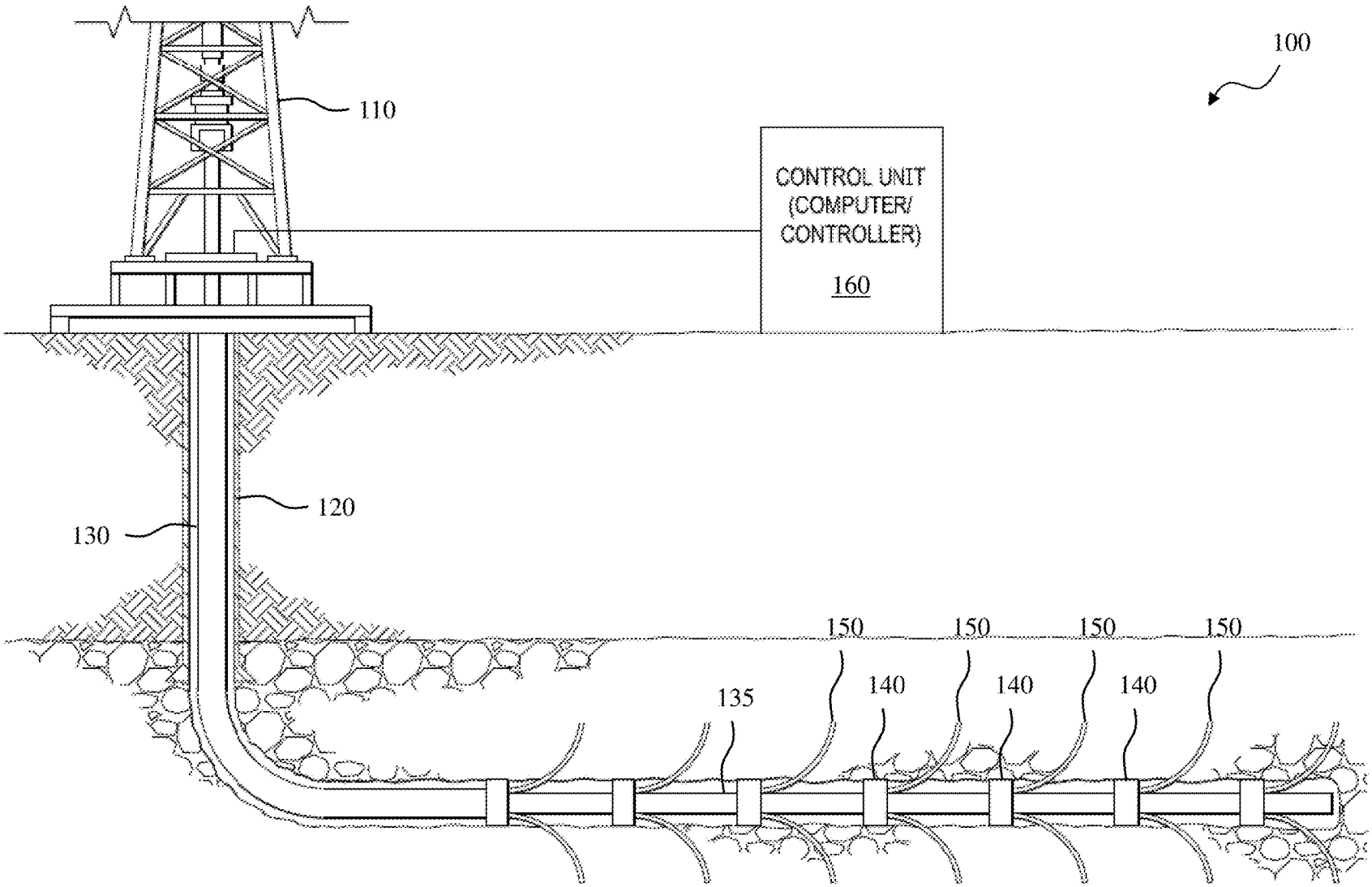
FIG. 1 illustrates a well system for hydrocarbon reservoir production, the well system including a multilateral junction designed, manufactured and operated according to one or more embodiments of the disclosure.

Referring now to FIG. 1, illustrated is a well system 100 for hydrocarbon reservoir production, according to certain example embodiments. The well system 100 in one or more embodiments includes a pumping station 110, a main wellbore 120, and tubing 130, 135, which may have differing tubular diameters. The well system 100 may additionally include a plurality of multilateral junctions 140, and lateral wellbore legs 150 with additional tubing integrated with a main bore of the tubing 130, 135. Each multilateral junction 140 may comprise one or more features designed, manufactured or operated according to the disclosure. The well system 100 may additionally include a control unit 160. The control unit 160, in one embodiment, is operable to provide control to and/or from the multilateral junctions and/or lateral legs 140, 150, as well as other devices downhole.

Figure 2:
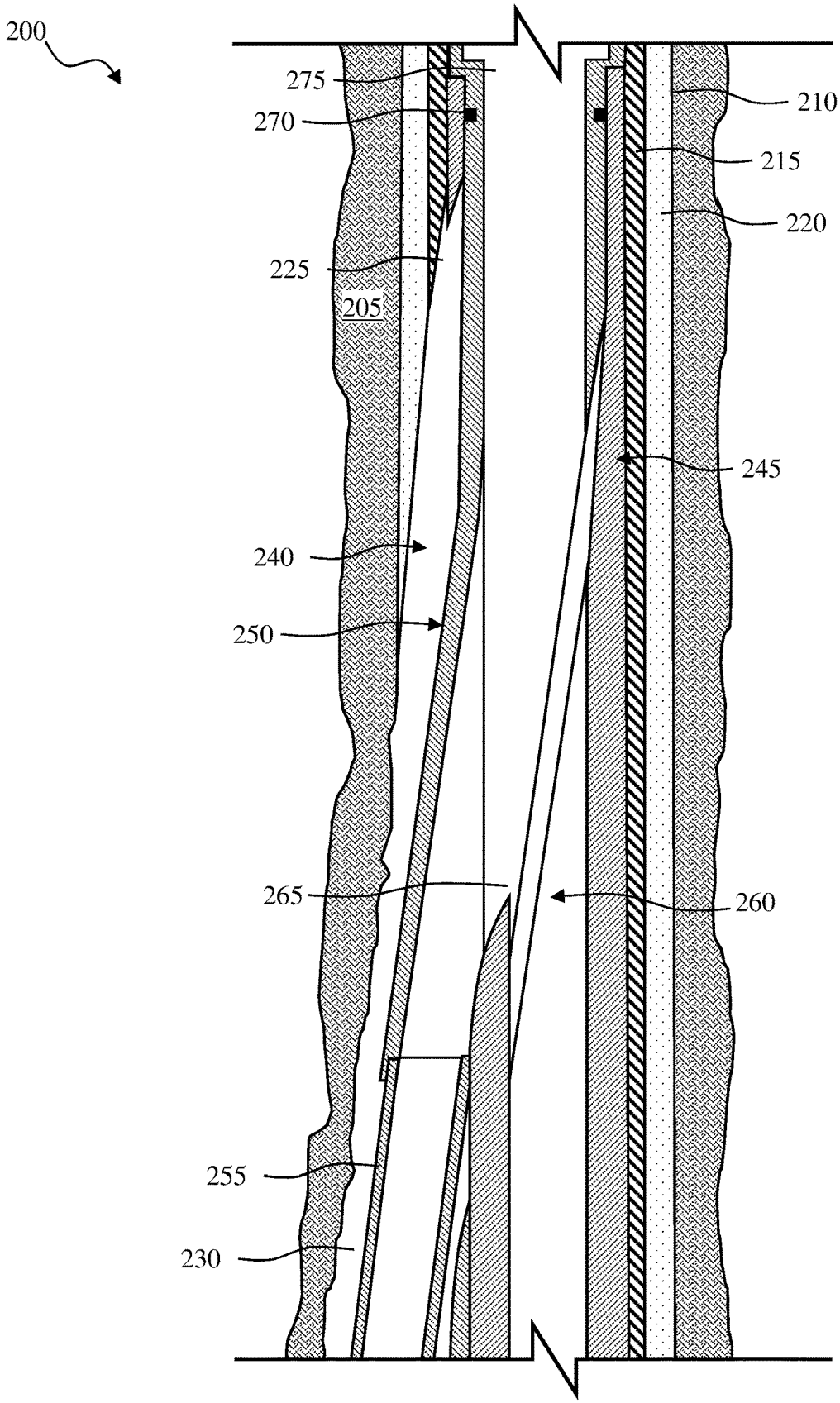
FIG. 2 illustrates a cross-sectional view of an alternative embodiment of a well system designed, manufactured and/or operated according to one or more embodiments of the disclosure.

Turning to FIG. 2, illustrated is a cross-sectional view of an alternative embodiment of a well system 200 designed, manufactured and/or operated according to one or more embodiments of the disclosure. The well system 200, in one or more embodiments, includes a multilateral junction, shown generally at 240, positioned within a wellbore casing 215 of a main wellbore 210 that is drilled through one or more subterranean formations 205.

In the illustrated embodiment, a lateral branch template 245 is set at a desired location within the wellbore casing 215, which in one embodiment may be set by cement 220 within the main wellbore 210. The cement 220, in one embodiment, is pumped into the annulus between the wellbore casing 215 and the main wellbore 210, and is allowed to harden so that the wellbore casing 215 is substantially integral or mechanically interlocked with respect to the surrounding formation.

A lateral window 225, in one or more embodiments, is formed within the wellbore casing 215, either having been milled prior to the running and cementing of the wellbore casing 215 within the main wellbore 210, or having been milled downhole after the wellbore casing 215 has been run and cemented. In the illustrated embodiment, a lateral wellbore 230 has been drilled from the main wellbore 210, for example employing a branch drilling tool (not shown) that is diverted from the main wellbore 210 through the lateral window 225 and outwardly into the formation surrounding the main wellbore 210. The lateral wellbore 230, in one embodiment, is drilled along an inclination that is established by a whipstock or other suitable drill orientation control tool. The lateral wellbore 230, in one or more embodiments, is also drilled along a predetermined azimuth that is established by the relation of the drill orientation control tool and an indexing device (not shown) that is connected into the wellbore casing 215 or set within the wellbore casing 215.

A lateral branch connector 250, engageable within the lateral branch template 245, is attached to a lateral branch liner 255 to connect the lateral wellbore 230 to the main wellbore 210. A ramp 260 cut at a shallow angle in the lateral branch template 245 serves to guide the lateral branch connector 250 toward the lateral window 225 while sliding downwardly along the lateral branch template 245. In addition, as further described below, the lateral branch template 245 and lateral branch connector 250 may have co-operable inter-engagement members that, in addition to connection and sealing functions, also serve to guide the lateral branch connector 250 through the lateral branch template 245 and a window 265 of the lateral branch template 245 into the lateral wellbore 230. The window 265 of the lateral branch template 245, in one embodiment, is azimuthally oriented to align to the direction of the lateral wellbore 230.

Seals 270, which may be carried within optional seal grooves (not shown) of the lateral branch template 245 or lateral branch connector 250, as shown in FIG. 2, may establish sealing between the lateral branch template 245 and the lateral branch connector 250 to provide part of the fluid isolation of the main wellbore 210 and the lateral wellbore 230 from the environment external thereof. Once the lateral branch template 245 and lateral branch connector 250 are engaged, fluid communication between the lateral wellbore 230 and the main wellbore 210 (e.g., above the multilateral junction 240) is established.

The lateral branch connector 250, in one or more embodiments, is designed to withstand loads that are induced thereto while running the lateral branch liner 255, attached at the end of the lateral branch connector 250, into the lateral wellbore 230. Once the lateral branch connector 250 is in fixed position and orientation with respect to the lateral branch template 245, an interlocking and sealed connection with the lateral branch template 245 is established. The lateral branch connector 250 thus supports a lateral opening, which allows fluid and production tools to pass through the junction between a main production bore 275 (above the junction) and the lateral wellbore 230.

In at least one embodiment, the lateral branch liner 255 connects to, or alternatively, stabs into the lateral branch connector 250 at the lateral branch liner's 255 upper end and connects to the upper portion of a lateral liner (not shown) that has been installed prior to installing the connecting apparatus. In the alternative, the lateral branch liner 255 sets into the open wellbore of the lateral wellbore 230 along its entire length or along a portion of the lateral wellbore 230. The lateral branch liner 255, in one or more embodiments, also has many properties of liners that are installed in wells to isolate production or injection zones from other formations. The lateral branch liner 255 may be or may not be cemented, depending upon the desires of the user. The lateral branch liner's 255 sealed and mechanically interlocked relation with the lateral branch template 245 may obviate the need for cementing because, unlike conventional cement junctions, the multilateral junction 240 is structurally capable of withstanding mechanical or pressure induced forces that cause failure of conventional cemented lateral branch junctions.

As an alternative, the lateral branch liner 255 may carry inside or outside its wall some reservoir monitoring equipment, which measures, processes and transmits important data that identifies the evolution of the reservoir characteristics while producing hydrocarbon products. This information may be transmitted to the surface via suitable transmission means such as electric lines, electromagnetic or induction through or along the liner itself, provided adequate relays and connections up to the lateral connection with the parent well.

Also, as an option, the lateral branch template 245 may include an active diverting device that is controlled from surface prior to lowering the equipment in a pre-selected lateral branch by creating a temporary mechanical diverter in the main bore.

In accordance with some embodiments, as shown in FIGS. 3A-3D, an interlocking mechanism (e.g., continuous interlocking mechanism) may be provided between the lateral branch connector 250 and the lateral branch template 245, and may include inter-engagement members (e.g., continuous inter-engagement members). The inter-engagement members provide improved interlocking characteristics (such as connection and sealing characteristics). In addition, the interlocking mechanism provides improved sealing characteristics to prevent or reduce the influx of solids (e.g., sand and other debris) from the surrounding formation and wellbore.

Figure 3A:
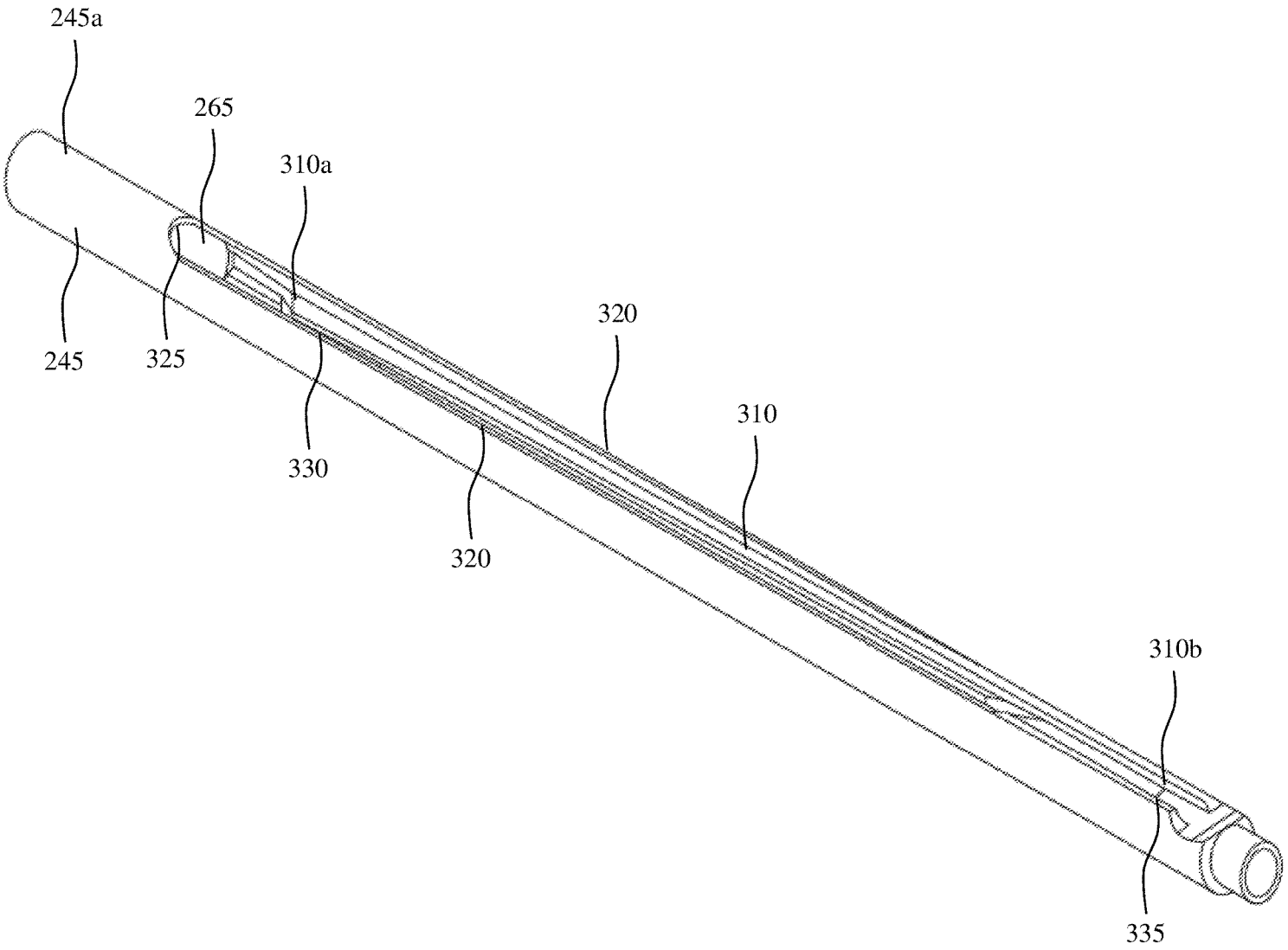
FIGS. 3A through 3N illustrate various different views of an alternative embodiment of a multilateral junction, including a lateral branch template and lateral branch connector, designed, manufactured and/or operated according to one or more embodiments of the disclosure.
Figure 3B:
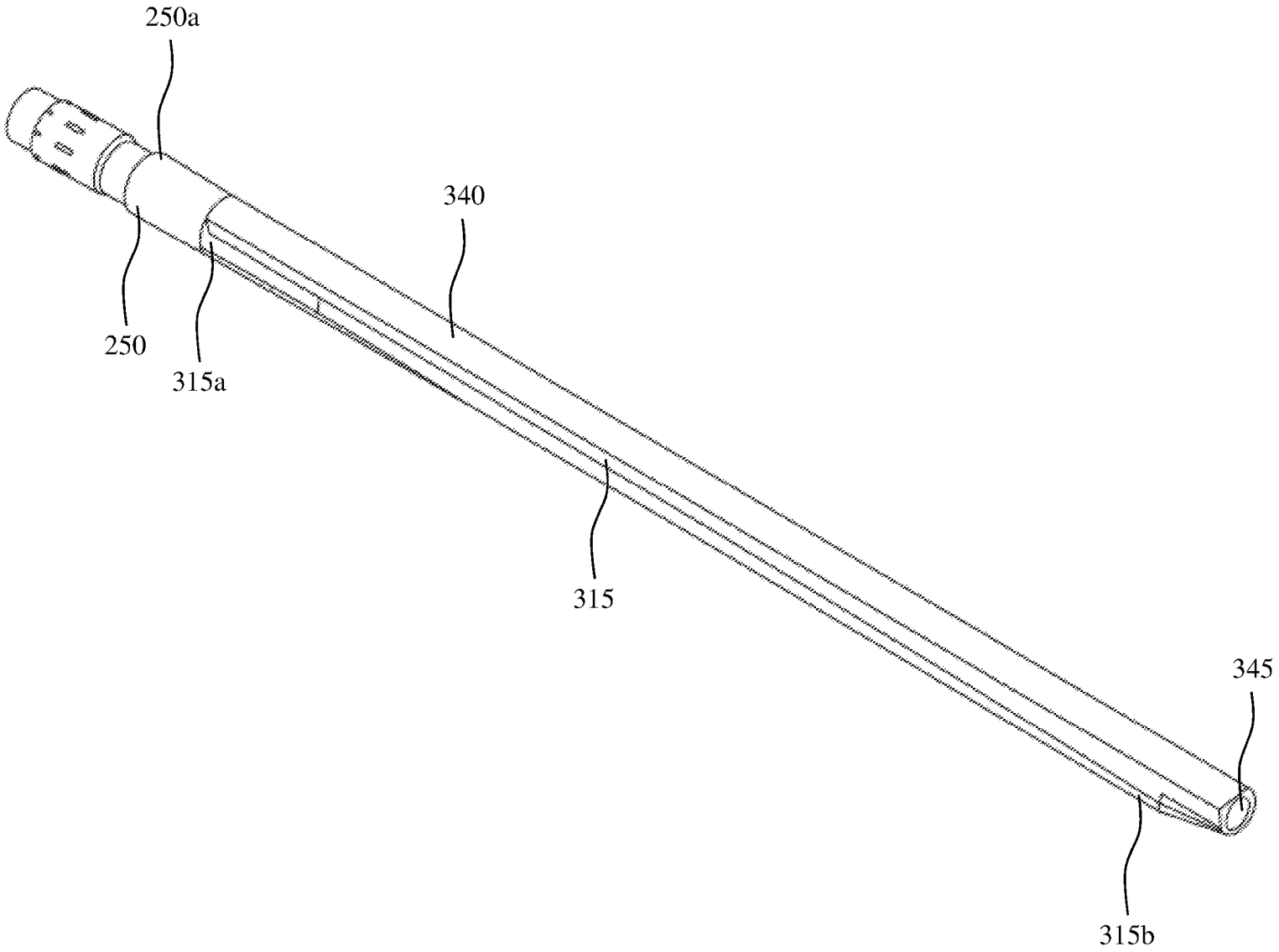
Figure 3C:
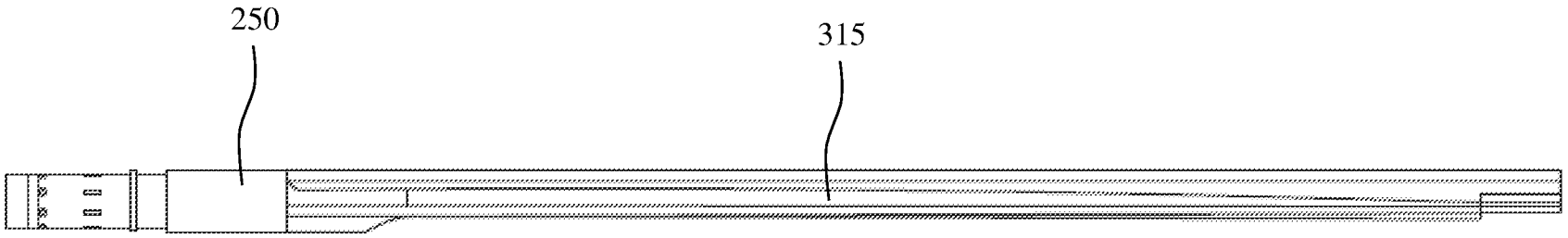
Figure 3D:
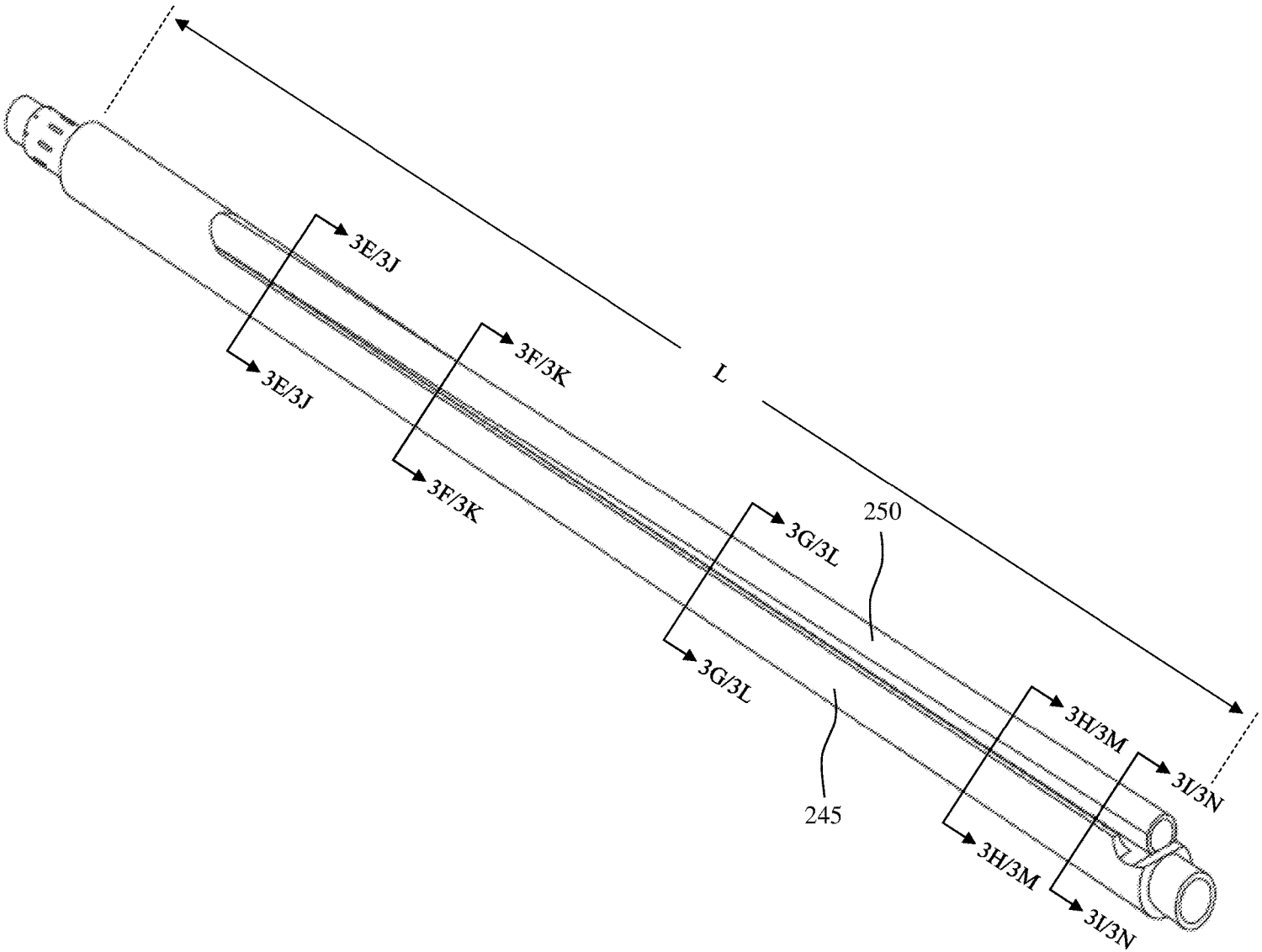

As shown in FIG. 3D, the lateral branch template 245 and the lateral branch connector 250 are engaged with each other along a length indicated generally as "L." As used here, a "continuous interlocking mechanism" according to one embodiment is one that extends (e.g., continuously extends) along at least a portion the length of engagement (L) of the lateral branch connector 250 and the lateral branch template 245, for example without any breaks or gaps in the inter-engagement members along the lengths of the inter-engagement members. Generally, the inter-engagement members in some embodiments extend from one end (e.g., upper end) of the window 265 (e.g., window in the lateral branch template 245) to the other end (e.g., lower end) of the window 265. However, in an alternative embodiment, one or both of the inter-engagement members may be formed with one or more gaps or breaks (discussed further below).

In FIG. 3A, the inter-engagement members of the lateral branch template 245 include a pair of grooves 310 (e.g., continuous grooves, only one of which is visible in FIG. 3A) formed on the inner wall of the lateral branch template 245. The grooves 310, in one or more embodiments, are adapted for engagement with a corresponding pair of tongues or rails 315 (e.g., continuous tongues or rails, only one of which is visible in FIGS. 3B-3C) formed on the external surface of the lateral branch connector 250. In another arrangement, the grooves 310 are formed in the lateral branch connector 250 and the tongues or rails 315 are formed on the lateral branch template 245. In yet further embodiments, other types of inter-engagement members can be employed on the lateral branch connector 250 and lateral branch template 245.

As shown in FIG. 3A, the window 265 formed through the lateral branch template 245 is defined by side surfaces 320 (e.g., by generally parallel side surfaces). The side surfaces 320, in one or more embodiments, are joined at the upper end by an end surface 325 (e.g., curved end surface). As the lateral branch connector 250 is moved downwardly, the ramp 260 (FIG. 2) of the lateral branch template 245, in conjunction with the cooperation of the grooves 310 and tongues or rails 315, directs the lower end portion of the lateral branch connector 250 through the window 265.

Each groove 310, in one or more embodiments, has an upper end 310*a* (the "proximal end") and a lower end 310*b* (the "distal end"). In the embodiment shown, the width of the groove 310 near the upper end 310*a* is larger than the width of the groove 310 near the lower end 310*b*. The width of the groove 310, in one or more embodiments, gradually decreases along its length, starting at the upper end 310*a*, so that the groove 310 has a maximum width at the upper end 310*a* and a minimum width at the lower end 310*b*. In other embodiments, other arrangements of the grooves 310 are possible. For example, each groove 310 can have a generally constant width along its length. Alternatively, instead of a gradual variation of the groove 310 width, step changes of the groove 310 can be provided.

The enlarged upper portion of each groove 310, in one or more embodiments, provides an orientation mechanism for guiding a corresponding tongue or rail 315 of the lateral branch connector 250 into the groove 310. The upper end 310*a* of the groove 310, in one or more embodiments, has at least one angulated surface 330 for guiding the tongues or rails 315.

The lower end 310*b* of each groove 310 in the lateral branch template 245, in one or more embodiments, defines a lower connector stop 335, which is engageable by the lower end of the tongues or rails 315 to prevent further downward movement of the lateral branch connector 250 once the tongues or rails 315 are fully engaged in the grooves 310.

Referring to FIGS. 3B-3C, the tongues or rails 315 of the lateral branch connector 250 extend from an outer surface on opposite sides of the lateral branch connector housing 340 (only one of the tongues or rails 315 is visible in FIGS. 3B-3C). The lateral branch connector housing 340 defines a bore 345 extending therethrough to enable the flow of fluids (production or injection fluids). As shown in FIGS. 3B-3C, the tongues or rails 315, in one or more embodiments, extend substantially along the length of engagement (e.g., length (L) in FIG. 3D) between the lateral branch connector 250 and the lateral branch template 245. The tongues or rails 315, in one or more embodiments, are arranged and oriented for engagement with the grooves 310 of the lateral branch template 245. As the lateral branch connector 250 is moved downwardly within the lateral branch template 245, the groove 310 and tongues or rails 315 are moved into interlocking relation with each other.

Each tongue or rail 315, in one or more embodiments, has an upper end 315*a* (the "proximal end") and a lower end 315*b* (the "distal end"). The width of the upper end 315*a*, in one or more embodiments, is larger than the width of the lower end 315*b*. The tongue or rail 315, in one or more embodiments, gradually decreases in width along its length starting from the upper end 315*a*. In other embodiments, other arrangements of the tongues or rails 315 are possible. The variation of the width of the tongues or rails 315 is selected to correspond generally to the variation of the width of the grooves 310 in the lateral branch template 245.

As shown in FIGS. 3B-3C, the tongues or rails 315 may incline generally downwardly. On the other hand, the grooves 310 (FIG. 3A) may incline generally upwardly. The inclined arrangements of the tongues or rails 315 and grooves 310, in one embodiment, serve to guide the lateral branch connector 250 outwardly through the window 265 formed through the lateral branch template 245 (FIG. 3A) so that the distal portion of the lateral branch connector 250 is guided into the lateral wellbore 230 (FIG. 2).

Also, as the lateral branch connector 250 is forced to follow the inclined path provided by the inclined grooves 310 and tongues or rails 315, the lateral branch connector 250 may be elastically and/or plastically deformed to follow the inclined path. Thus, as bending force is applied to the lateral branch connector housing 340 by the ramping action of the groove 310 and tongue or rail 315 interlocks, the lateral branch connector housing 340 is deformed or flexed to permit its lower end to move through the lateral window 225 and into the lateral wellbore 230. FIG. 3D shows the connector 28 and template 18 in the engaged position.

The groove 310 and tongue or rail 315 interlocking mechanism shown in FIGS. 3A-3D forms a multilateral junction that has sufficient structural integrity to withstand the mechanical force induced during well operation. For example, the mechanical force may be applied by shifts occurring in the surrounding earth formation. Also, forces are induced by the flow of fluid through the junction. The groove 310 and tongue or rail 315 interlocking mechanism also prevents solids (such as sand or other debris) from entering the production stream from the lateral branch liner 255 and permits lateral branch connector 250 movement that establishes efficient sealing with the lateral branch liner 255 of the lateral wellbore 230.

In an alternative embodiment, instead of a continuous tongue or rail 315, as shown in FIG. 3B, the tongue or rail 315 can be separated into two or more segments, with gaps or breaks between segments.

The present disclosure has recognized that in certain circumstances a fluid seal (e.g., in addition to the solid based barrier discussed above) may be necessary between the lateral branch template 245 and the lateral branch connector 250 or lateral branch liner 255. In at least one embodiment, the fluid seal may seal a leakage path in the periphery of the window 265 in the lateral branch template 245, for example by being positioned around the periphery of the window 265 of the lateral branch template 245. Specifically, the present disclosure is the first to recognize that traditional seals, such as traditional O-rings (e.g., polymeric O-rings) are insufficient to make the necessary seal in today's oil and gas applications. Based upon this recognition, the present disclosure has further recognized that seals that are configured to expand in volume may be used, and thereby address the newly discovered concerns discussed herein.

The phrase "seals that are configured to expand in volume," as used herein and unless otherwise stated, is intended to exclude traditional polymeric O-ring that are not configured to expand in volume, but that are simply configured to change in shape to accommodate various surface shapes that they are intended to engage. In at least one embodiment, the seals that are configured to expand in volume are configured to expand in volume by at least 5% (e.g., expand to 105% the volume of the seal prior to expansion). In at least one other embodiment, the seals that are configured to expand in volume are configured to expand in volume by at least 15% (e.g., expand to 115% the volume of the seal prior to expansion), if not by at least 25% (e.g., expand to 125% the volume of the seal prior to expansion). In at least one additional embodiment, the seals that are configured to expand in volume are configured to expand in volume by at least 50% (e.g., expand to 150% the volume of the seal prior to expansion), if not by at least 75% (e.g., expand to 175% the volume of the seal prior to expansion). In yet at least one other embodiment, the seals that are configured to expand in volume are configured to expand in volume by at least 100% (e.g., expand to 200% the volume of the seal prior to expansion), if not 125% (e.g., expand to 225% the volume of the seal prior to expansion). Based upon the material chosen for the seals that are configured to expand in volume, a limit does exist for the amount of expansion that can be achieved. In at least one embodiment, the amount of expansion in volume may be limited to 1000%.

In one or more embodiments, the seals that are configured to expand in volume are one or more seals that are configured to expand in volume in response to hydrolysis. For example, in at least one embodiment, the seal that is configured to expand in volume, pre-expansion, includes an expandable metal member positioned about the housing, the expandable metal member comprising a metal configured to expand in response to hydrolysis.

The term expandable metal, as used herein, refers to the expandable metal in a pre-expansion form. Similarly, the term expanded metal, as used herein, refers to the resulting expanded metal after the expandable metal has been subjected to reactive fluid, as discussed below. The expanded metal, in accordance with one or more aspects of the disclosure, comprises a metal that has expanded in response to hydrolysis. In certain embodiments, the expanded metal includes residual unreacted metal. For example, in certain embodiments the expanded metal is intentionally designed to include the residual unreacted metal. The residual unreacted metal has the benefit of allowing the expanded metal to self-heal if cracks or other anomalies subsequently arise, or for example to accommodate changes in the tubular or housing diameter due to variations in temperature and/or pressure. Nevertheless, other embodiments may exist wherein no residual unreacted metal exists in the expanded metal. In at least one embodiment, the residual unreacted metal exists when the expandable metal has expanded into contact with another feature, such as another wellbore tubular, prior to all of the expanded metal reacting into expanded metal. Once the expanded metal has sealed against this wellbore tubular, the reactive fluid may no longer reach the expandable metal, and the hydrolysis essentially ends, in some instances leaving the residual unreacted metal.

The expandable metal, in some embodiments, may be described as expanding to a cement like material, and thereby forming the required seal. In other words, the expandable metal goes from metal to micron-scale particles and then these particles expand and lock together to, in essence, seal two or more surfaces together. The reaction may, in certain embodiments, occur in less than 2 days in a reactive fluid and in certain temperatures. Nevertheless, the time of reaction may vary depending on the reactive fluid, the expandable metal used, the downhole temperature, surface-area-to-volume ratio (SA:V) of the expandable metal, etc..

In some embodiments, the reactive fluid may be a brine solution such as may be produced during well completion activities, and in other embodiments, the reactive fluid may be one of the additional solutions discussed herein (e.g., water-based mud). The expandable metal is electrically conductive in certain embodiments. The expandable metal, in certain embodiments, has a yield strength greater than about 8,000 psi, e.g., 8,000 psi+/−50%. The expandable metal, in at least one embodiment, has a minimum dimension greater than about 1.25 mm (e.g., approximately 0.05 inches).

The hydrolysis of the expandable metal can create a metal hydroxide. The formative properties of alkaline earth metals (Mg-Magnesium, Ca—Calcium, etc.) and transition metals (Zn—Zinc, Al-Aluminum, etc.) under hydrolysis reactions demonstrate structural characteristics that are favorable for use with the present disclosure. Hydration results in an increase in size from the hydration reaction and results in a metal hydroxide that can precipitate from the fluid.

It should be noted that the starting expandable metal, unless otherwise indicated, is not a metal oxide (e.g., an insulator). In contrast, the starting expandable metal has, in certain embodiments, the properties of traditional metals: 1) Highly conductive to both electricity and heat (e.g., greater than 1,000,000 siemens per meter); 2) Contains a metallic bond (e.g., the outermost electron shell of each of the metal atoms overlaps with a large number of neighboring atoms). As a consequence, the valence electrons are allowed to move from one atom to another and are not associated with any specific pair of atoms. This gives metals their conductive nature; 3) Malleable and ductile, for example deforming under stress without cleaving; and 4) Tend to be shiny and lustrous with high density. In contrast, metal oxides are ceramics, and are dull, insulating, fragile, brittle and are not conductive metals.

The hydration reactions for magnesium is:

$$Mg+2H_2O \rightarrow Mg(OH)_2+H_2,$$

where $Mg(OH)_2$ is also known as brucite. Another hydration reaction uses aluminum hydrolysis. The reaction forms a material known as Gibbsite, bayerite, boehmite, aluminum oxide, and norstrandite, depending on form. The possible hydration reactions for aluminum are:

$$Al+3H_2O \rightarrow Al(OH)_3+3/2H_2.$$

$$Al+2H_2O \rightarrow AlO(OH)+3/2H_2$$

$$Al+3/2H_2O \rightarrow \tfrac{1}{2}Al_2O_3+3/2H_2$$

Magnesium hydroxide is considered to be relatively insoluble in water. Aluminum hydroxide can be considered an amphoteric hydroxide, which has solubility in strong acids or in strong bases. Alkaline earth metals (e.g., Mg, Ca, etc.) work well for the expandable metal, but transition metals (Al, etc.) also work well for the expandable metal. In one embodiment, the metal hydroxide is dehydrated by the swell pressure to form a metal oxide.

It is to be understood, that the selected expandable metal is to be selected such that the expanded metal does not degrade into the brine. As such, the use of metals or metal alloys for the expandable metal that form relatively water-insoluble hydration products may be chosen. For example, magnesium hydroxide and calcium hydroxide have low solubility in water. Alternatively, or in addition to, the sealing element may be positioned such that degradation into the brine is constrained due to the geometry of the area in which the expandable metal is disposed and thus resulting in reduced exposure of the expandable metal and/or expanded metal. For example, the volume of the area in which the expandable metal is disposed may be less than the expansion volume of the expandable metal. In some examples, the volume of the area is less than as much as 50% of the expansion volume. Alternatively, the volume of the area in which the expandable metal may be disposed may be less than 90% of the expansion volume, less than 80% of the expansion volume, less than 70% of the expansion volume, or less than 60% of the expansion volume.

In at least one embodiment, the expandable metal is a non-graphene based expandable metal. By non-graphene based material, it is meant that is does not contain graphene, graphite, graphene oxide, graphite oxide, graphite intercalation, or in certain embodiments, compounds and their derivatized forms to include a function group, e.g., including carboxy, epoxy, ether, ketone, amine, hydroxy, alkoxy, alkyl, aryl, aralkyl, alkaryl, lactone, functionalized polymeric or oligomeric groups, or a combination comprising at least one of the forgoing functional groups. In at least one other embodiment, the expandable metal does not include a matrix material or an exfoliatable graphene-based material. By not being exfoliatable, it means that the expandable metal is not able to undergo an exfoliation process. Exfoliation as used herein refers to the creation of individual sheets, planes, layers, laminae, etc. (generally, "layers") of a graphene-based material; the delamination of the layers; or the enlargement of a planar gap between adjacent ones of the layers, which in at least one embodiment the expandable metal is not capable of.

In yet another embodiment, the expandable metal does not include graphite intercalation compounds, wherein the graphite intercalation compounds include intercalating agents such as, for example, an acid, metal, binary alloy of an alkali metal with mercury or thallium, binary compound of an alkali metal with a Group V element (e.g., P, As, Sb, and Bi), metal chalcogenide (including metal oxides such as, for example, chromium trioxide, $PbO_2$, $MnO_2$, metal sulfides, and metal selenides), metal peroxide, metal hyperoxide, metal hydride, metal hydroxide, metals coordinated by nitrogenous compounds, aromatic hydrocarbons (benzene, toluene), aliphatic hydrocarbons (methane, ethane, ethylene, acetylene, n-hexane) and their oxygen derivatives, halogen, fluoride, metal halide, nitrogenous compound, inorganic compound (e.g., trithiazyl trichloride, thionyl chloride), organometallic compound, oxidizing compound (e.g., peroxide, permanganate ion, chlorite ion, chlorate ion, perchlorate ion, hypochlorite ion, $As_2O_5$, $N_2O_5$, $CH_{3D}1O_4$, $(NH_4)_2S_2O_8$, chromate ion, dichromate ion), solvent, or a combination comprising at least one of the foregoing. Thus, in at least one embodiment, the expandable metal is a structural solid expanded metal, which means that it is a metal that does not exfoliate and it does not intercalate. In yet another embodiment, the expandable metal does not swell by sorption.

In an embodiment, the expandable metal used can be a metal alloy. The expandable metal alloy can be an alloy of the base expandable metal with other elements in order to either adjust the strength of the expandable metal alloy, to adjust the reaction time of the expandable metal alloy, or to adjust the strength of the resulting metal hydroxide byproduct, among other adjustments. The expandable metal alloy can be alloyed with elements that enhance the strength of the metal such as, but not limited to, Al-Aluminum, Zn-Zinc, Mn-Manganese, Zr-Zirconium, Y-Yttrium, Nd-Neodymium, Gd-Gadolinium, Ag-Silver, Ca-Calcium, Sn-Tin, and Re-Rhenium, Cu-Copper. In some embodiments, the expandable metal alloy can be alloyed with a dopant that promotes corrosion, such as Ni-Nickel, Fe-Iron, Cu-Copper, Co-Cobalt, Ir-Iridium, Au-Gold, C-Carbon, Ga-Gallium, In-Indium, Mg-Mercury, Bi-Bismuth, Sn-Tin, and Pd-Palladium. The expandable metal alloy can be constructed in a solid solution process where the elements are combined with molten metal or metal alloy. Alternatively, the expandable metal alloy could be constructed with a powder metallurgy process. The expandable metal can be cast, forged, extruded, sintered, welded, mill machined, lathe machined, stamped, eroded or a combination thereof. The metal alloy can be a mixture of the metal and metal oxide. For example, a powder mixture of aluminum and aluminum oxide can be ball-milled together to increase the reaction rate. Based upon the present disclosure, those skilled in the art would understand the ratios that might be necessary of the expandable metal to the alloy.

Optionally, non-expanding components may be added to the starting metallic materials. For example, ceramic, elastomer, plastic, epoxy, glass, or non-reacting metal components can be embedded in the expandable metal or coated on the surface of the expandable metal. In yet other embodiments, the non-expanding components are metal fibers, a composite weave, a polymer ribbon, or ceramic granules, among others. In one variation, the expandable metal is formed in a serpentinite reaction, a hydration and metamorphic reaction. In one variation, the resultant material resembles a mafic material. Additional ions can be added to the reaction, including silicate, sulfate, aluminate, carbonate, and phosphate. The metal can be alloyed to increase the reactivity or to control the formation of oxides.

The expandable metal can be configured in many different fashions, as long as an adequate volume of material is available for achieving the necessary seal. For example, the expandable metal may be formed into a single long member, multiple short members, rings, among others. In another embodiment, the expandable metal may be formed into a long wire of expandable metal, which can in turn be wound around a housing as a sleeve, or placed within a seal groove (e.g., thereby forming a continuous wire of expandable metal). The wire diameters do not need to be of circular cross-section, but may be of any cross-section. For example, the cross-section of the wire could be oval, rectangle, star, hexagon, keystone, hollow braided, woven, twisted, among others, and remain within the scope of the disclosure. In certain other embodiments, the expandable metal is a collection of individual separate chunks of the metal held together with a binding agent. In yet other embodiments, the expandable metal is a collection of individual separate chunks of the metal that are not held together with a binding agent, but held in place using one or more different techniques, including an enclosure (e.g., an enclosure that could be crushed to expose the individual separate chunks to the reactive fluid), a cage, etc.

Additionally, a delay coating or protective layer may be applied to one or more portions of the expandable metal to delay the expanding reactions. In one embodiment, the material configured to delay the hydrolysis process is a fusible alloy. In another embodiment, the material configured to delay the hydrolysis process is a eutectic material. In yet another embodiment, the material configured to delay the hydrolysis process is a wax, oil, or other non-reactive material. The delay coating or protective layer may be applied to any of the different expandable metal configurations disclosed above.

In one or more other embodiments, the seals that are configured to expand in volume are one or more seals that are configured to swell in volume, for example by sorption. In at least one embodiment, these one or more seals that are configured to swell in volume, are materials, such as swellable elastomers. The swellable elastomers suitable for use in the compositions of the present disclosure generally include any elastomer that swells upon contact with a selected fluid. A variety of swellable elastomers may be utilized in accordance with the present disclosure, including, but not limited to, those that swell upon contact with an oleaginous fluid and/or an aqueous fluid, such as water. Swellable elastomers suitable for use in the present invention may generally swell by up to approximately 500% of their original size at the surface. Under downhole conditions, this swelling may be more or less depending on the conditions presented. In some embodiments, the swelling may be up to about 200% under downhole conditions. Once swelled to at least some extent, the elastomers may be referred to as swelled elastomers.

Some specific examples of suitable elastomers that swell upon contact with an oleaginous fluid and/or an aqueous fluid include, but are not limited to, natural rubber, acrylate butadiene rubbers, polyacrylate rubbers, isoprene rubbers, choloroprene rubbers, butyl rubbers (IIR), brominated butyl rubbers (BIIR), chlorinated butyl rubbers (CIIR), chlorinated polyethylene (CM/CPE), neoprene rubbers (CR), styrene butadiene copolymer rubbers (SBR), sulphonated polyethylene (CSM), ethylene acrylate rubbers (EAM/AEM), epichlorohydrin ethylene oxide copolymers (CO, ECO), ethylene-propylene rubbers (EPM and EDPM), ethylene-propylene-diene terpolymer rubbers (EPT), ethylene vinyl acetate copolymers, fluorosilicone rubbers (FVMQ), silicone rubbers (VMQ), poly 2,2,1-bicyclo heptene (polynorborneane), alkylstyrene, crosslinked substituted vinyl acrylate copolymers and diatomaceous earth. Examples of suitable elastomers that swell when in contact with aqueous fluid include, but are not limited to, nitrile rubbers (NBR), hydrogenated nitrile rubbers (HNBR, HNS), fluoro rubbers (FKM), perfluoro rubbers (FFKM), tetrafluorethylene/propylene (TFE/P), starch-polyacrylate acid graft copolymers, polyvinyl alcoholcyclic acid anhydride graft copolymers, isobutylene maleic anhydride, acrylic acid type polymers, vinylacetate-acrylate copolymer, polyethylene oxide polymers, carboxymethyl cellulose type polymers, starch-polyacrylonitrile graft copolymers and the like, polymethacrylate, polyacrylamide, non-soluble acrylic polymers, and highly swelling clay minerals such as sodium bentonite (having as main ingredient montmorillonite). Other swellable materials that behave in a similar fashion with respect to oleaginous fluids or aqueous fluids also may be suitable. Those of ordinary skill in the art, with the benefit of this disclosure, will be able to select an appropriate swellable elastomer for use in the compositions of the present disclosure based on a variety of factors, including the application in which the composition will be used and the desired swelling characteristics.

Turning to FIGS. 3E through 3I, as well as FIGS. 3J through 3N, illustrated are various different cross-sectional views of the lateral branch template 245 and the lateral branch connector 250 of FIG. 3D. Accordingly, FIGS. 3E through 3N illustrate the structural interrelation of the various components of the lateral branch template 245 and the lateral branch connector 250 (e.g., with layers outside the lateral branch connector 250 omitted for clarity). Furthermore, in the embodiment of FIGS. 3E through 3N, the lateral branch template 245 and the lateral branch connector 250 are in the fully engaged position.

In accordance with one or more embodiments of the disclosure, FIGS. 3E through 3I illustrate the lateral branch template 245 and the lateral branch connector 250 including a pre-expansion sealing element 370 configured to expand in volume. Similarly, in accordance with one or more embodiments of the disclosure, FIGS. 3J through 3N illustrate the lateral branch template 245 and the lateral branch connector 250 including a post-expansion sealing element 380 that has expanded in volume.

In the embodiment of FIGS. 3E through 3I, the pre-expansion sealing element 370 is an expandable metal pre-expansion sealing element (e.g., a metal that is configured to expand in response to hydrolysis), as discussed in detail above. Furthermore, in the embodiment of FIGS. 3J through 3N, the post-expansion sealing element 380 is an expanded metal post-expansion sealing element (e.g., a metal that has expanded in response to hydrolysis), for example as might result when the expandable metal pre-expansion sealing element 370 was subjected to a suitable reactive fluid, as discussed above.

Figure 3E:
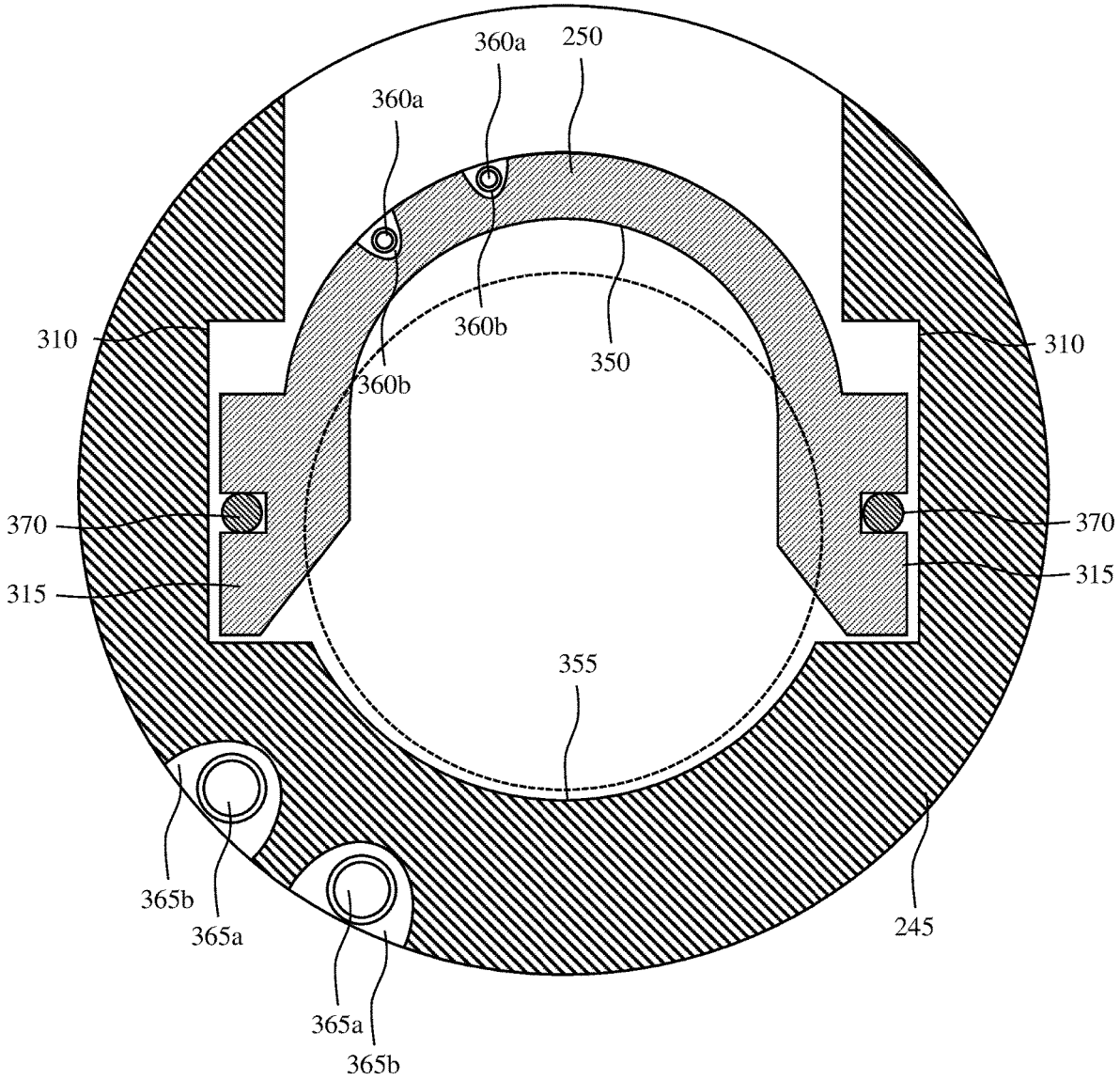
Figure 3F:
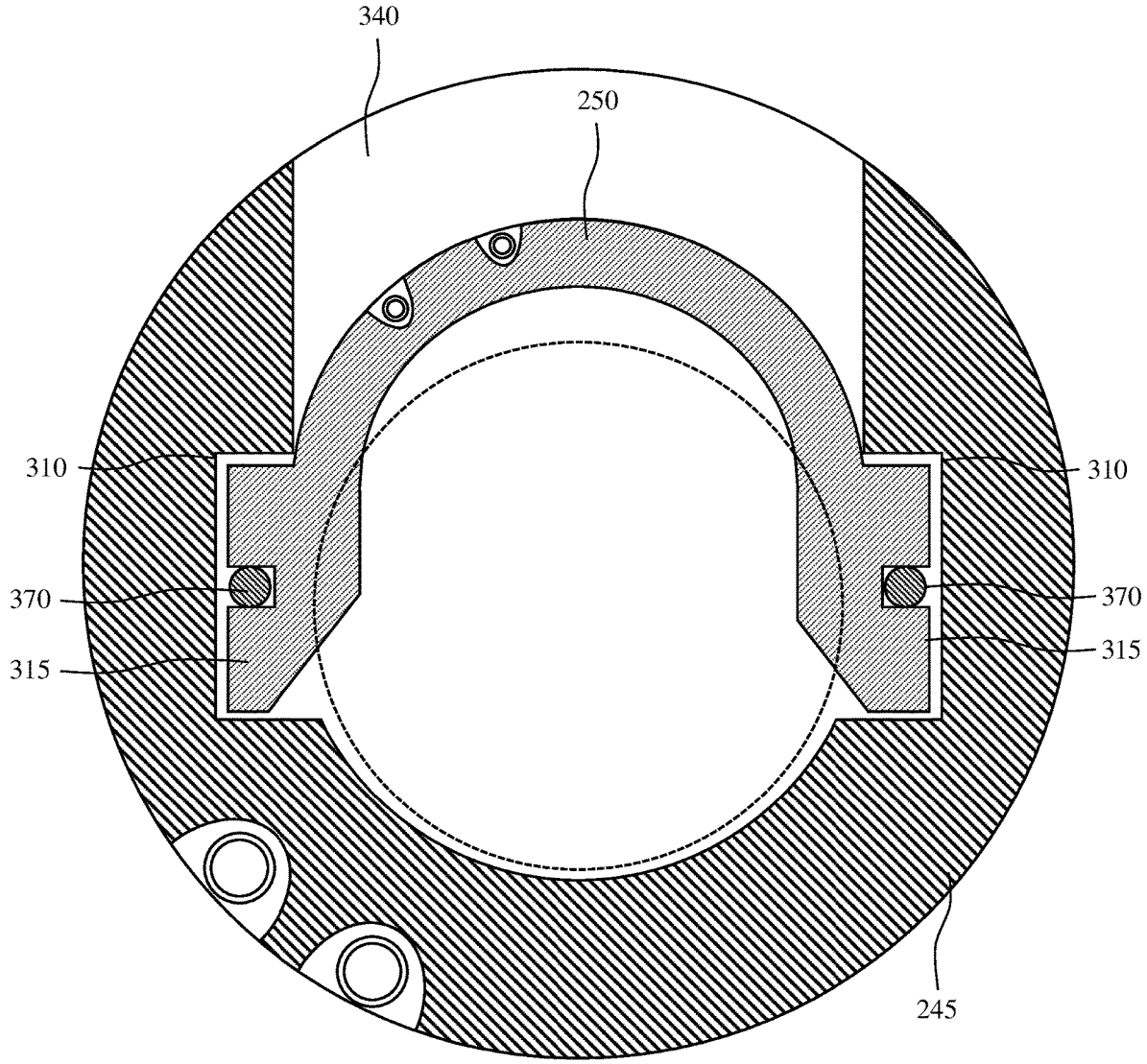
Figure 3G:
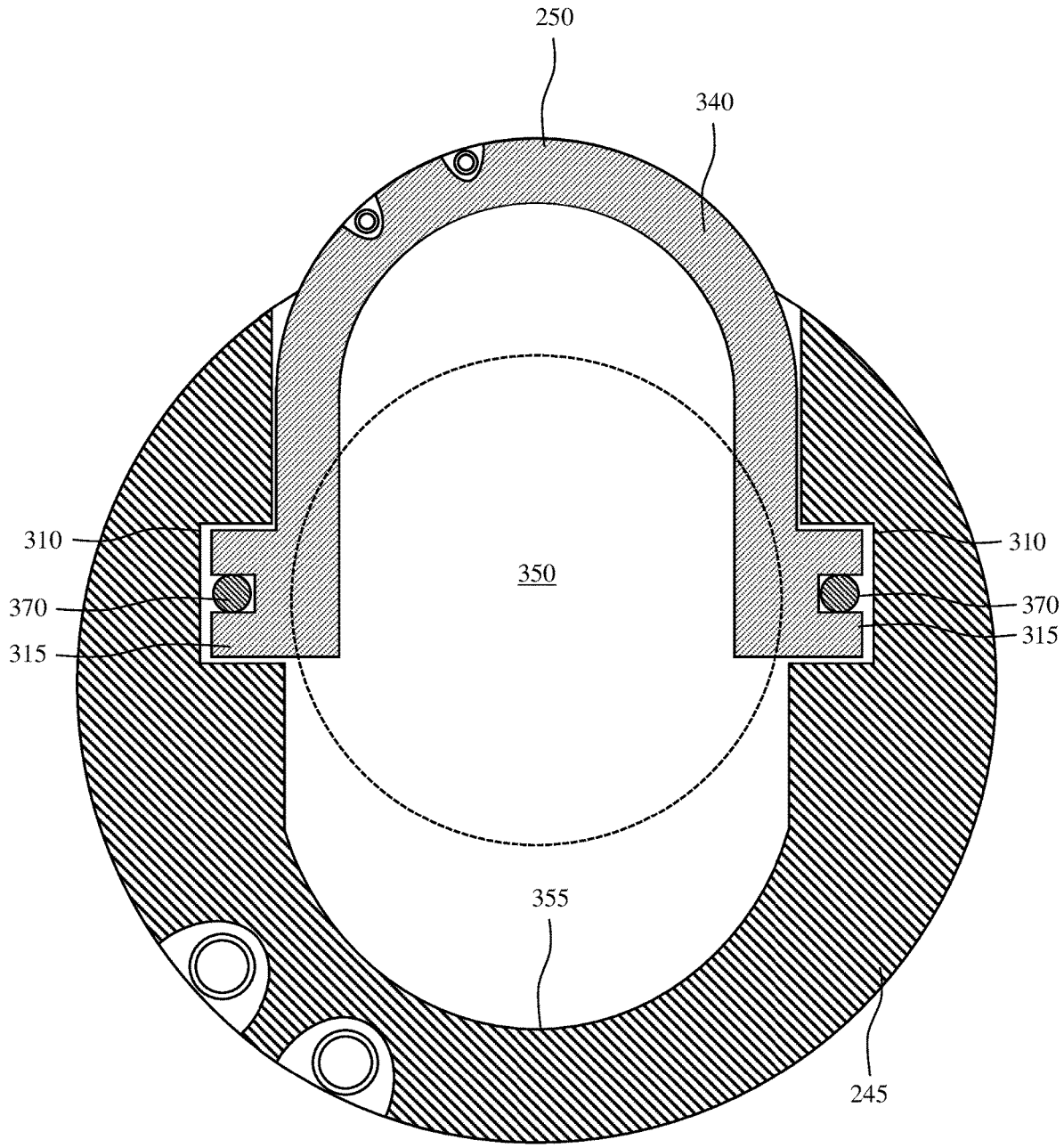
Figure 3H:
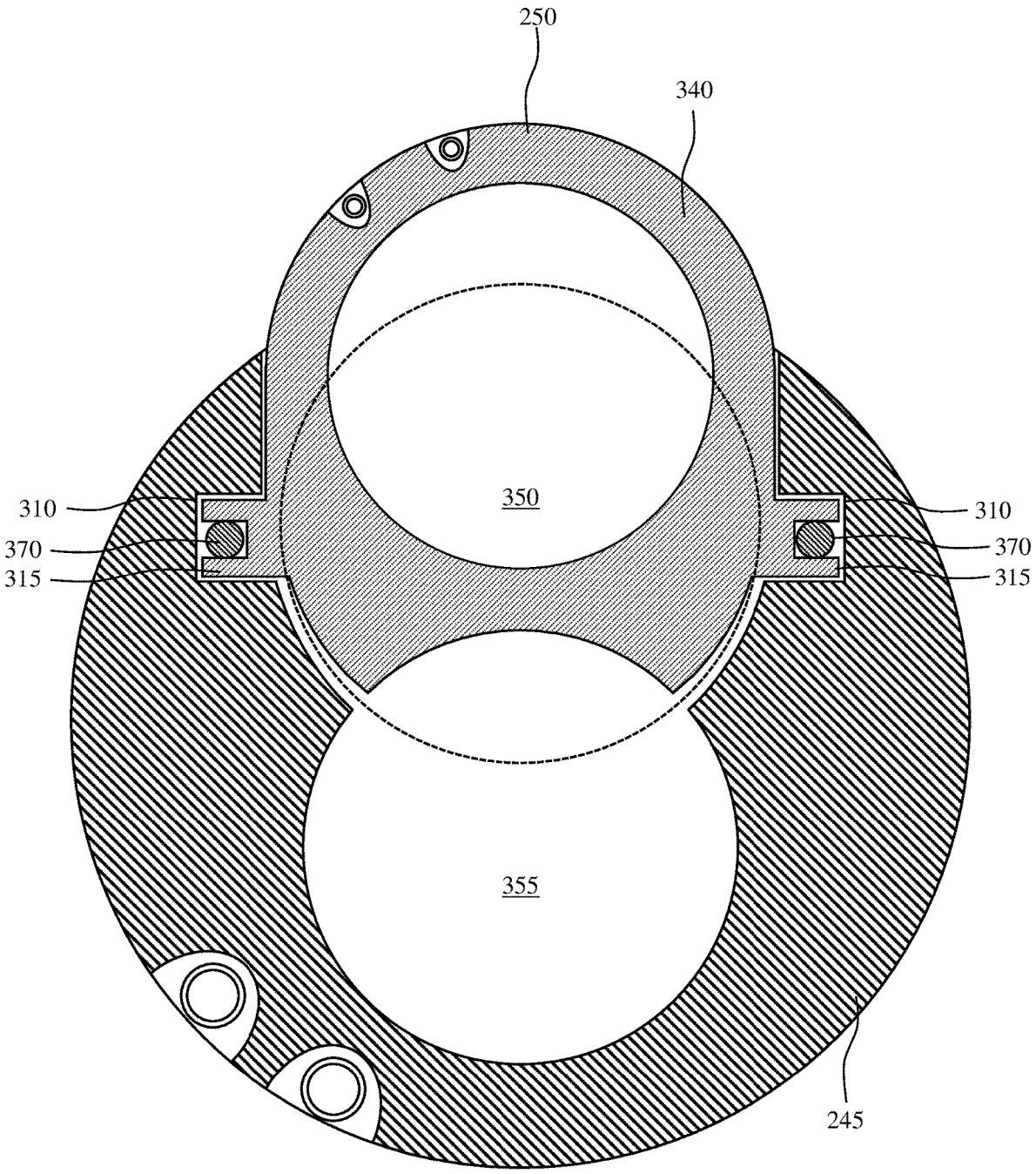
Figure 3I:
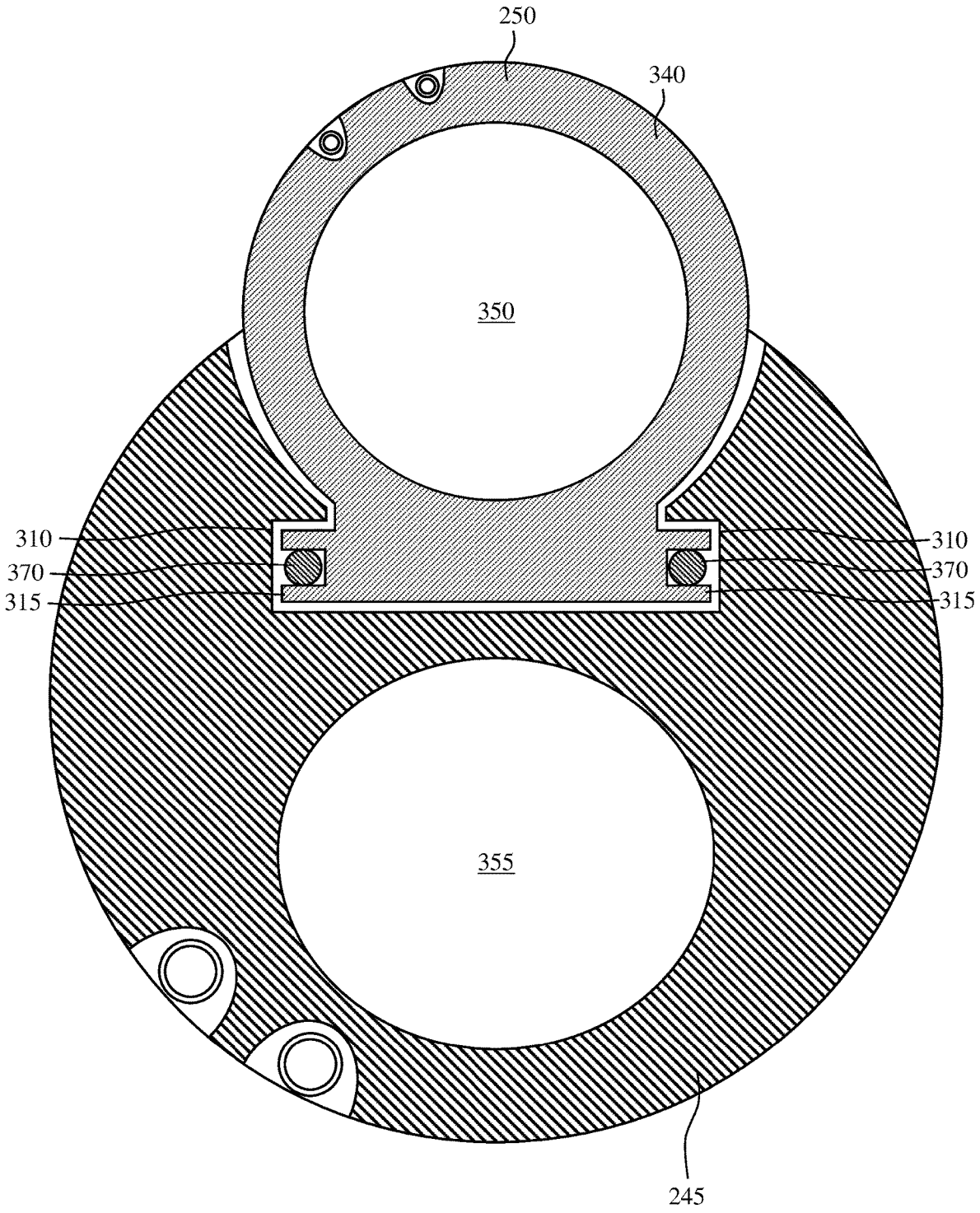
Figure 3J:
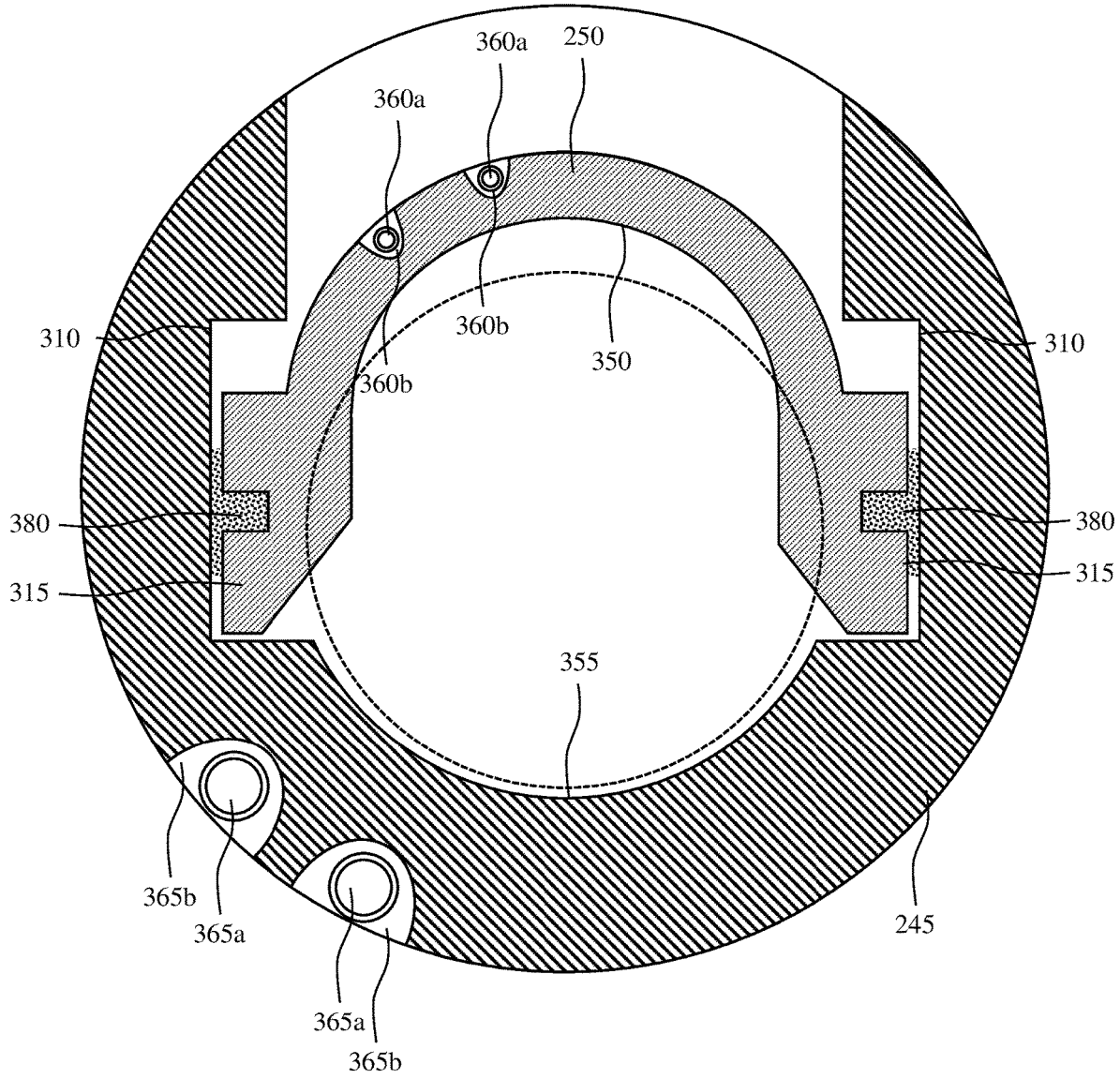

FIGS. 3E and 3J show cross-sectional views (at 3E/3J-3E/3J in FIG. 3D) near the upper end of the junction assembly including the lateral branch template 245 and the lateral branch connector 250. As shown, the upper portion of each of the grooves 310 is wider than a corresponding portion of each of the tongues or rails 315. The relatively large width of each groove 310 makes it easier for the tongues or rails 315 of the lateral branch connector 250 to be inserted into the grooves 310. Also, at the position indicated by cross-section 3E/3J-3E/3J, an inner bore 350 of the lateral branch connector 250 is substantially coaxial with an inner bore 355 of the lateral branch template 245.

Figure 3K:
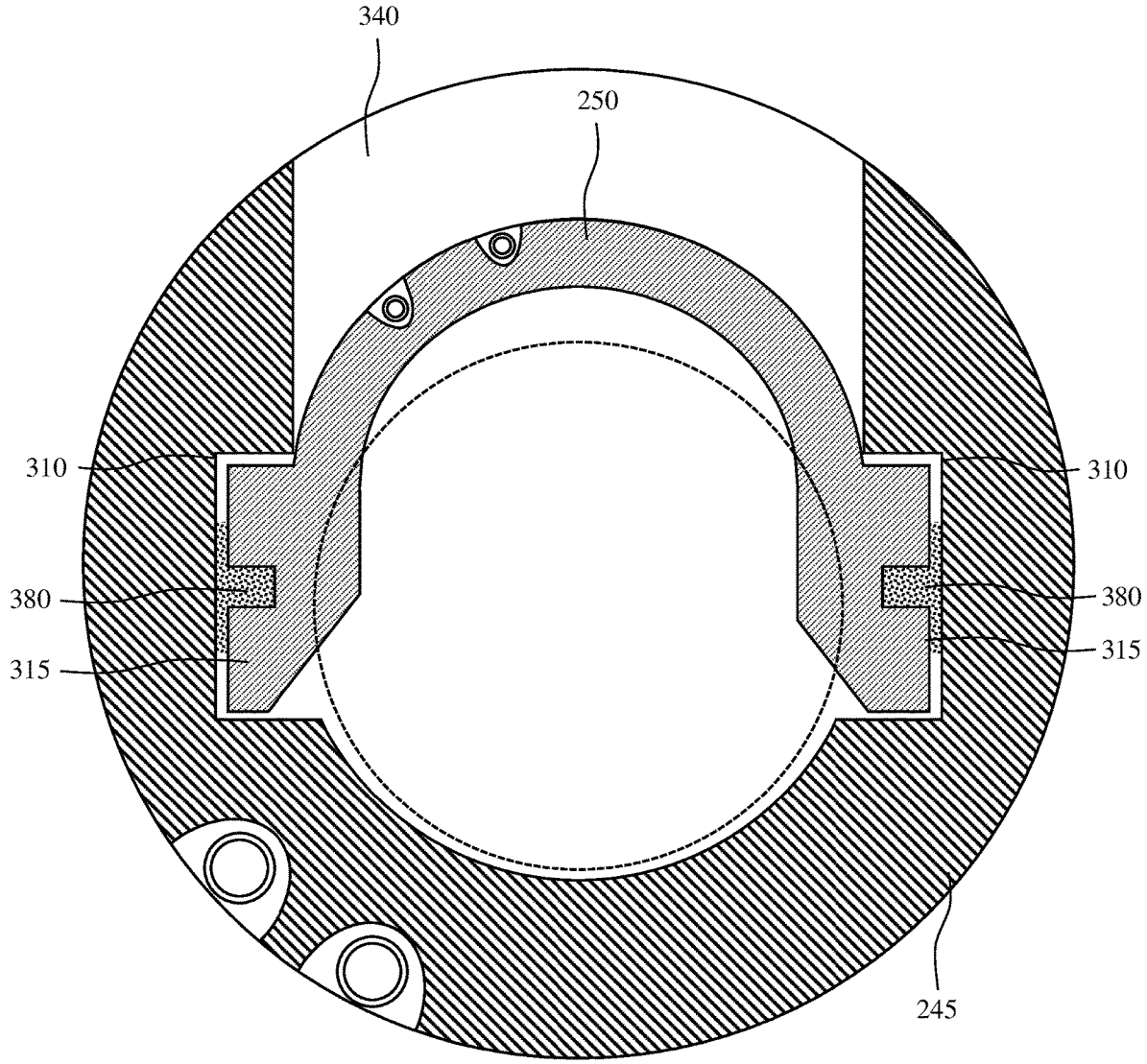
Figure 3L:
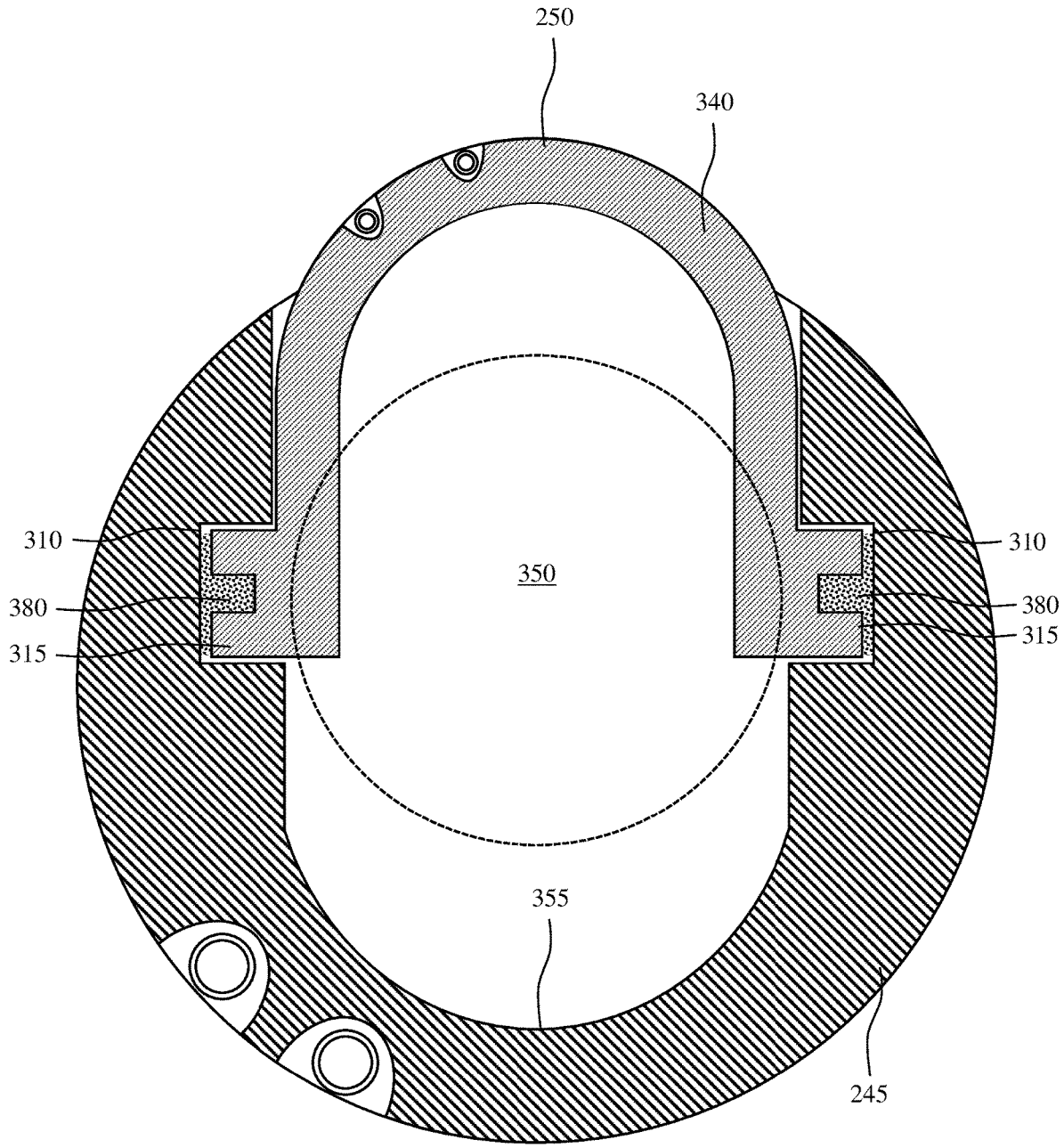

Further downward, as shown in FIGS. 3F and 3K (at 3F/3K-3F/3K in FIG. 3D), the inner bore 350 of the lateral branch connector 250 is slightly offset with respect to the inner bore 355 of the lateral branch template 245. Also, the width of each groove 310 has narrowed to provide a tighter fit with the corresponding tongue or rail 315. The offset between the inner bores 350 and 355 becomes larger at the cross-section 3G/3L-3G/3L, as shown in FIGS. 3G and 3L. Also, as shown in FIGS. 3G and 3L, the widths of the grooves 310 and the tongues or rails 315 are also smaller than the widths at cross-sections 3E/3J-3E/3J and 3F/3K-3F/3K.

Figure 3M:
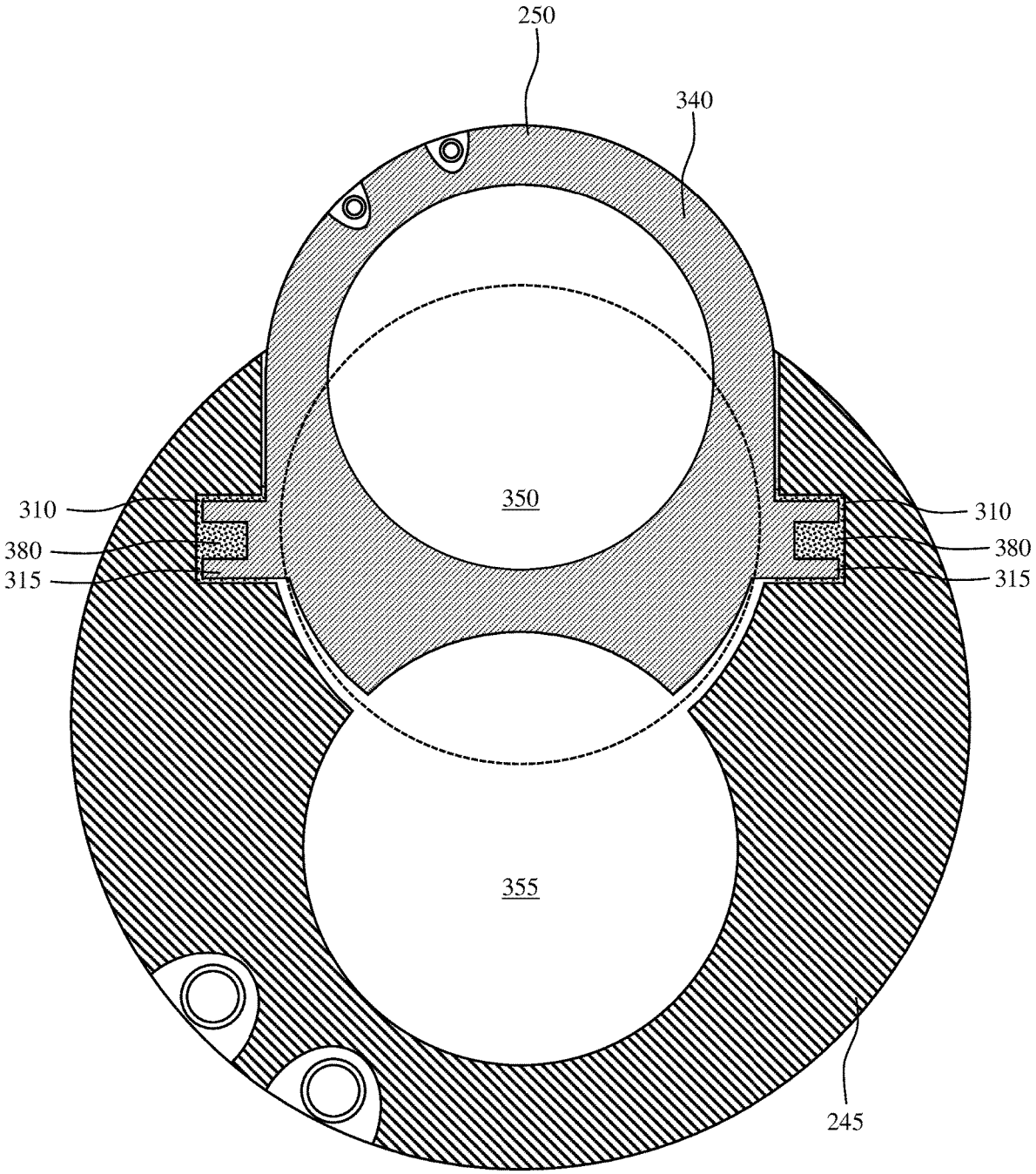

The offset of the inner bores 350 and 355 (and of the lateral branch connector 250 and lateral branch template 245) increases at cross-section 3H/3M-3H/3M, as shown in FIGS. 3H and 3M. Here, the bores 350 and 355 provide completely separate paths. In addition, the widths of the grooves 310 and tongues and rails 315 are reduced further. Near the lower end of the junction assembly, at cross-section 3I/3N-3I/3N, the lateral branch connector 250 and the lateral branch template 245 are further offset from each other. The tongues or rails 315 and grooves 310 near the distal end of the multilateral junction 240 are also shown.

In accordance with one or more embodiments of the disclosure, slots or conduits may also be defined in the lateral branch connector 250 and/or lateral branch template 245, for example to enable the routing of communications lines (e.g., electrical lines, fluid pressure control lines, hydraulic lines, fiber optic lines, etc.). As shown in FIGS. 3E through 3N, communications lines 360*a* may be routed along conduits 360*b* defined on the outer surface of the connector housing 340. Although two sets of communications lines 360*a* and conduits 360*b* are illustrated in the FIGS., other embodiments may have only a single set or more than two sets. The communications lines 360*a* enable the transmission and receiving of power and signals between devices located in the lateral wellbore 230 and devices located in the main wellbore 210 or at the well surface.

In addition to the communications lines 360*a* and conduits 360*b*, similar communications lines 365*a* can also be extended along conduits 365*b* formed on the outer surface of the lateral branch template 245 housing. Again, two sets of communications lines 365*a* and conduits 365*b* are illustrated for purposes of example. The communications lines 365*a* enable communications with devices located below the multilateral junction 240.

Another feature of some embodiments is the presence of the pre-expansion sealing element 370 and the post-expansion sealing element 380, for example formed proximate a joint between the lateral branch template 245 and the lateral branch connector 250 (e.g., proximate a joint between respective grooves 310 and tongues or rails 315 (as shown in FIGS. 3E through 3N)). The term "proximate," as used with regard to the placement of the one or more sealing elements, means that the one or more sealing elements are positioned close enough that when they expand they seal at least a portion of the joint between the lateral branch template 245 and the lateral branch connector 250.

The pre-expansion sealing element 370 and the post-expansion sealing element 380 are provided to prevent the entry of solids from the surrounding formation and wellbore into the bores 350 and 355. Nevertheless, the present disclosure has recognized that the pre-expansion sealing element 370 and the post-expansion sealing element 380 designed, manufactured and/or employed according to the present disclosure may also impede liquids, which the present disclosure has recognized as highly valuable. Again, in the embodiment of FIGS. 3E through 3N, the pre-expansion sealing element 370 comprises a metal configured to expand in response to hydrolysis, and the post-expansion sealing element 380 is the byproduct of a metal that has expanded in response to hydrolysis.

FIGS. 3E through 3N show grooves 310 and tongues or rails 315 that are generally parallel to each other, and that are generally parallel along a longitudinal axis of the lateral branch connector 250 or lateral branch template 245. Alternatively, the grooves 310 and/or tongues or rails 315 can be non-parallel. Also, the grooves 310 and/or tongues or rails 315 do not need to be symmetrical along the longitudinal axis.

Figure 3N:
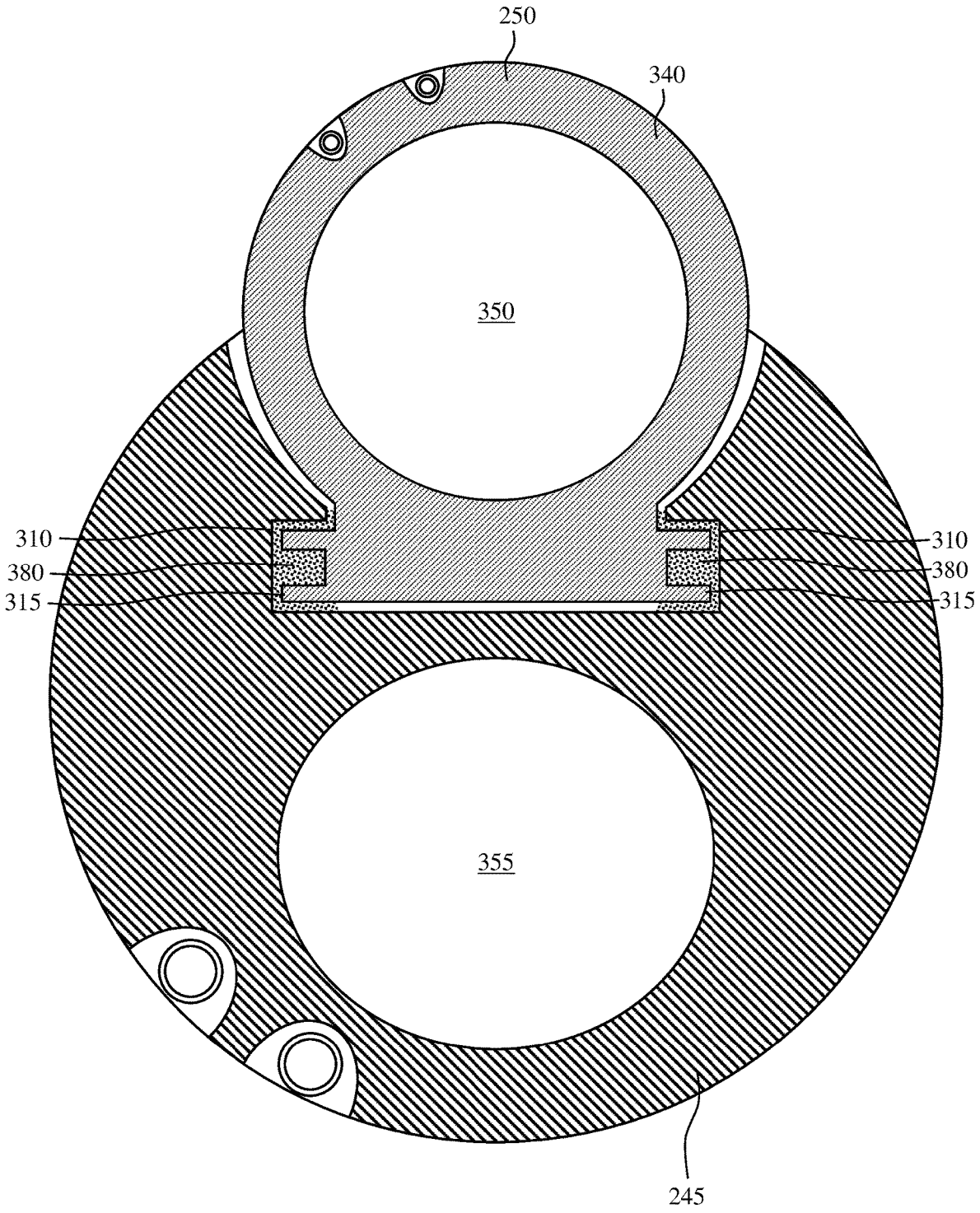
Figure 4A:
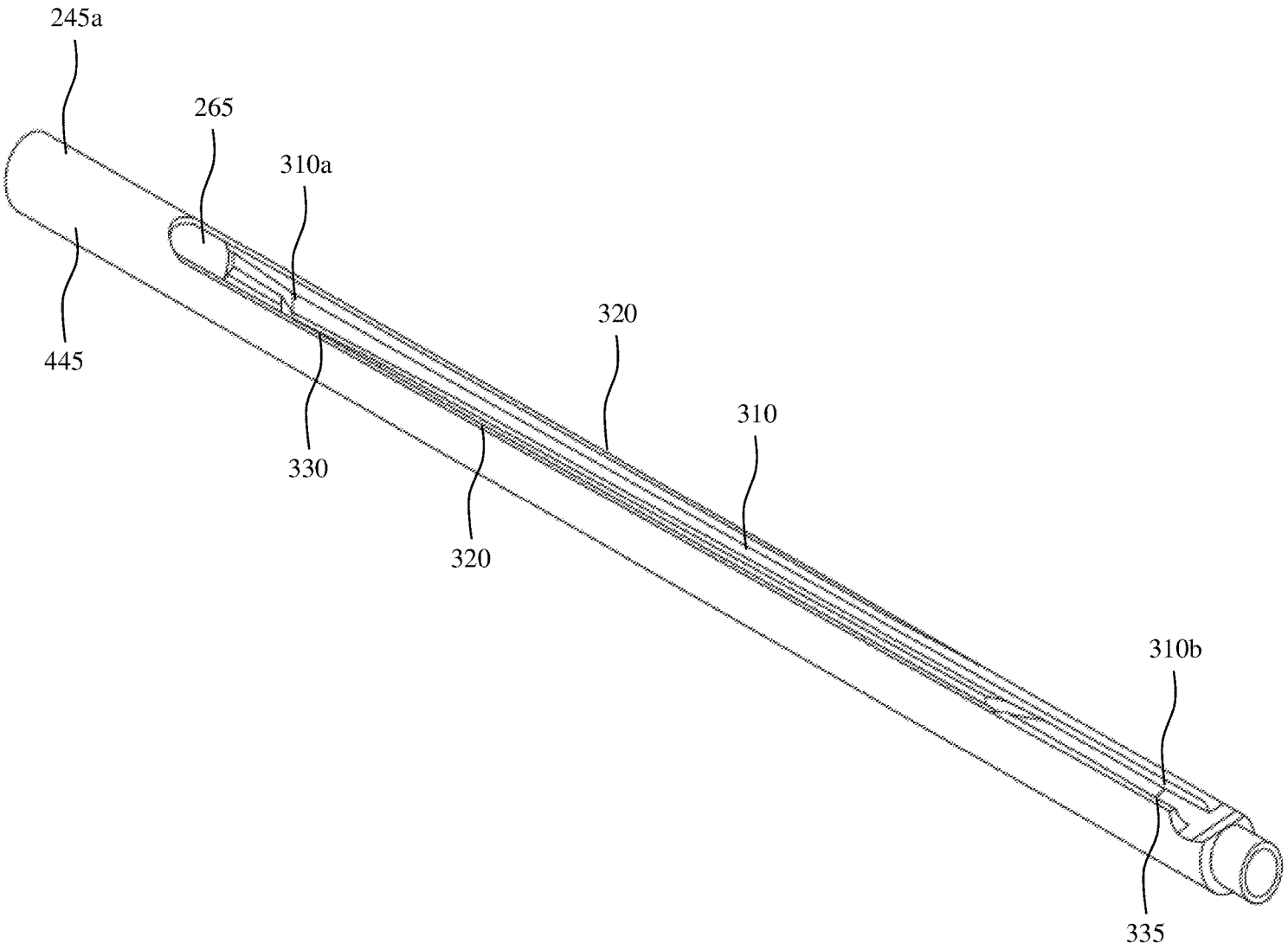
FIGS. 4A through 4N illustrate various different views of an alternative embodiment of a multilateral junction, including a lateral branch template and lateral branch connector, designed, manufactured and/or operated according to one or more embodiments of the disclosure.
Figure 4B:
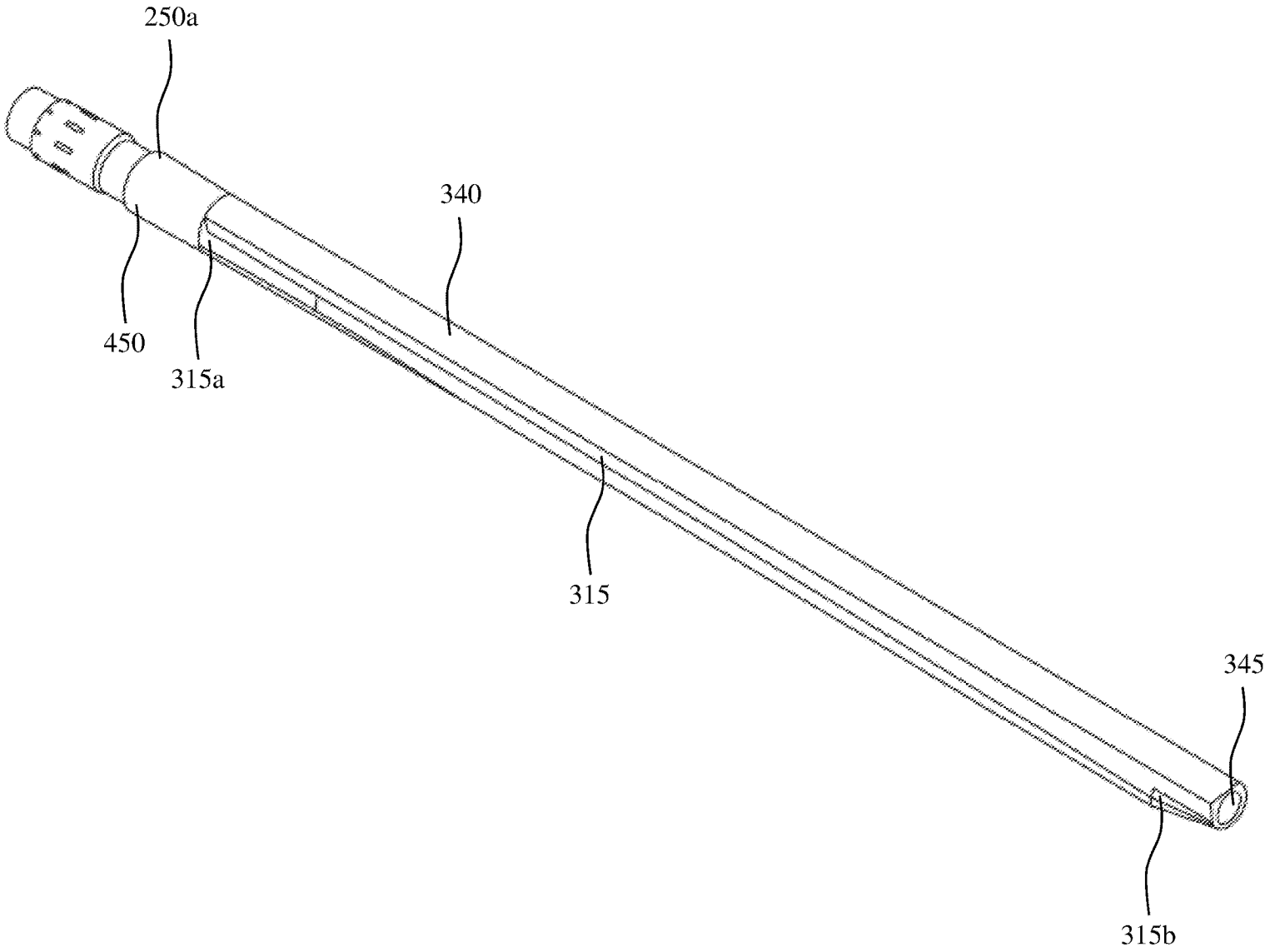
Figure 4C:
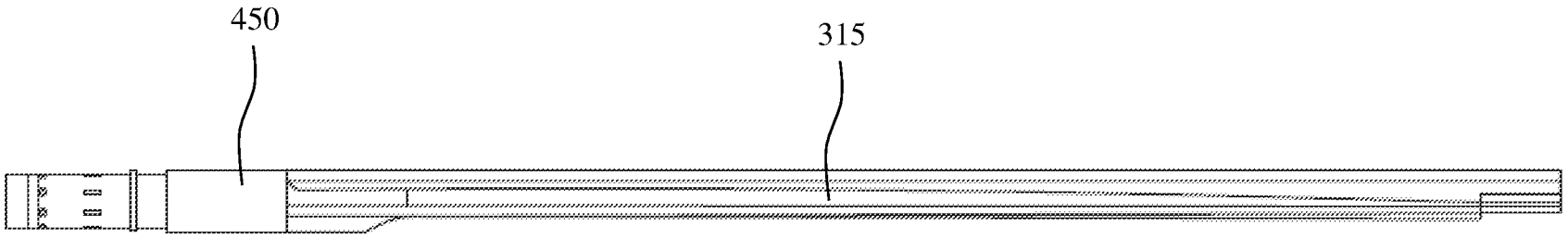
Figure 4D:
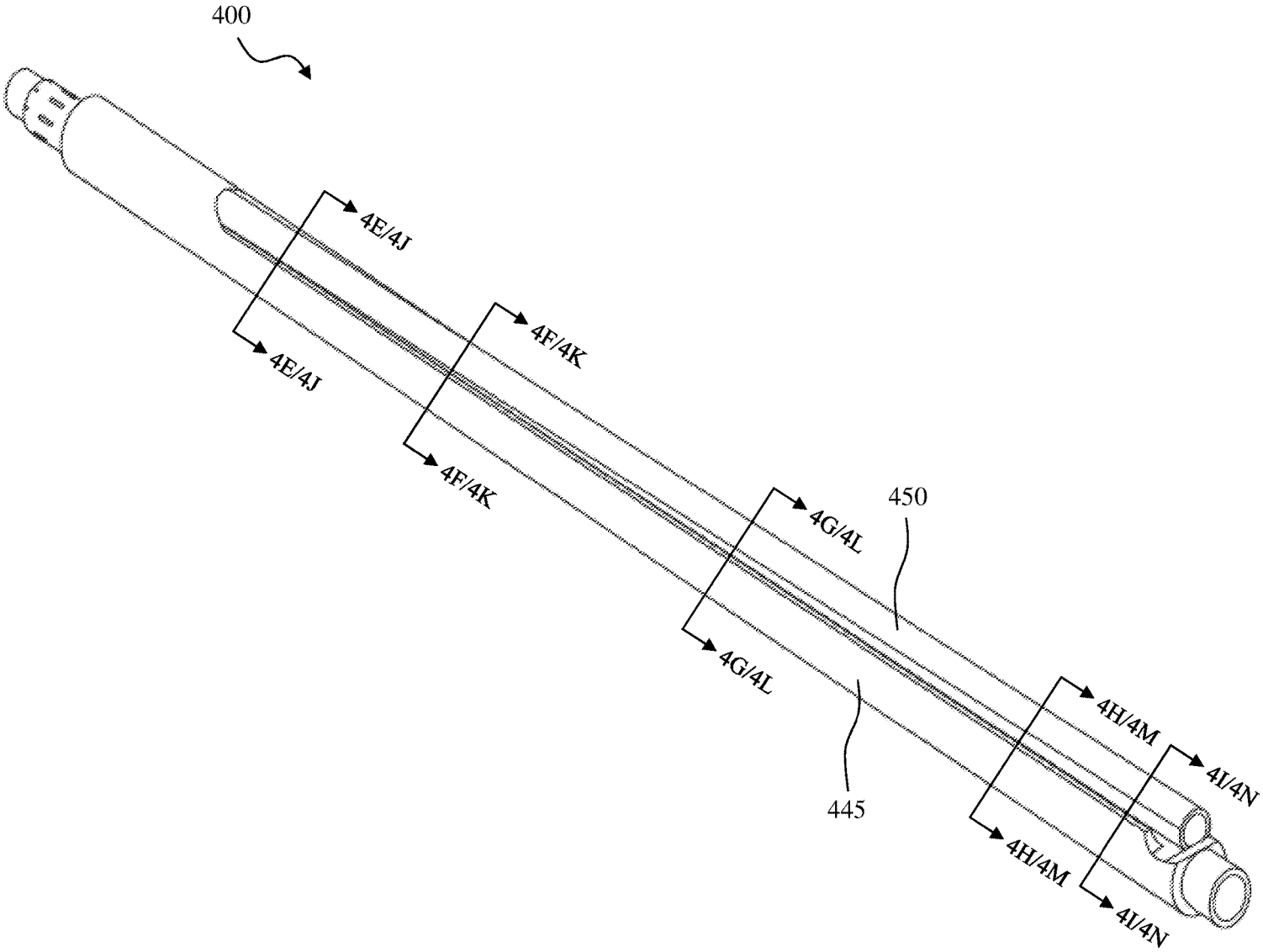
Figure 4E:
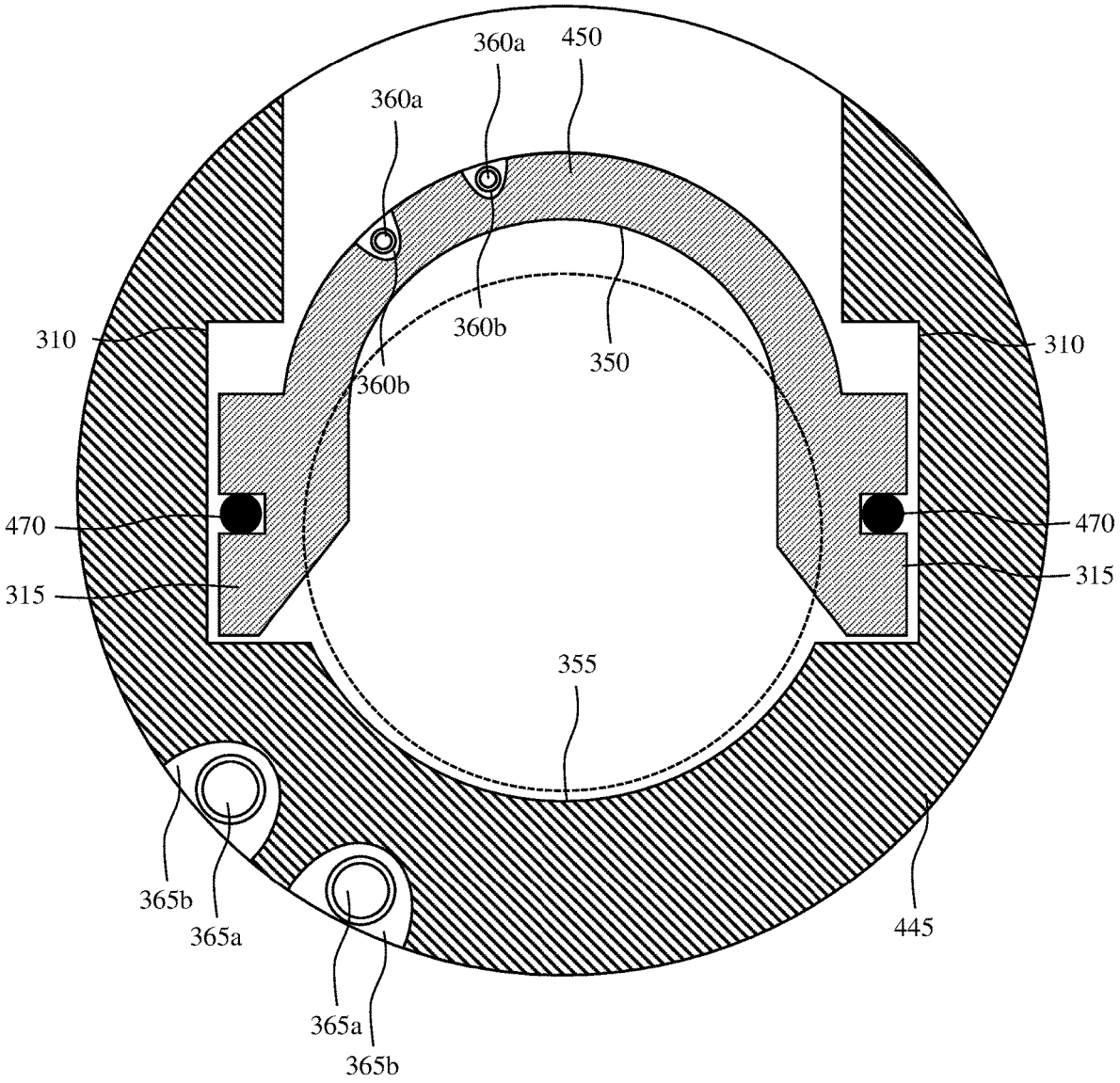
Figure 4F:
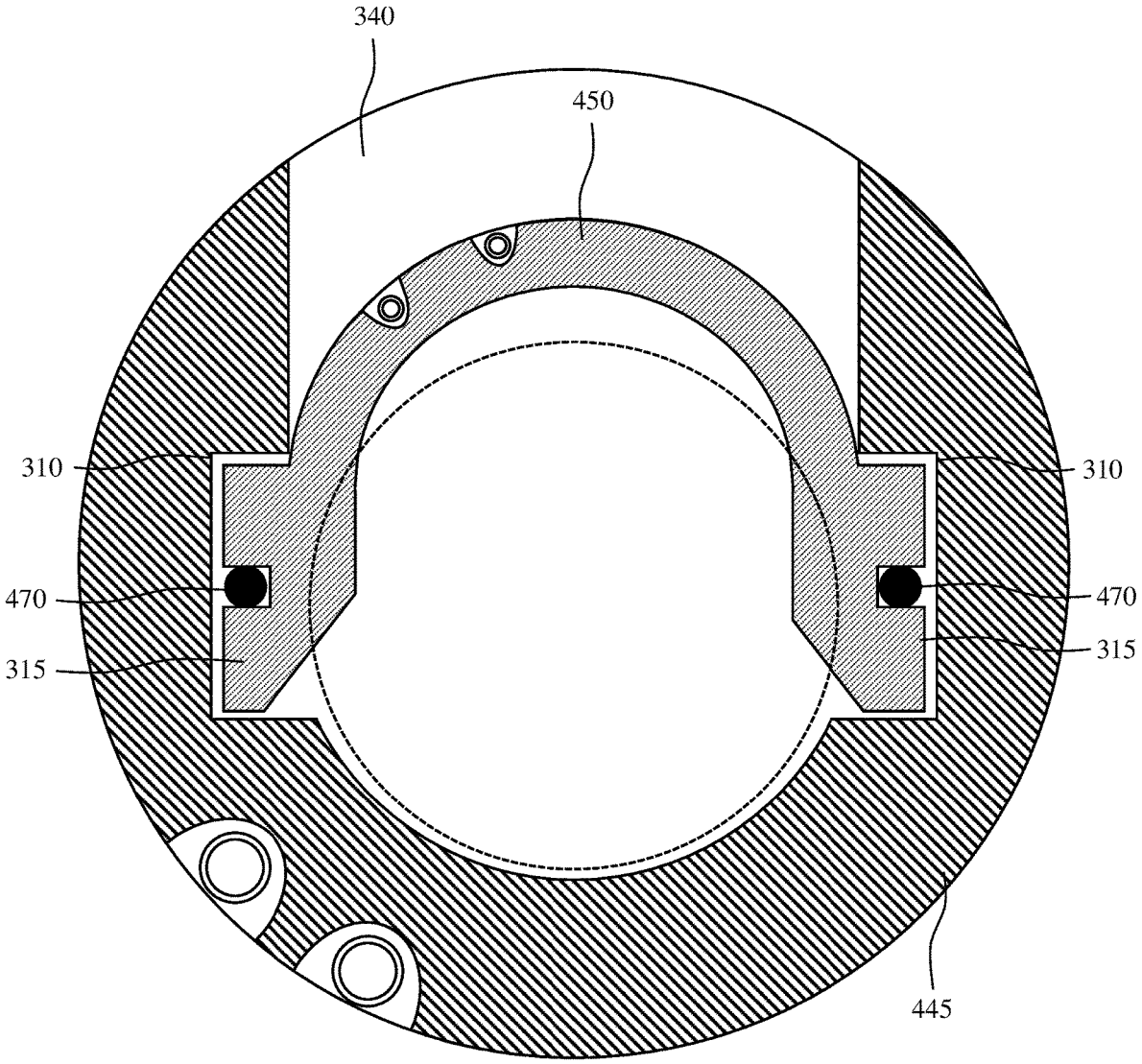
Figure 4G:
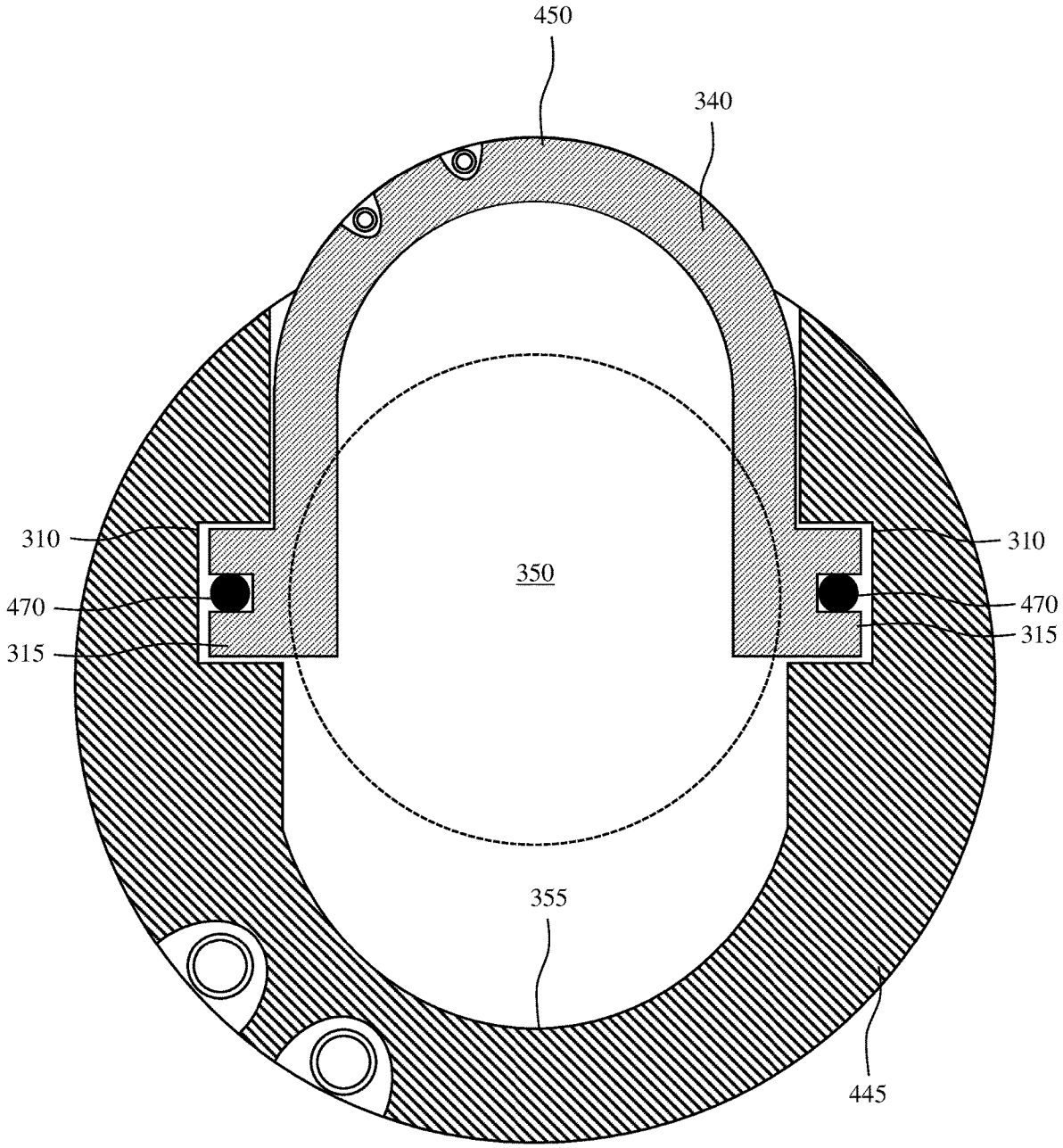
Figure 4H:
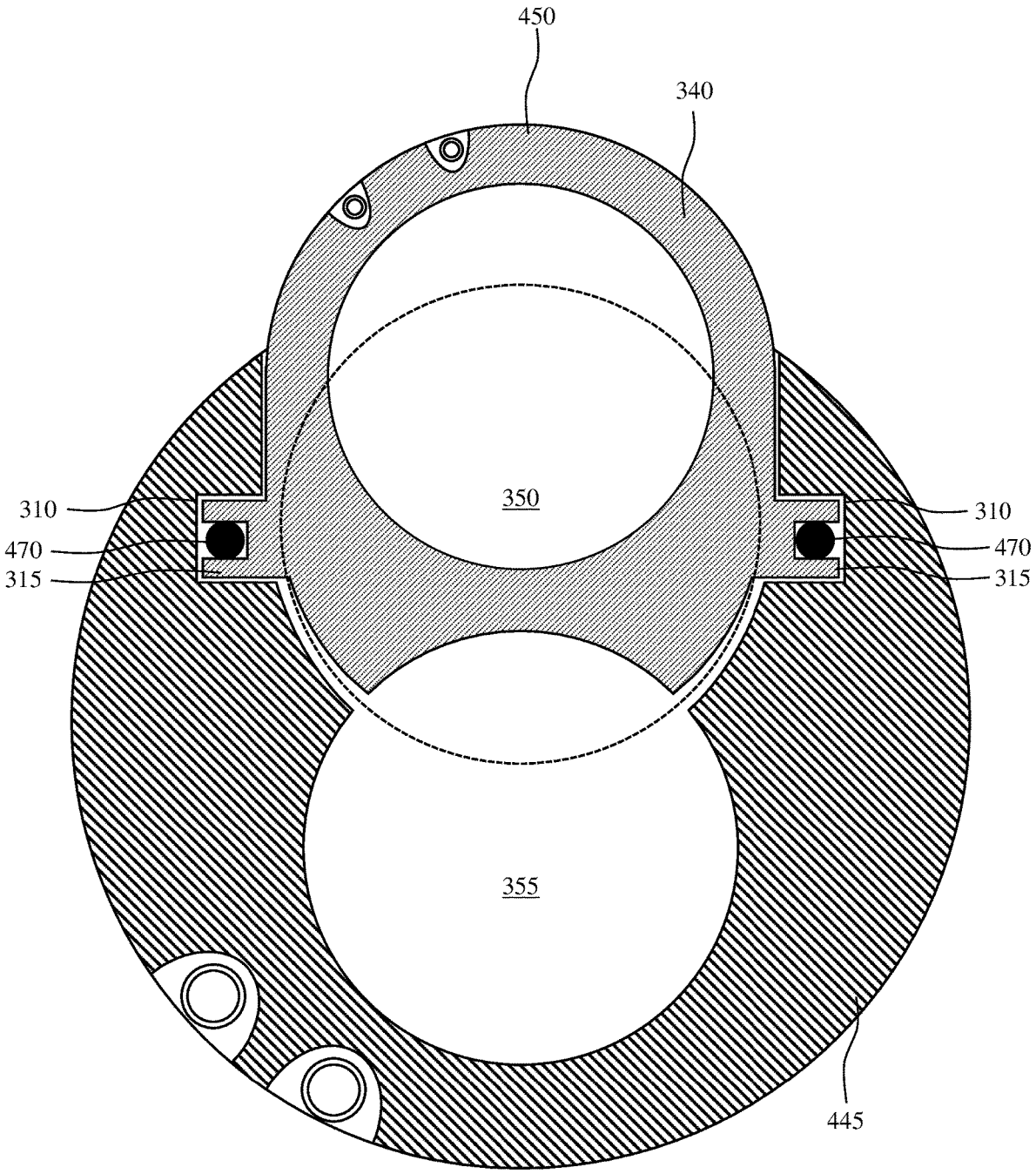
Figure 4I:
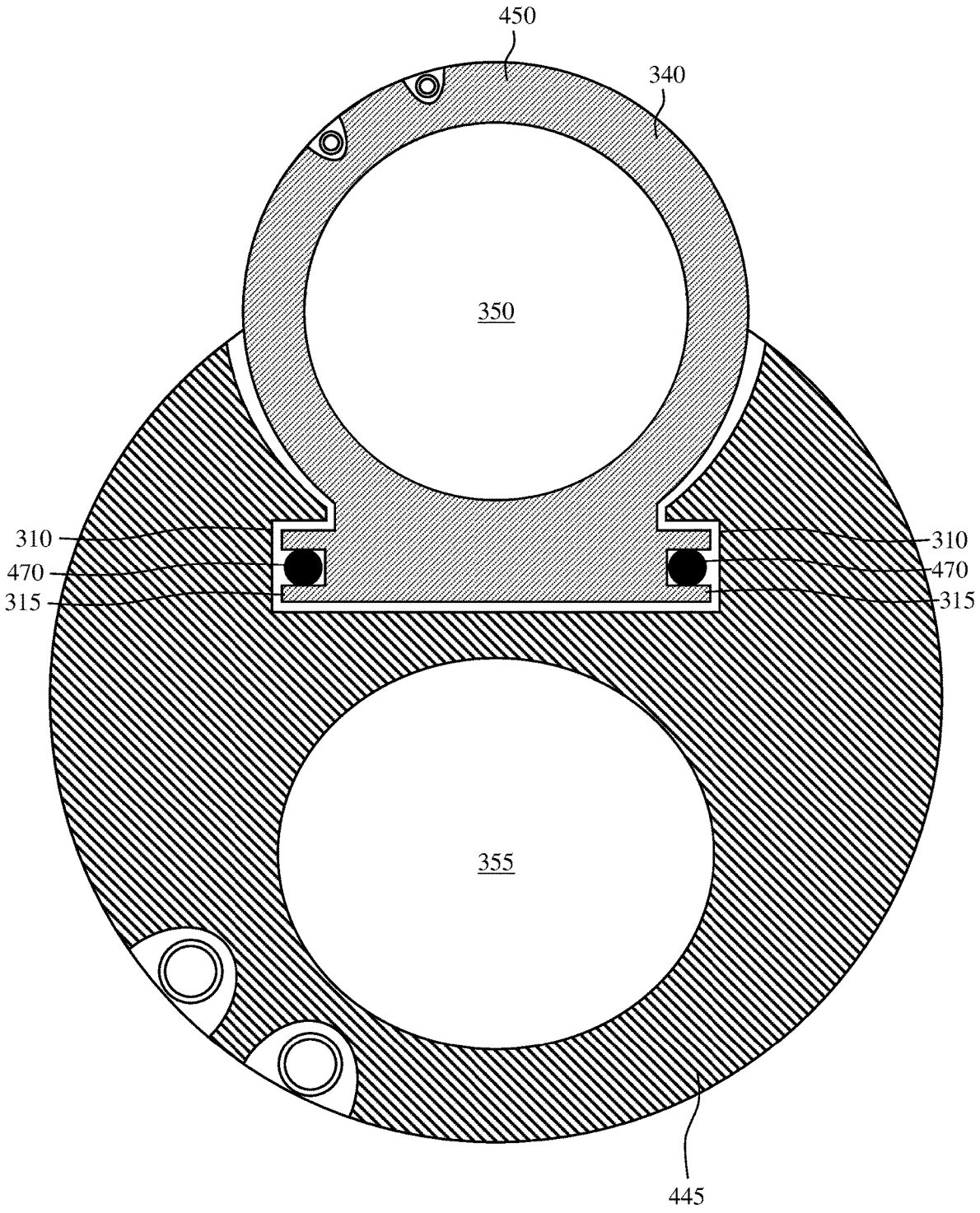
Figure 4J:
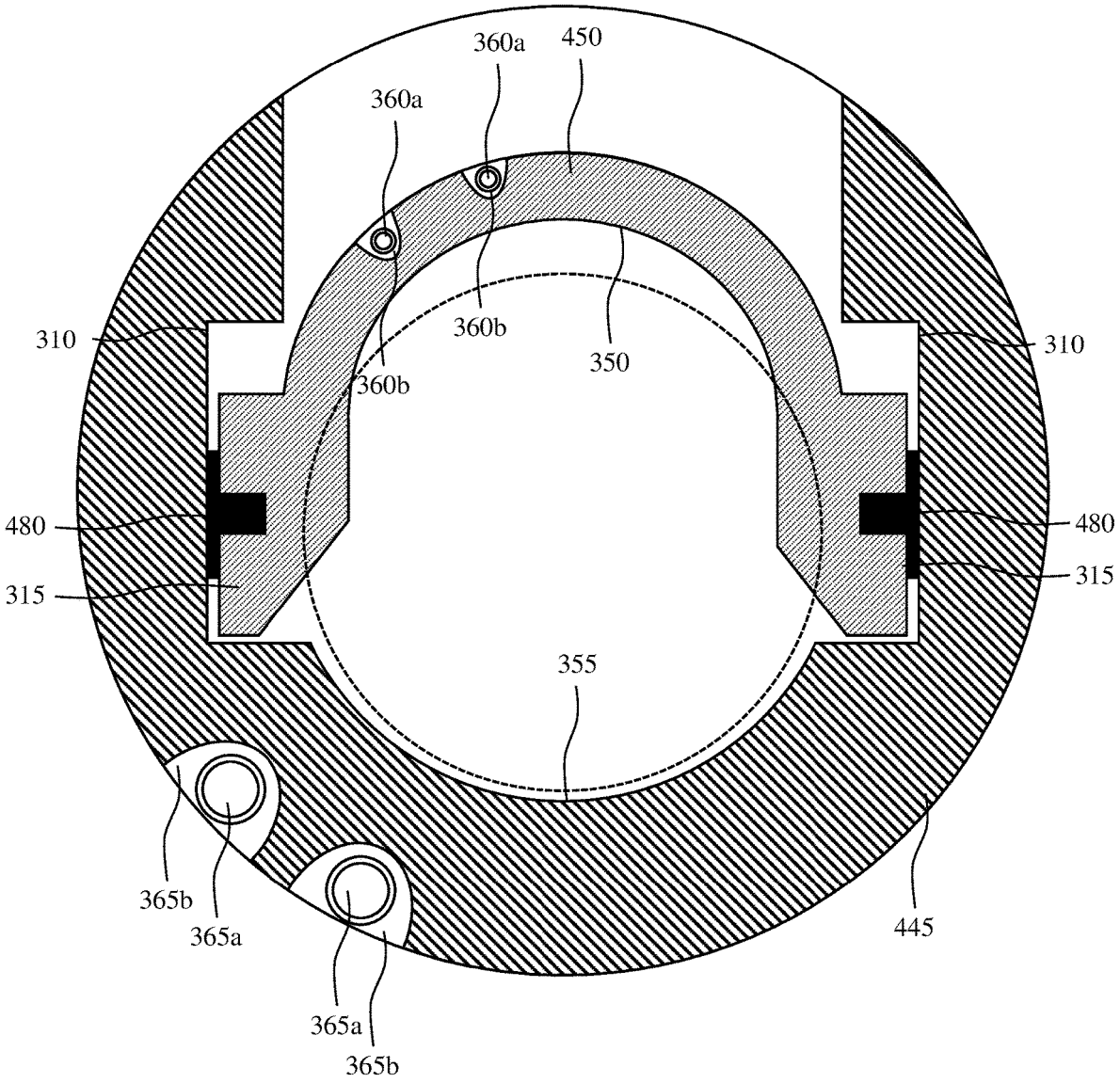
Figure 4K:
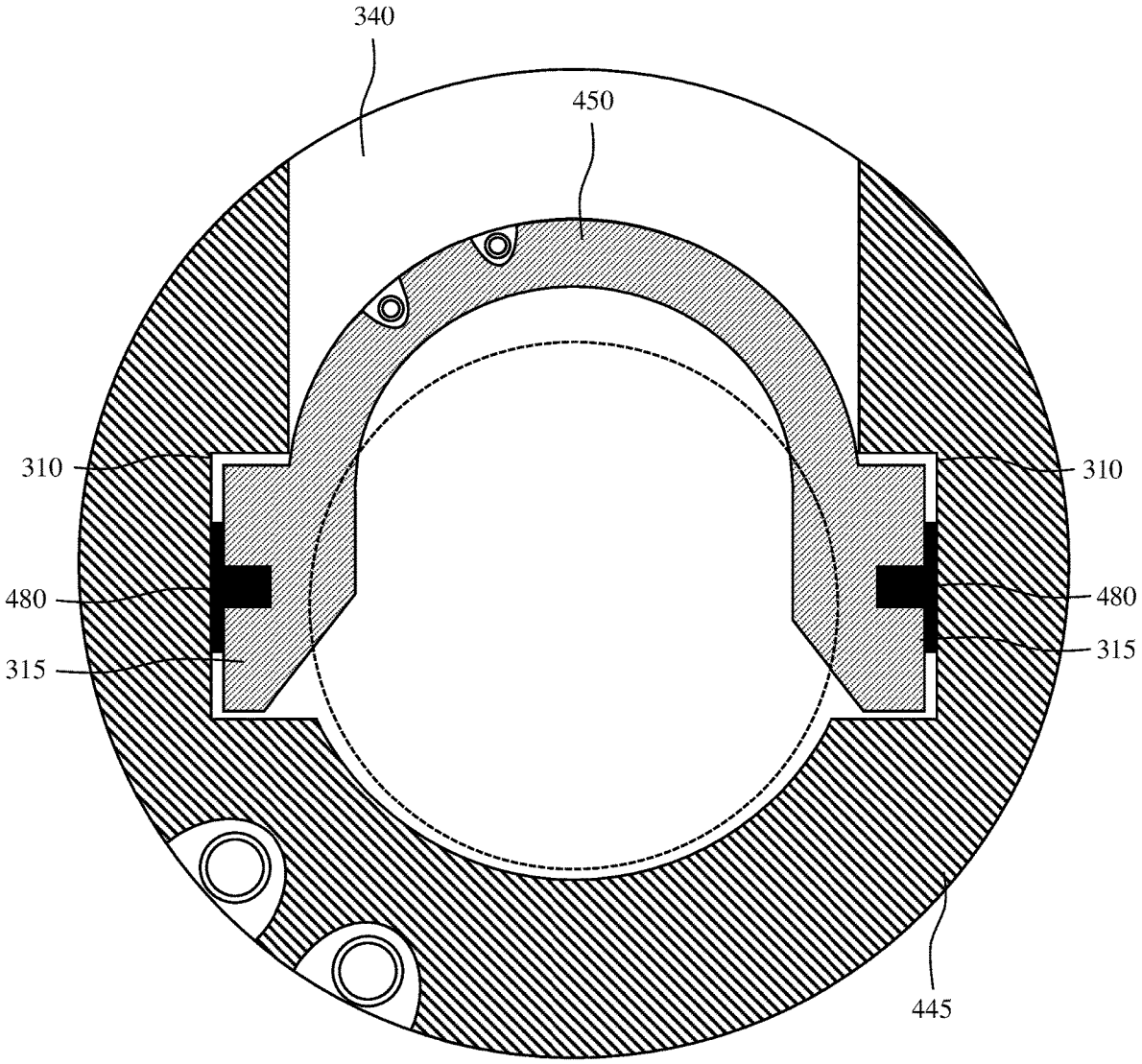
Figure 4L:
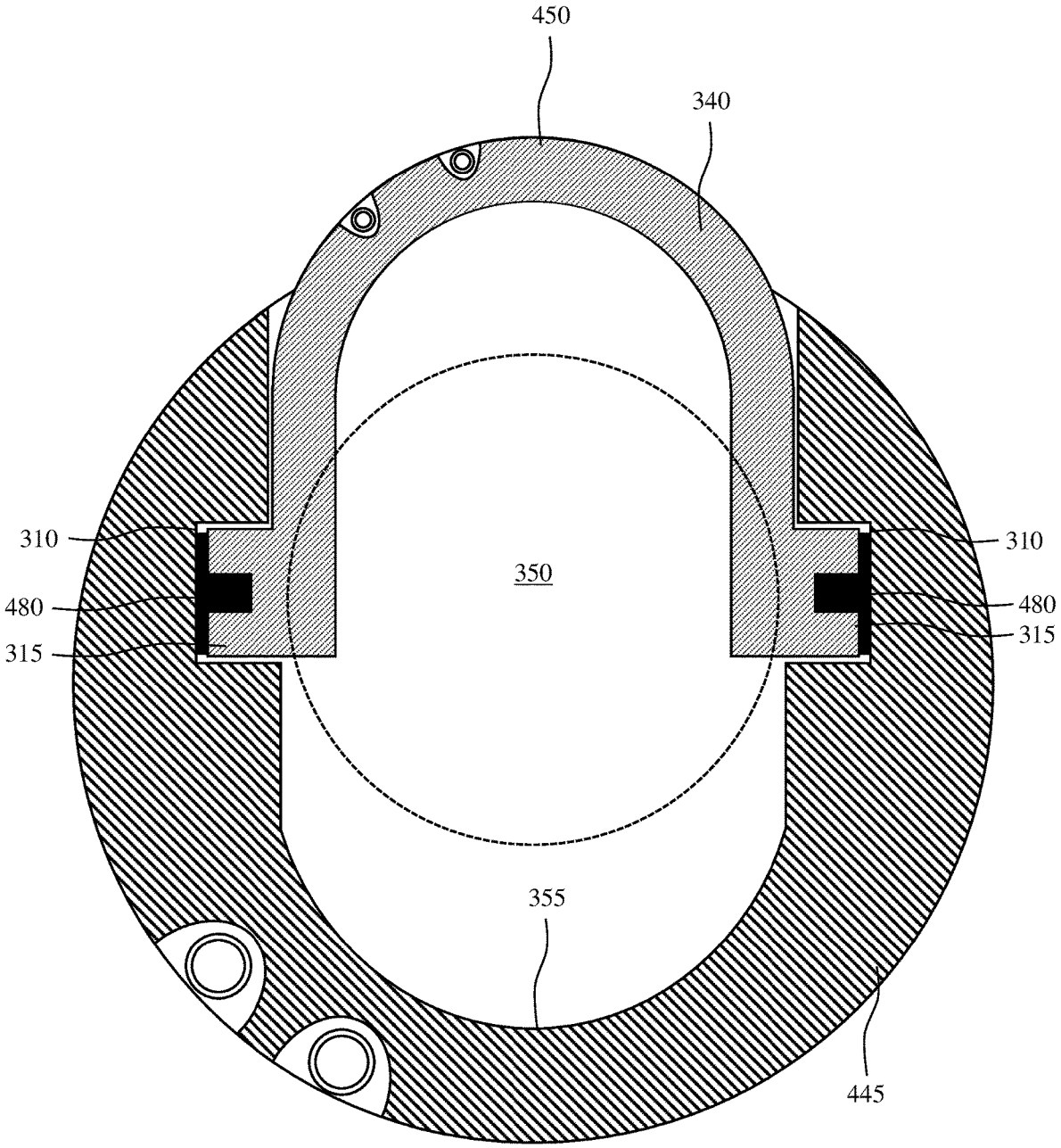
Figure 4M:
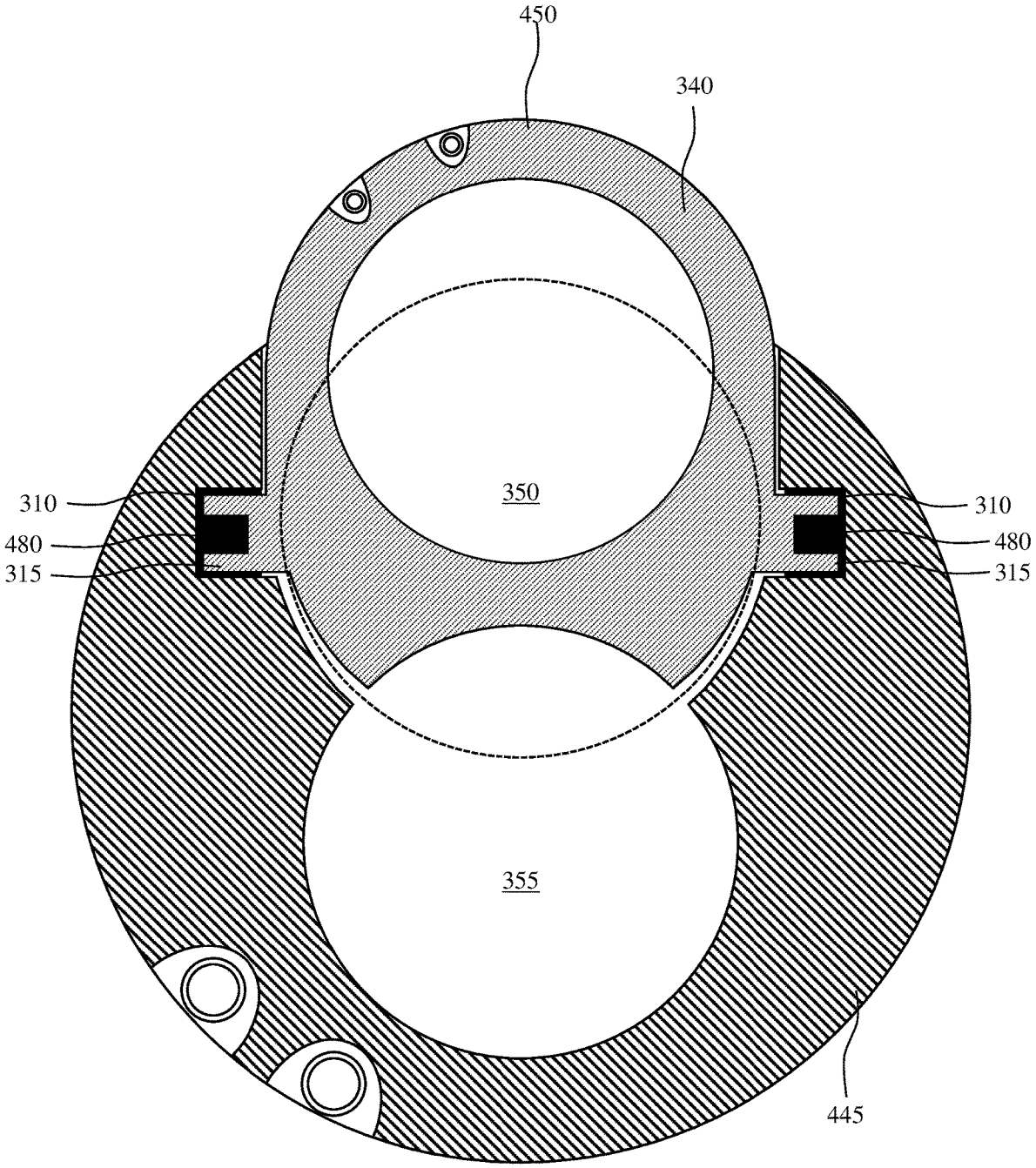
Figure 4N:
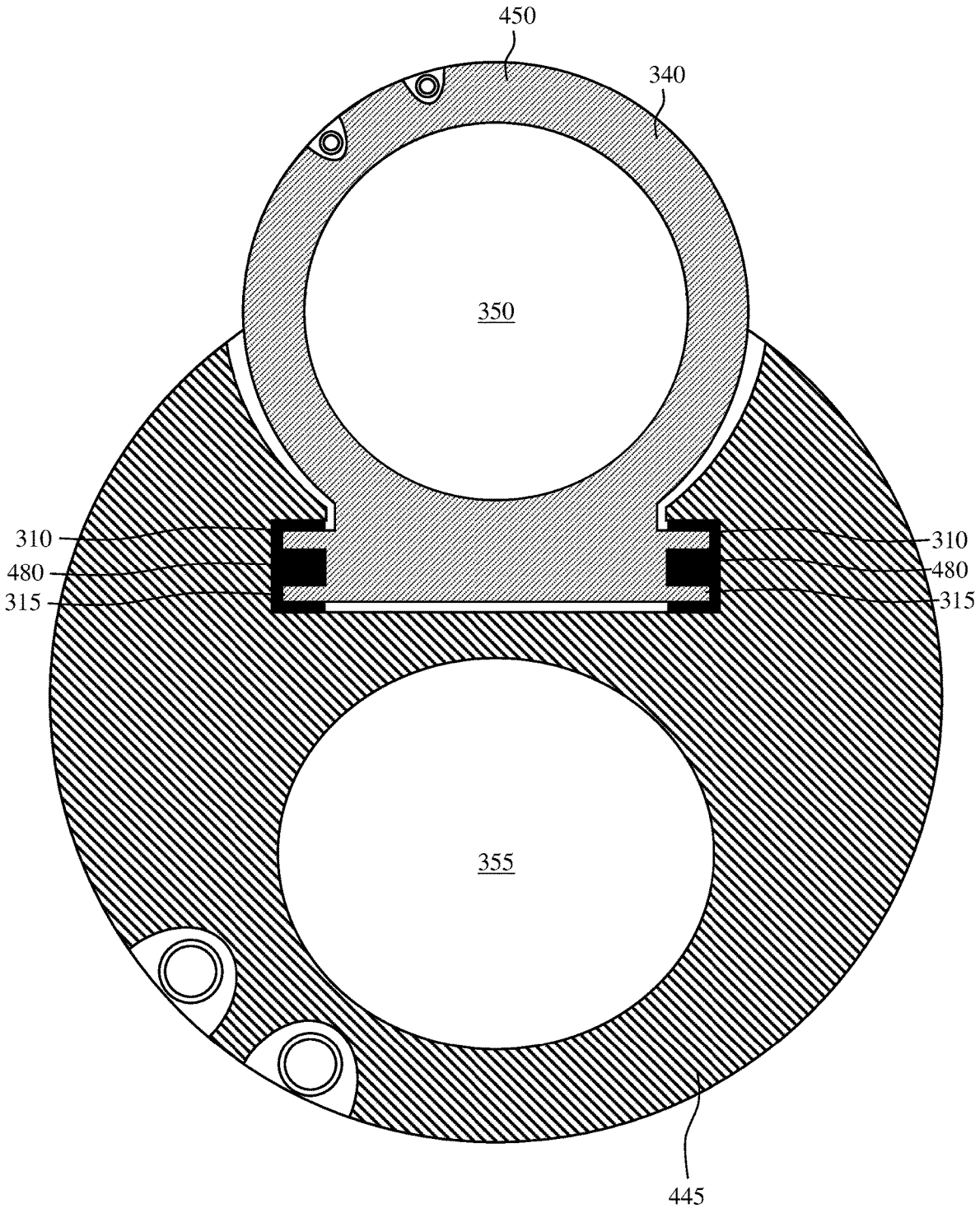

Turning to FIGS. 4A through 4N, illustrated are various different views of an alternative embodiment of a multilateral junction 400, including a lateral branch template 445 and lateral branch connector 450, designed, manufactured and/or operated according to one or more embodiments of the disclosure. The multilateral junction 400, including the lateral branch template 445 and lateral branch connector 450, is similar in many respects to the multilateral junction, including the lateral branch template 245 and lateral branch connector 250, described with respect to FIGS. 3A through 3N. Accordingly, like reference numbers have been used to indicated similar, if not identical, features.

The multilateral junction 400, including the lateral branch template 445 and lateral branch connector 450, differs for the most part from the multilateral junction, including the lateral branch template 245 and lateral branch connector 250 described with respect to FIGS. 3A through 3N, in that the multilateral junction 400 employs a pre-expansion seal 470 that is configured to swell in volume, for example by sorption (e.g., as discussed above) and a post-expansion seal 480 that has swollen in volume, for example by sorption (e.g., as also discussed above). The pre-expansion seal 470 and post-expansion seal 480 may comprise any of the materials discussed above. As discussed, the ability for the pre-expansion seal 470 to expand (e.g., swell) in volume provides many benefits that existing devices were unable to achieve.

Figure 5A:
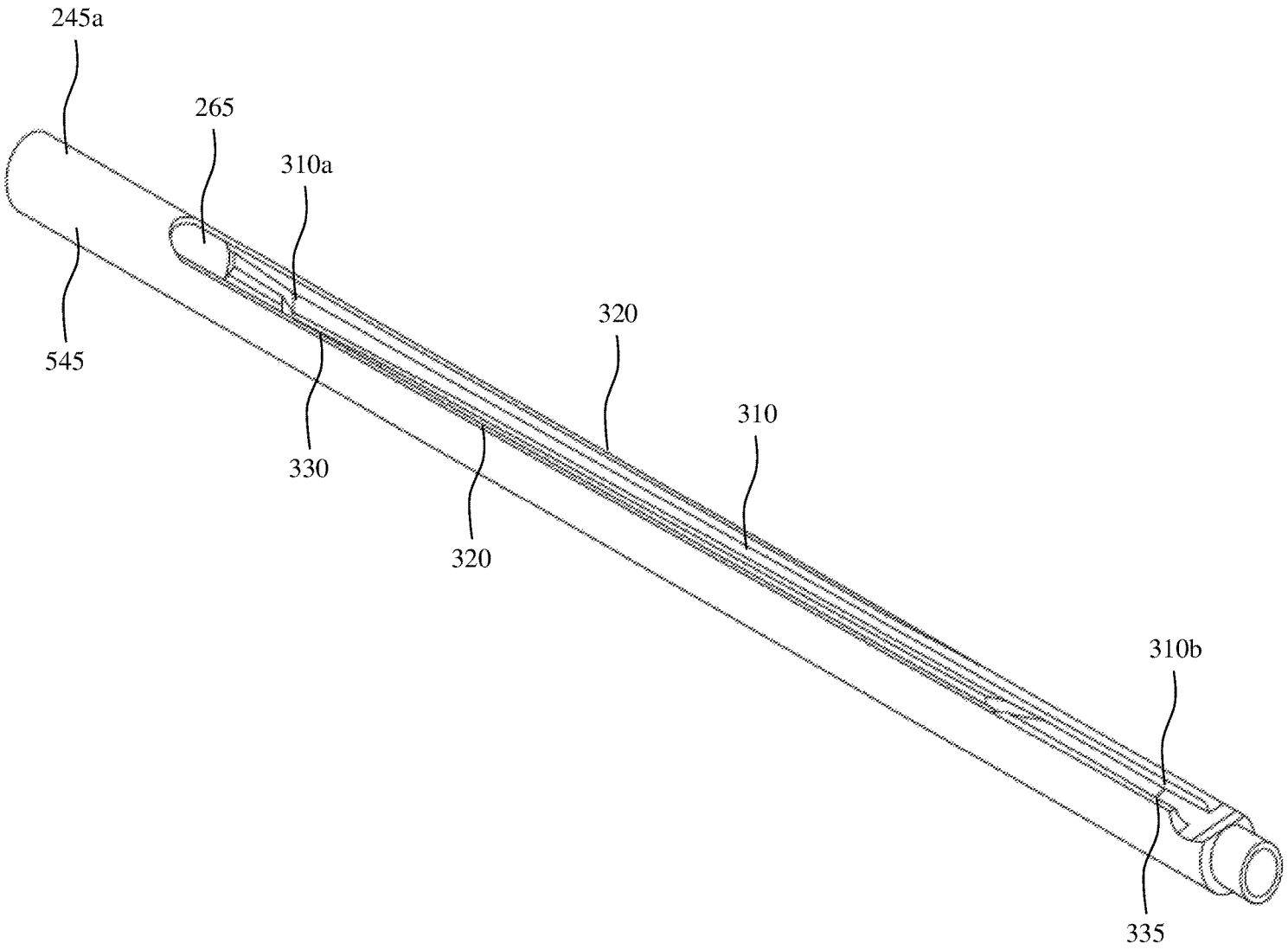
FIGS. 5A through 5N illustrate various different views of an alternative embodiment of a multilateral junction, including a lateral branch template and lateral branch connector, designed, manufactured and/or operated according to one or more embodiments of the disclosure.
Figure 5B:
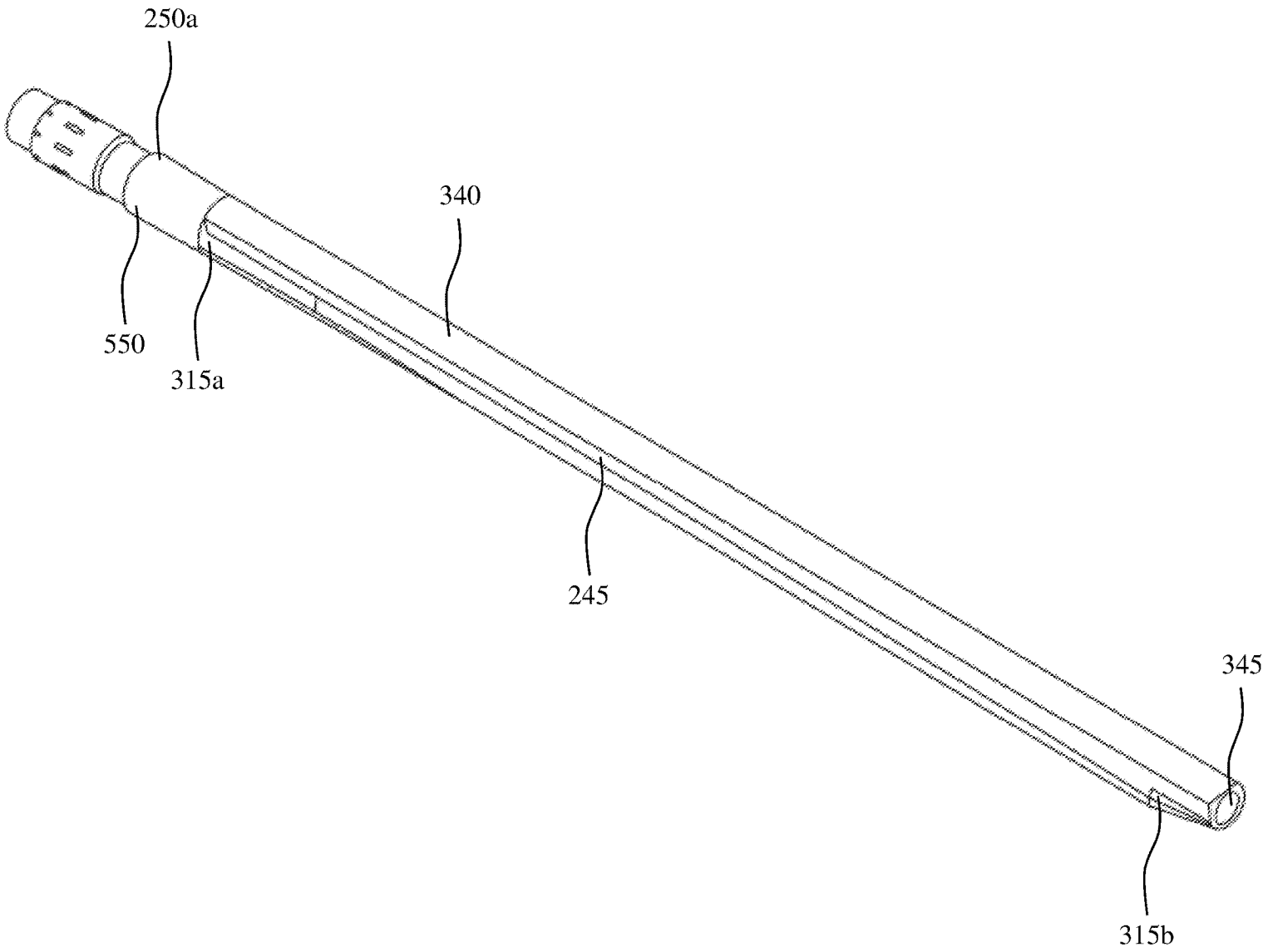
Figure 5C:
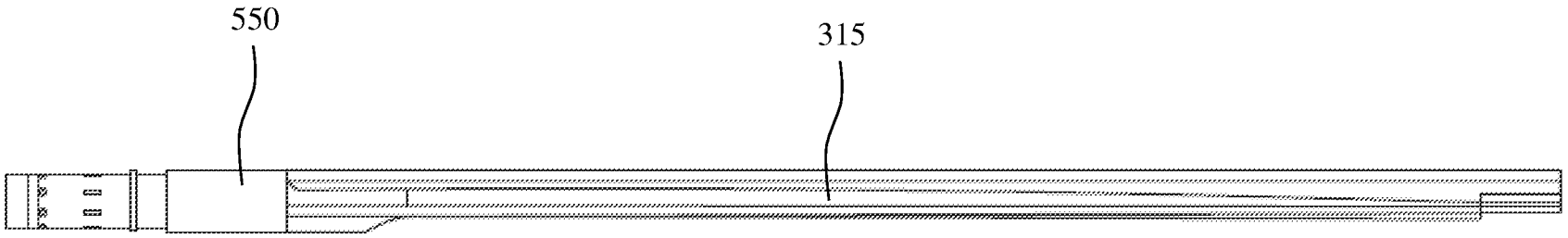
Figure 5D:
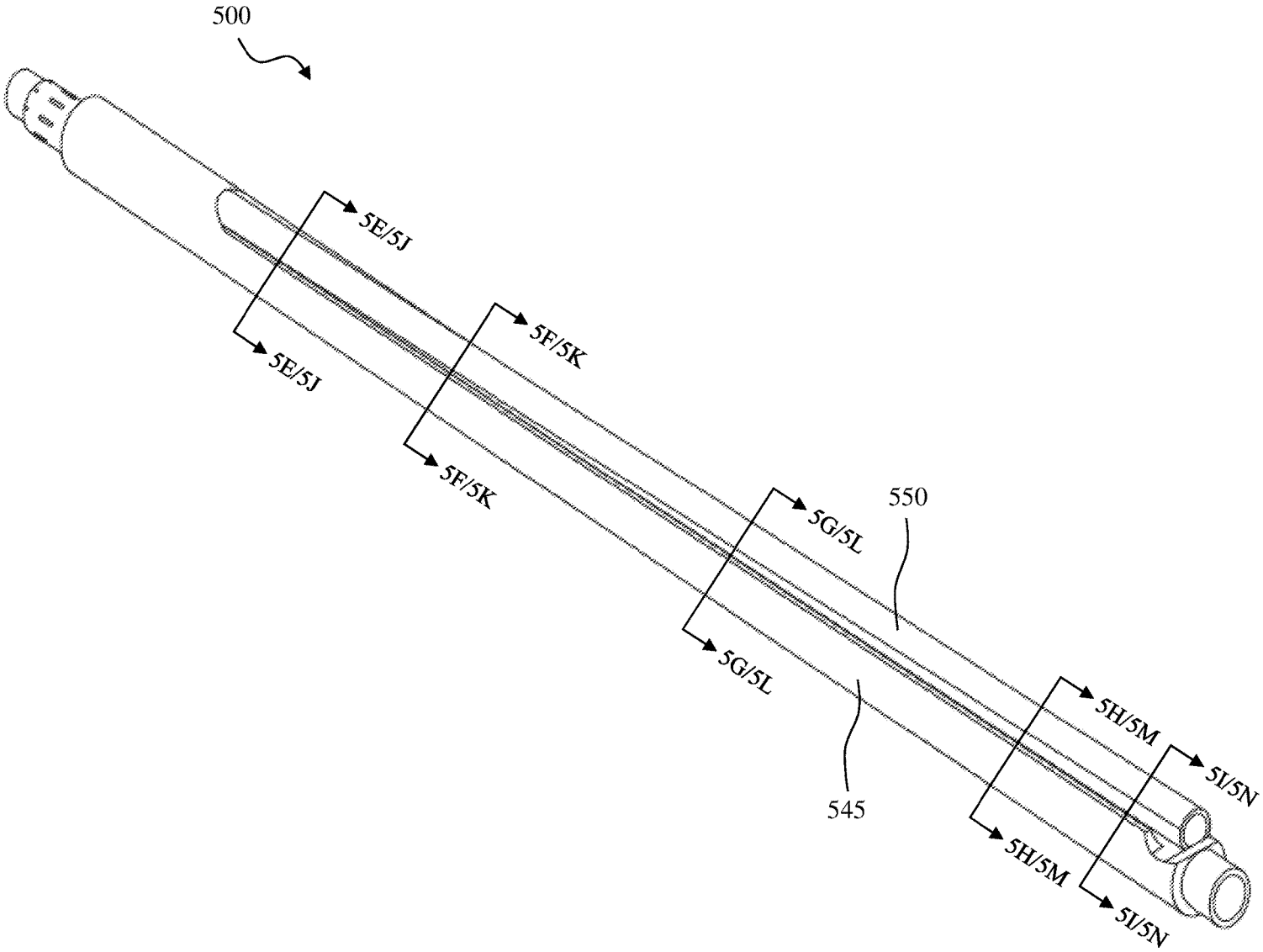
Figure 5E:
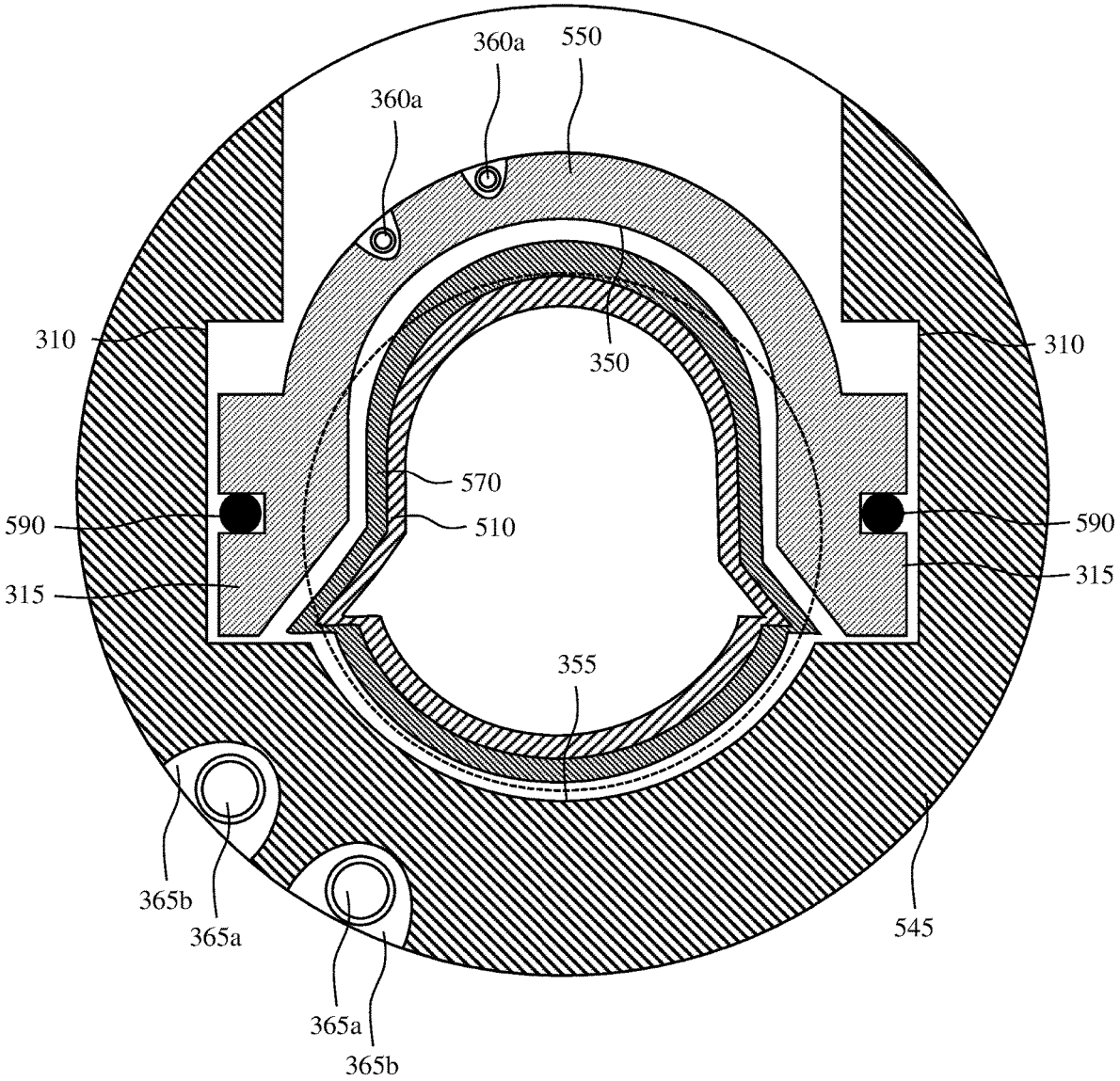
Figure 5F:
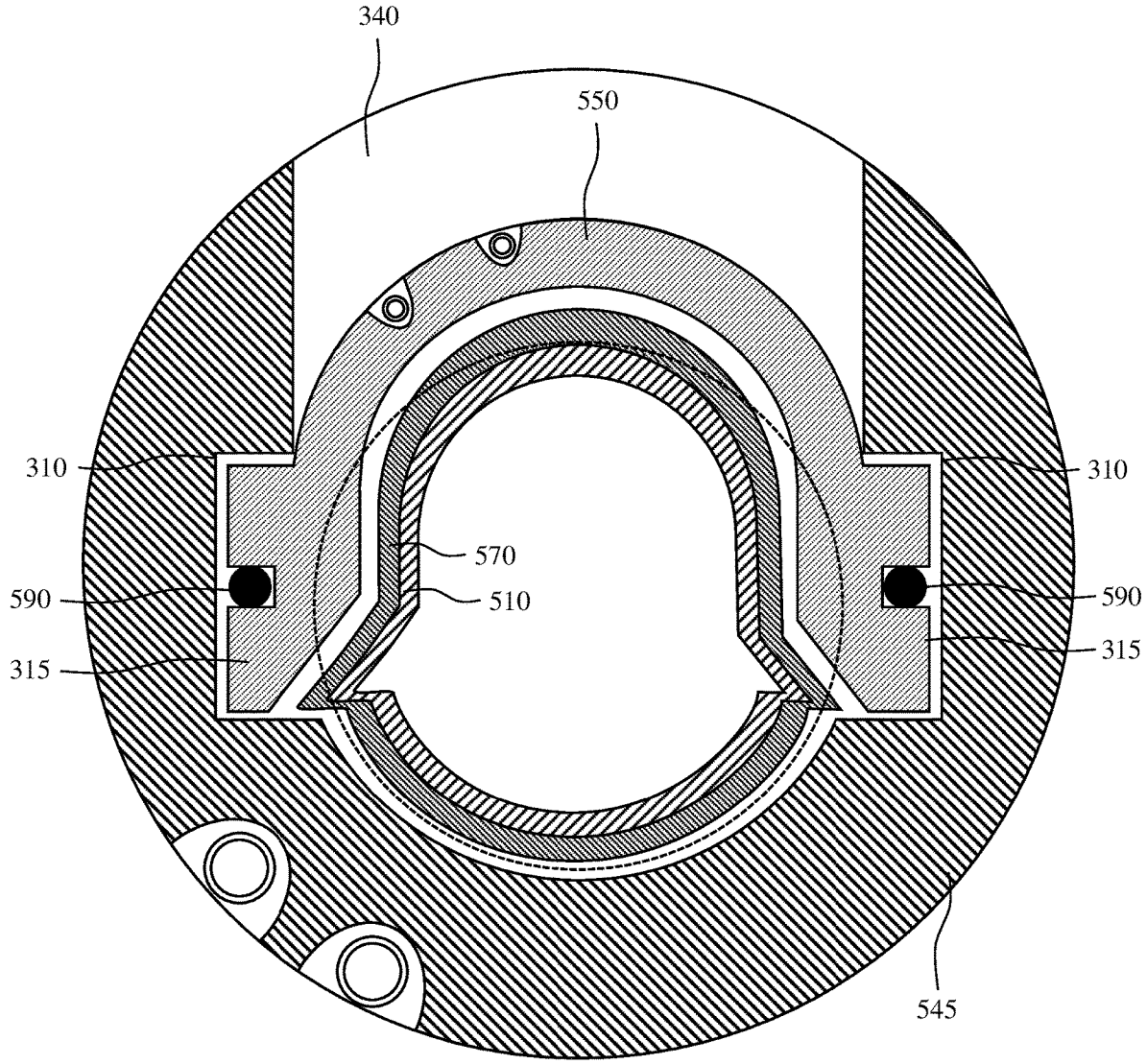
Figure 5G:
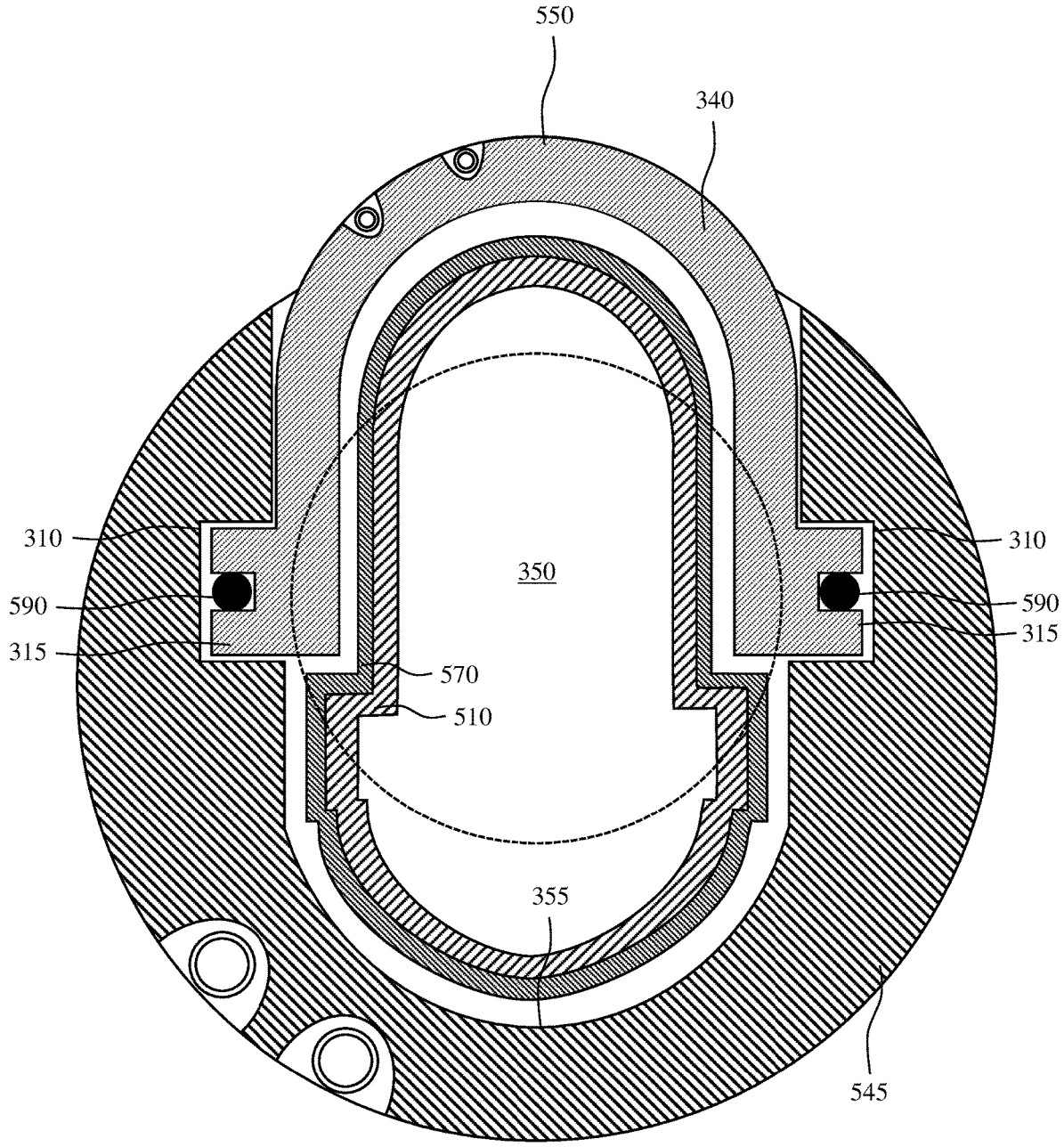
Figure 5H:
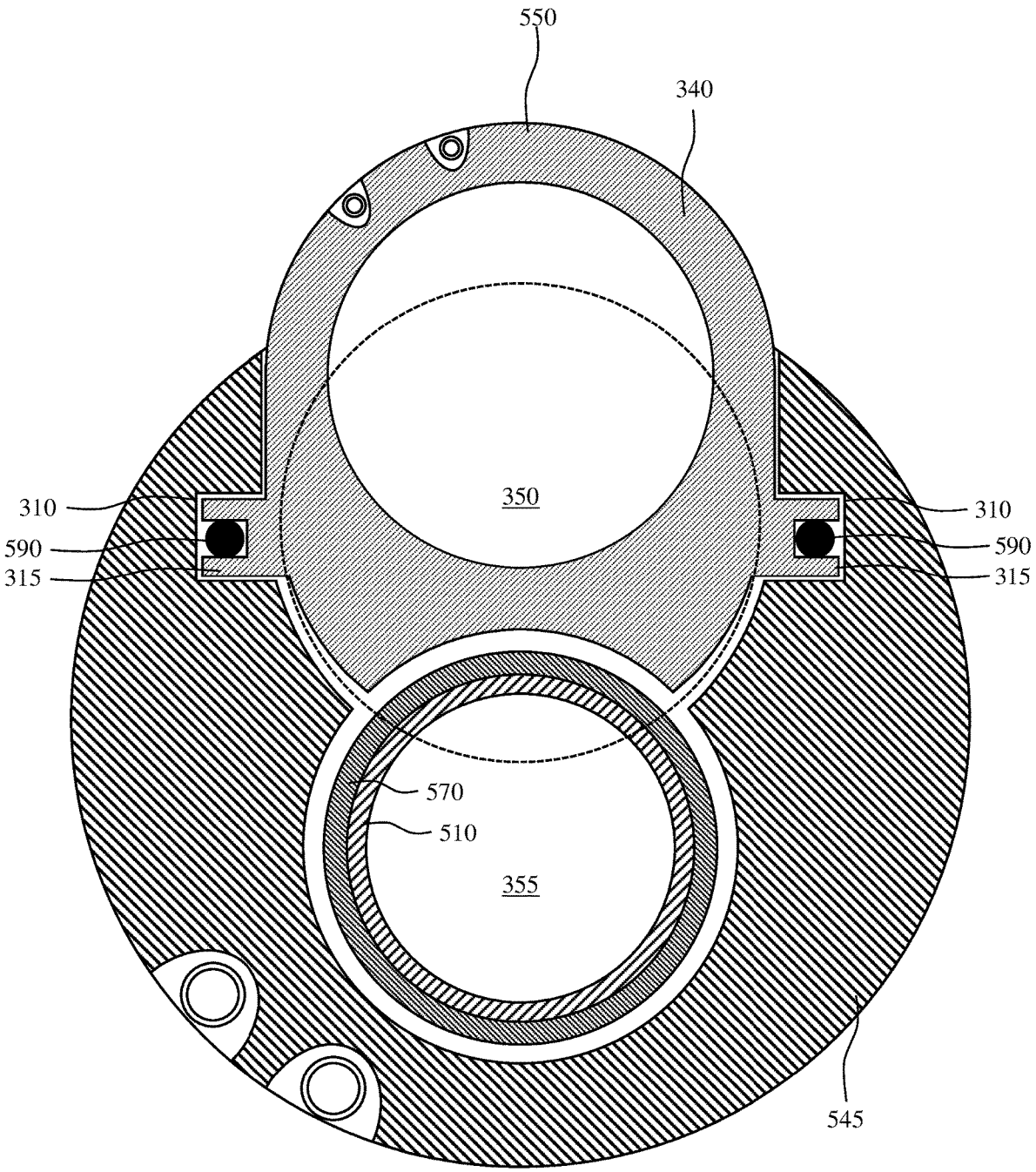
Figure 5I:
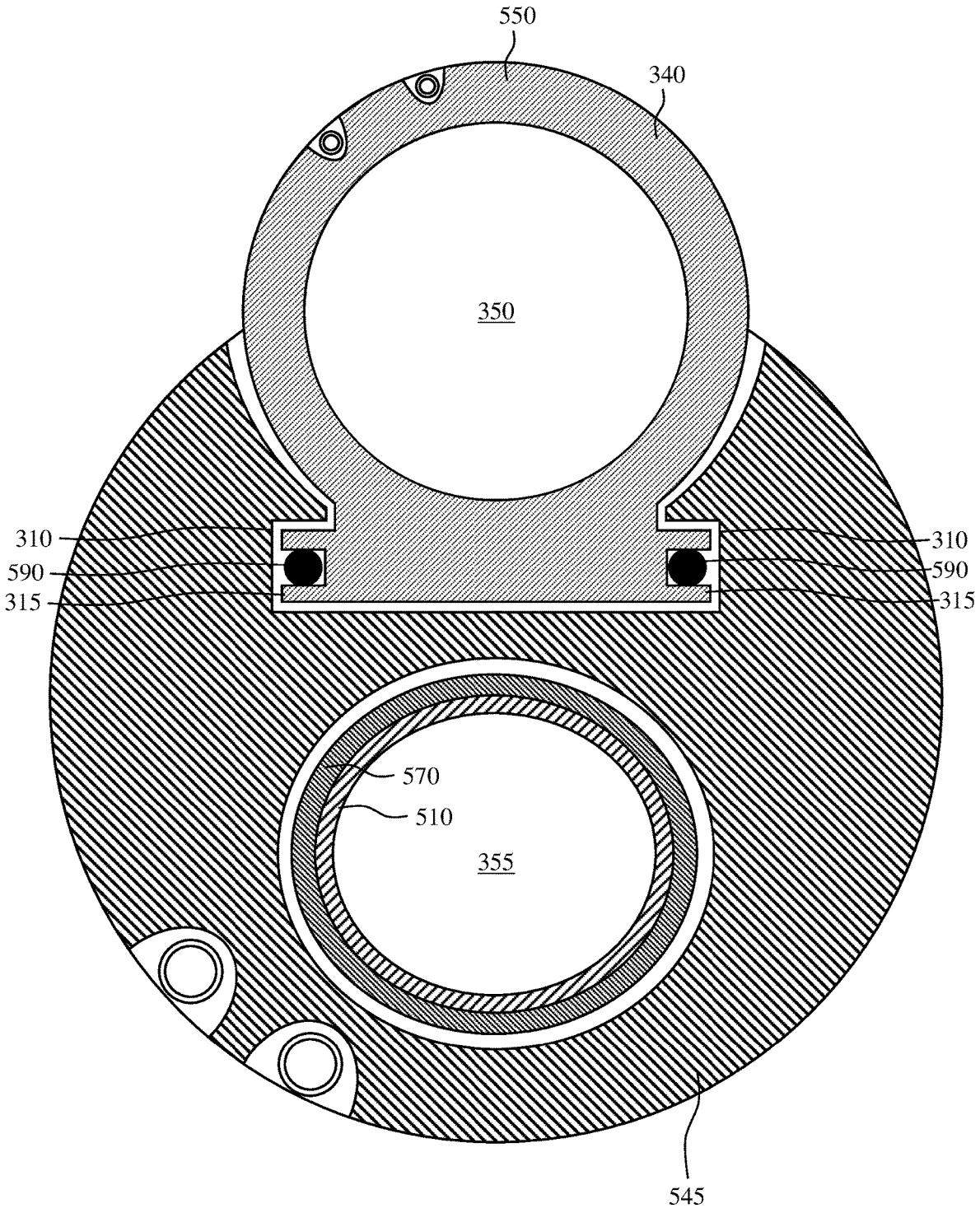
Figure 5J:
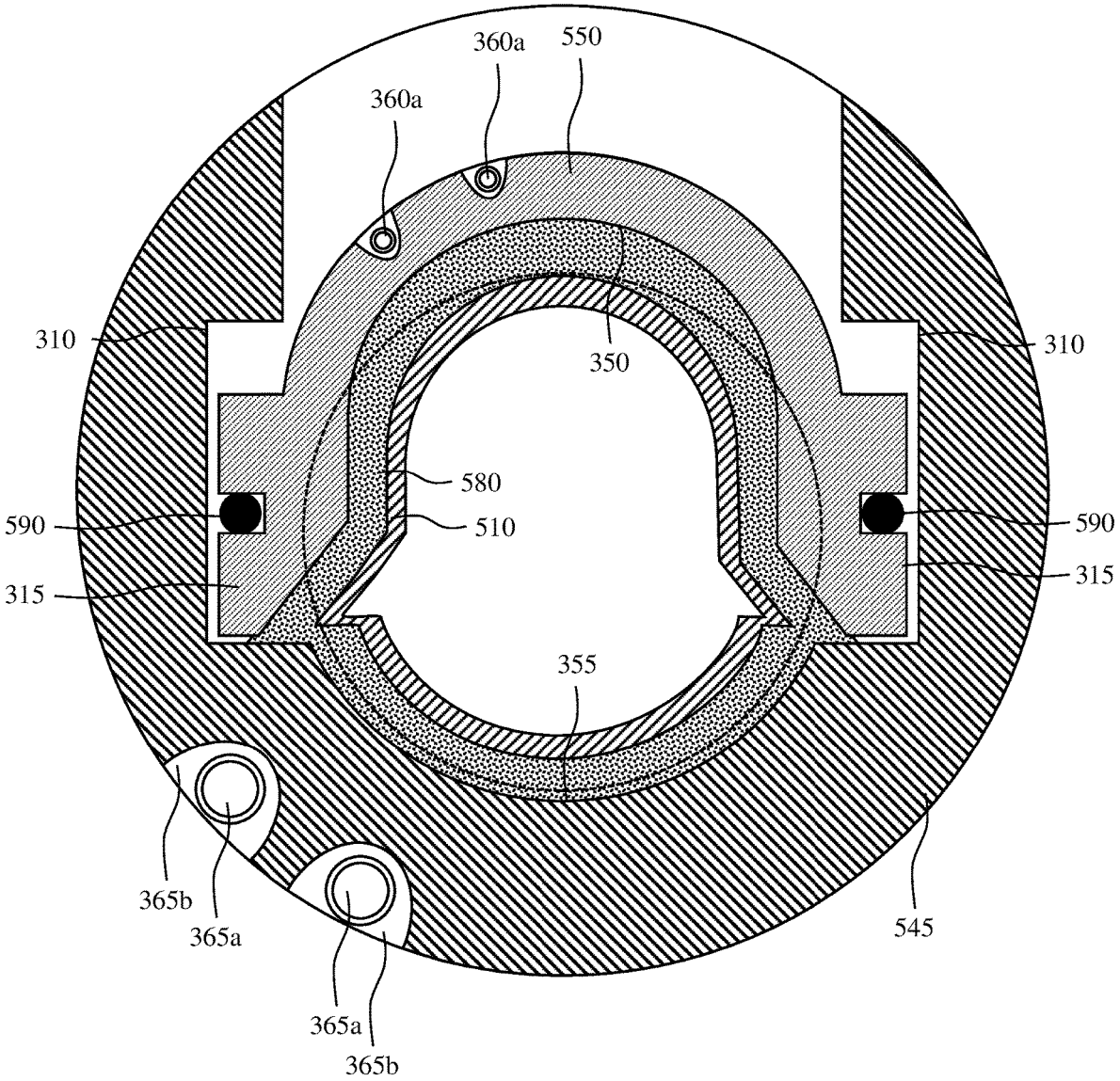
Figure 5K:
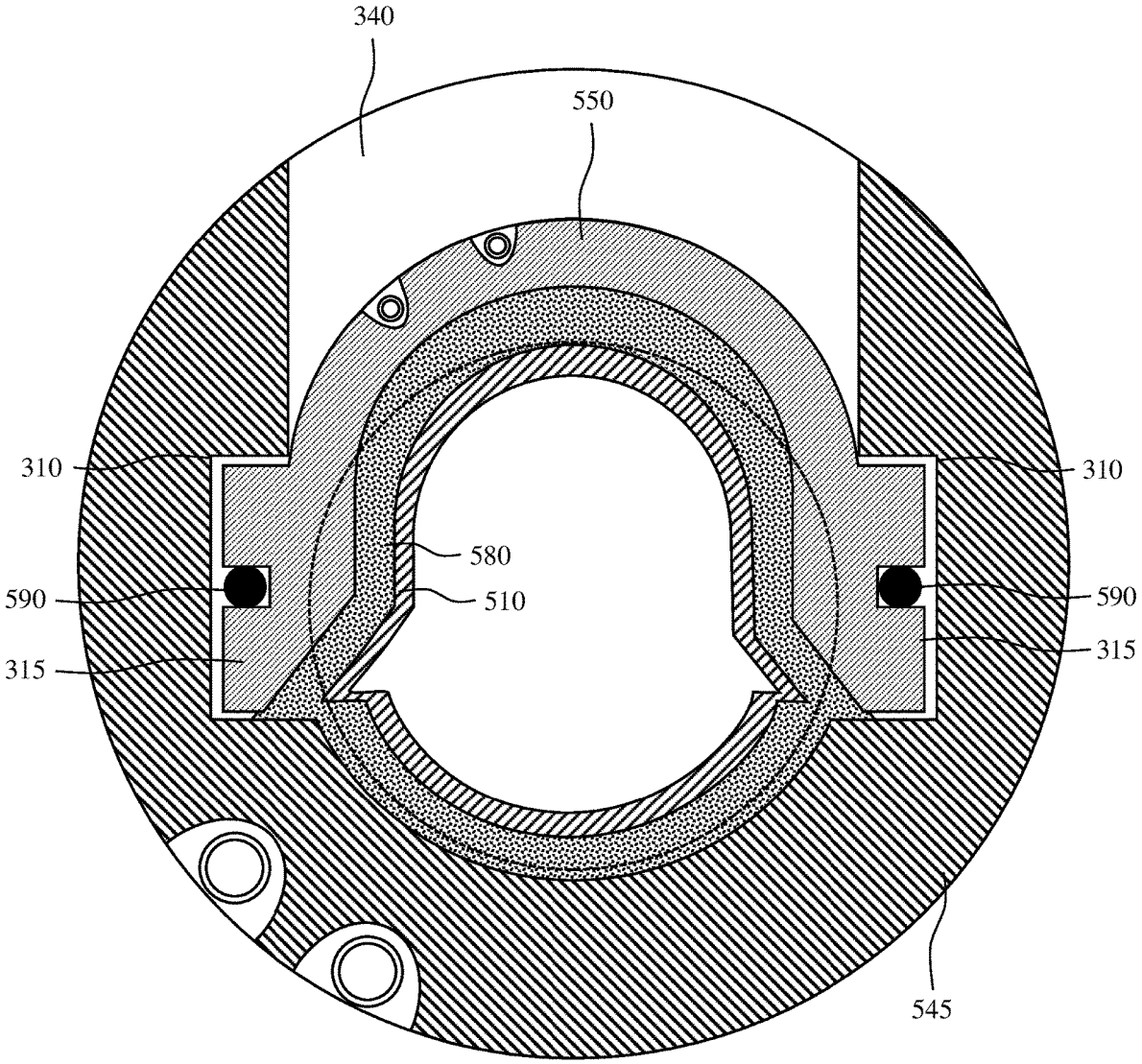
Figure 5L:
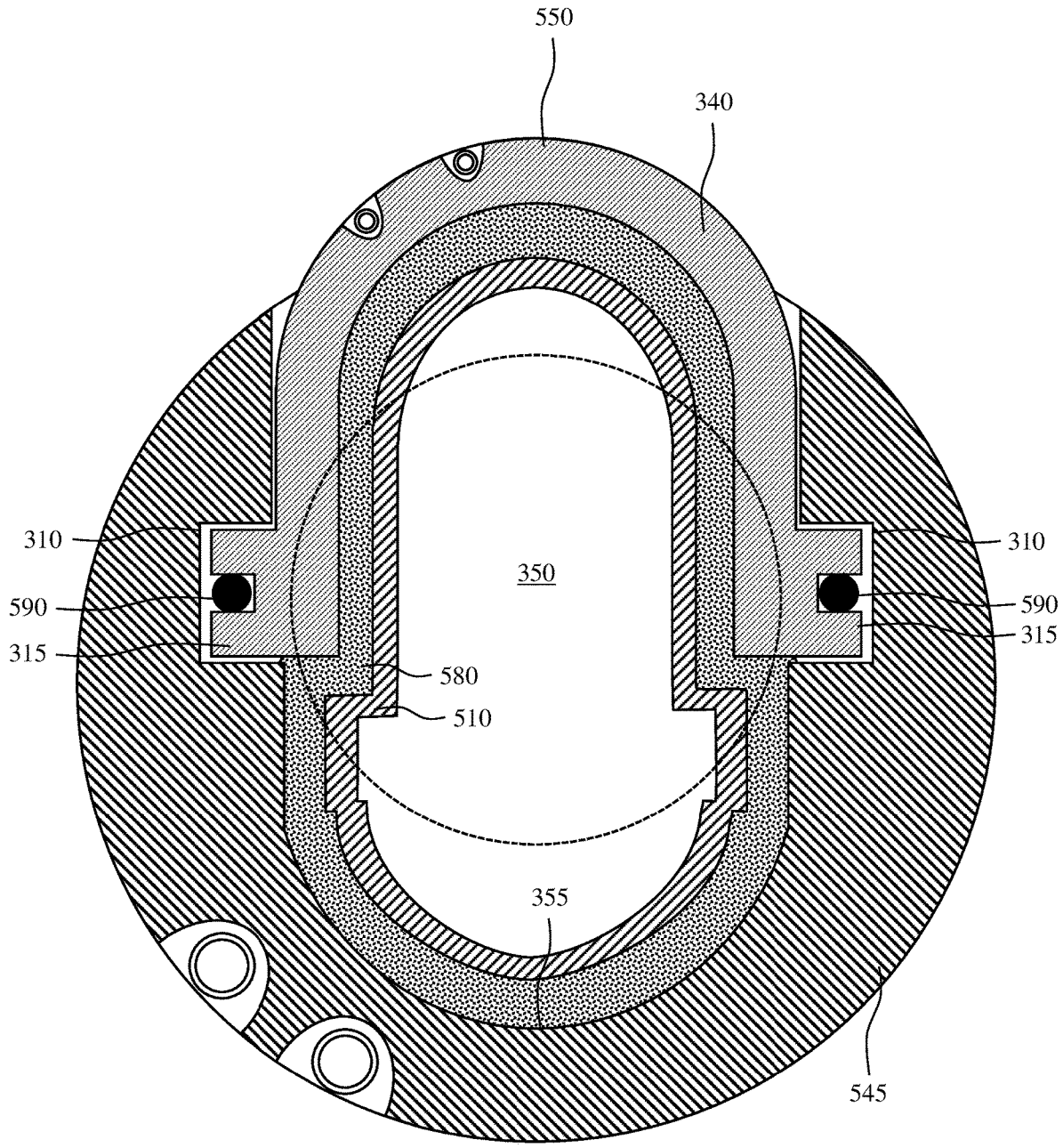
Figure 5M:
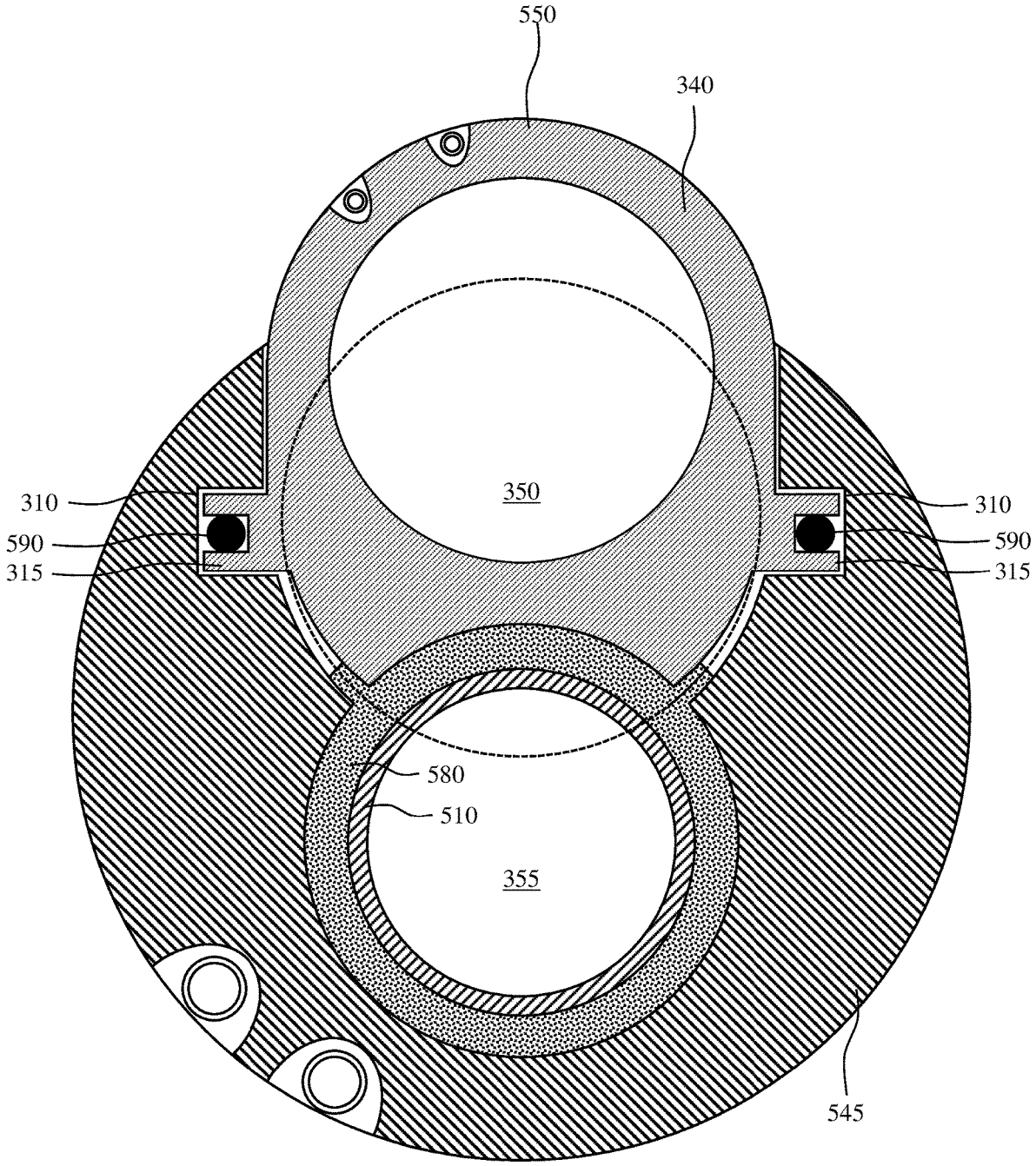
Figure 5N:
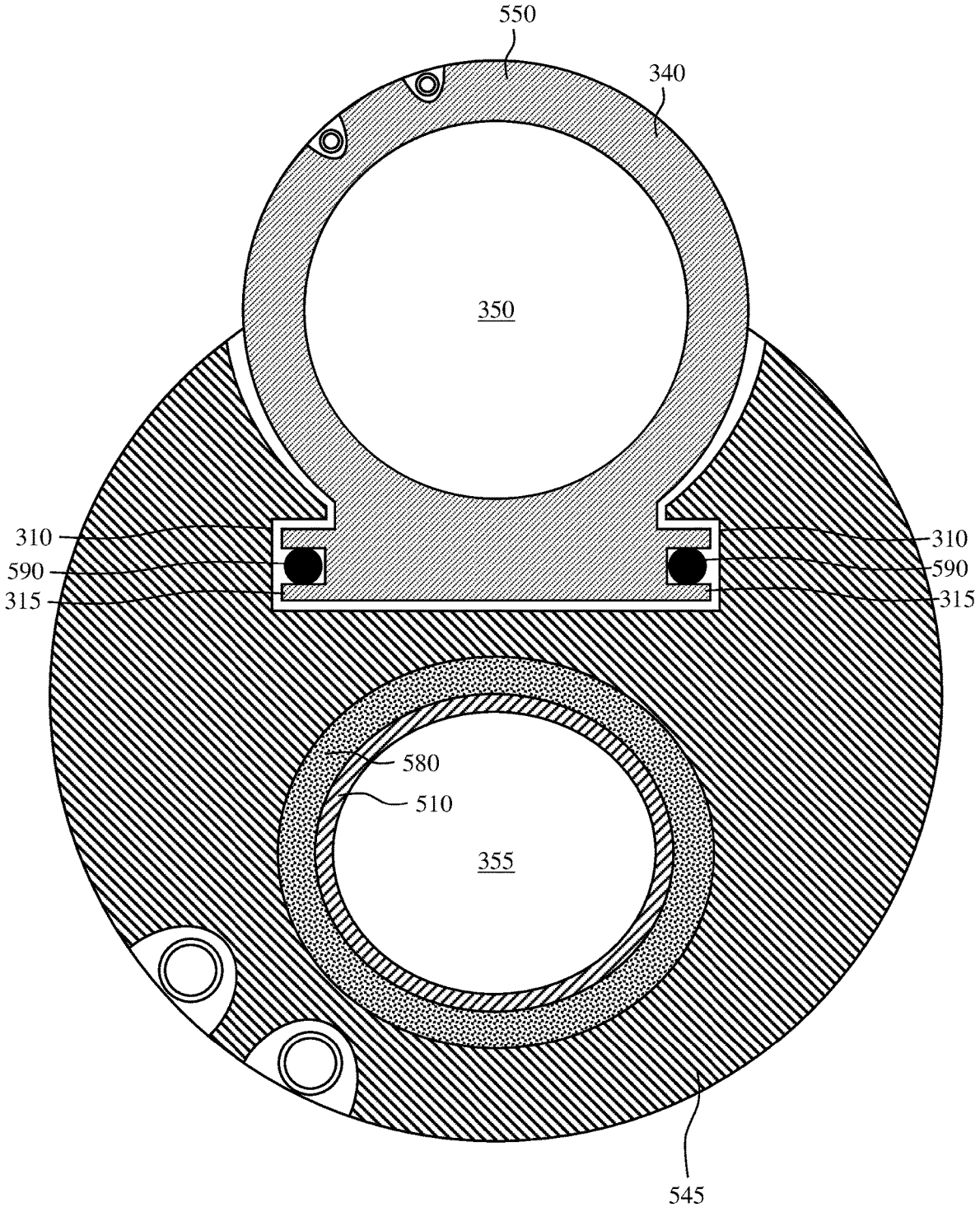

Turning to FIGS. 5A through 5N, illustrated are various different views of an alternative embodiment of a multilateral junction 500, including a lateral branch template 545 and lateral branch connector 550, designed, manufactured and/or operated according to one or more embodiments of the disclosure. The multilateral junction 500, including the lateral branch template 545 and lateral branch connector 550, is similar in many respects to the multilateral junction, including the lateral branch template 245 and lateral branch connector 250, described with respect to FIGS. 3A through 3N. Accordingly, like reference numbers have been used to indicated similar, if not identical, features.

The multilateral junction 500, including the lateral branch template 545 and lateral branch connector 550, differs for the most part from the multilateral junction, including the lateral branch template 245 and lateral branch connector 250 described with respect to FIGS. 3A through 3N, in that the multilateral junction 500 employs an inner tubular 510 positioned within the inner bore 350 of the lateral branch connector 250, and specifically at least partially separating the lateral branch template 245 and the lateral branch connector 250. The multilateral junction 500, in one or more embodiments, may additionally include a pre-expansion seal 570 that is configured to expand in volume (e.g., as discussed above) and post-expansion seal 580 that has expanded in volume, radially outside of the inner tubular 510, thereby providing the desired fluid seal between the lateral branch template 545 and lateral branch connector 550. As discussed, the ability for the pre-expansion seal 570 to expand (e.g., expand in response to hydrolysis or swell in response to sorption) in volume provides many benefits that existing devices were unable to achieve. Furthermore, in at least one embodiment, additional seals 590 may be used, the additional seals 590 comprising non-expanding seals and/or expanding seals.

Turning to FIGS. 6A through 6N, illustrated are various different views of an alternative embodiment of a multilateral junction 600, including a lateral branch template 645 and lateral branch connector 650, designed, manufactured and/or operated according to one or more embodiments of the disclosure. The multilateral junction 600, including the lateral branch template 645 and lateral branch connector 650, is similar in many respects to the multilateral junction, including the lateral branch template 245 and lateral branch connector 250, described with respect to FIGS. 3A through 3N. Accordingly, like reference numbers have been used to indicated similar, if not identical, features.

The multilateral junction 600, including the lateral branch template 645 and lateral branch connector 650, differs for the most part from the multilateral junction, including the lateral branch template 245 and lateral branch connector 250 described with respect to FIGS. 3A through 3N, in that the multilateral junction 600 employs a non-parallel sealing element surface 610. In the illustrated embodiment, the non-parallel sealing element surface 610 is located in the lateral branch template 645. Nevertheless, in yet other embodiments the non-parallel sealing element surface 610 is located in the lateral branch connector 650, or elsewhere. Multiple different types and/or shapes of non-parallel sealing element surfaces 610 may be used and remain within the scope of the disclosure.

The non-parallel sealing element surface 610, in one or more embodiments, may provide for fuller expansion lengthwise, and a tighter seal along the non-parallel (e.g., tapered) surfaces. The non-parallel seal surface 610 may additionally include one or more flats on its edges, for example for bearing loads.

Turning to FIGS. 7A through 7N, illustrated are various different views of an alternative embodiment of a multilateral junction 700, including a lateral branch template 745 and lateral branch connector 750, designed, manufactured and/or operated according to one or more embodiments of the disclosure. The multilateral junction 700, including the lateral branch template 745 and lateral branch connector 750, is similar in many respects to the multilateral junction, including the lateral branch template 245 and lateral branch connector 250, described with respect to FIGS. 3A through 3N. Accordingly, like reference numbers have been used to indicated similar, if not identical, features.

The multilateral junction 700, including the lateral branch template 745 and lateral branch connector 750, differs for the most part from the multilateral junction, including the lateral branch template 245 and lateral branch connector 250 described with respect to FIGS. 3A through 3N, in that the multilateral junction 700 employs one or more fluid access ports 710 for allowing fluid (e.g., reactive fluid) into a space 705 between the lateral branch template 745 and the lateral branch connector 750, such that the fluid can engage (e.g., react) with the pre-expansion sealing element 370 configured to expand in volume, and thus result in the post-expansion sealing element 380. In at least one embodiment, the one or more fluid access ports 710 couple an interior of the lateral branch template 745 and the space 705 (e.g., joint) between the lateral branch template 745 and the lateral branch connector 750, and in yet another embodiment the one or more fluid access ports 710 couple an interior of the lateral branch connector 745 and the space 705 (e.g., joint) between the lateral branch template 745 and the lateral branch connector 750. The number, location (e.g., whether in the lateral branch template 745 and/or the lateral branch connector 750), size and type of the one or more fluid access ports 710 may vary greatly and remain within the scope of the disclosure.

In at least one embodiment, one or more material access ports 715 are located near a downhole end of the lateral branch connector 750, as shown in FIGS. 7I and 7N. In this embodiment, materials (e.g., fluids, gels, pastes, solids, etc.) may move from an area of most resistance to an area of least resistance. The embodiment of FIGS. 7I and 7N also illustrates an alternative embodiment of a material reservoir 730 (e.g., reactive fluid reservoir) that could include fluid therein. The material in the material reservoir 730 may be sealing material itself, reactive fluid, a sealing fluid, an epoxy and/or other fluids/materials and remain within the scope of the disclosure. In the illustrated embodiment, the material reservoir 730 is located so that it would not prevent circulation through the lateral branch connector 750 as it is run-in-hole.

In at least one other embodiment, the multilateral junction 700 may alternatively or also include one or more associated valves 720 for allowing existing other types of material (e.g., solids, liquids, etc.) within the space 705 to exit as the fluid (e.g., reactive fluid) enters the space 705 to form the post-expansion sealing element 380. The number, location, size and type of the one or more associated valves 720 may vary greatly and remain within the scope of the disclosure. For example, in at least one embodiment, the one or more associated valves 720 are spring loaded relief/check valves. In at least one embodiment, the one or more associated valves 720 actuate (e.g., open) as the pre-expansion sealing element 370 expands in volume to the post-expansion sealing element 380. In other embodiments, the one or more associated valves 720 may actuate (e.g., open) as a fluid/material is injected into the space 705. In other embodiments, the one or more associated valves 720 will have a closing feature that will force it into the closed position at a desired event (e.g., reaching a certain pressure). Likewise, in some embodiments, the one or more associated valves 720 will be such that it will not open until a particular event occurs such as reaching a certain pressure (when the expansion is great enough). Further to the embodiments of FIGS. 7I and 7N, the multilateral junction 700 may include one or more lower end pre-expansion seals 770 or post-expansion seals 780, for example to seal a downhole end of the lateral branch connector 750.

Aspects disclosed herein include:

A. A multilateral junction, the multilateral junction including: 1) a lateral branch template having a lateral window for positioning proximate a junction between a lateral wellbore and a main wellbore; 2) a lateral branch connector adapted to be sealably engaged to the lateral branch template, a portion of the lateral branch connector extending through the lateral window; and 3) one or more sealing elements configured to expand in volume located proximate a joint between the lateral branch template and the lateral branch connector.

B. A well system, the well system including: 1) a main wellbore; 2) a lateral wellbore extending from the main wellbore; and 3) a multilateral junction positioned at a junction of the main wellbore and the lateral wellbore, the multilateral junction including; a) a lateral branch template having a lateral window for positioning proximate a junction between a lateral wellbore and a main wellbore; b) a lateral branch connector adapted to be sealably engaged to the lateral branch template, a portion of the lateral branch connector extending through the lateral window; and c) one or more sealing elements configured to expand in volume located proximate a joint between the lateral branch template and the lateral branch connector.

C. A method, the method including: 1) forming a main wellbore and a lateral wellbore through one or more subterranean formations; and 2) positioning a multilateral junction at a junction of the main wellbore and the lateral wellbore, the multilateral junction including: 1) a lateral branch template having a lateral window for positioning proximate a junction between a lateral wellbore and a main wellbore; b) a lateral branch connector adapted to be sealably engaged to the lateral branch template, a portion of the lateral branch connector extending through the lateral window; and c) one or more sealing elements configured to expand in volume located proximate a joint between the lateral branch template and the lateral branch connector.

Aspects A, B, and C may have one or more of the following additional elements in combination: Element 1: wherein the lateral branch template has a first engagement member, and wherein the lateral branch connector has a second engagement member configured to engage the first engagement member, the first engagement member extending at least partially along a length of the lateral branch template, and the second engagement member extending at least partially along a length of the lateral branch connector. Element 2: wherein the one or more sealing elements configured to expand in volume are located proximate a joint between the first engagement member and the second engagement member. Element 3: wherein the one or more sealing elements configured to expand in volume is a single continuous sealing element configured to expand in volume encircling the joint between the first engagement member and the second engagement member. Element 4: wherein at least one of the one or more sealing elements configured to expand in volume is a metal sealing element configured to expand in volume in response to hydrolysis. Element 5: wherein at least one of the one or more sealing elements configured to expand in volume is a polymer sealing element configured to swell in volume in response to fluid sorption. Element 6: further including an inner tubular positioned within an inner bore of the lateral branch connector, the one or more sealing elements configured to expand in volume located radially outside of the inner tubular and proximate the joint between the lateral branch template and the lateral branch connector. Element 7: wherein the joint between the lateral branch template and the lateral branch connector is a non-parallel sealing element surface. Element 8: further including one or more fluid access ports coupling an interior of the lateral branch template and the joint between the lateral branch template and the lateral branch connector or coupling an interior of the lateral branch connector and the joint between the lateral branch template and the lateral branch connector. Element 9: further including one or more valves coupling an interior and an exterior of the lateral branch template or an interior and an exterior the lateral branch connector, the one or more valves configured to allow material from within the interior of the lateral branch template or the later branch connector to escape as reactive fluid encounters the one or more sealing elements.

Those skilled in the art to which this application relates will appreciate that other and further additions, deletions, substitutions and modifications may be made to the described embodiments.

What is claimed is:

1. A multilateral junction, comprising:

a lateral branch template having a lateral window for positioning proximate a junction between a lateral wellbore and a main wellbore;

a lateral branch connector, a portion of the lateral branch connector extending through the lateral window;

one or more sealing elements located in a seal groove in one of the lateral branch template or lateral branch connector, the one or more sealing elements configured to expand in volume from the seal groove into a space between the lateral branch template and the lateral branch connector to sealingly engage the lateral branch template and the lateral branch connector; and one or more fluid access ports coupling an interior of the lateral branch template and the joint between the lateral branch template and the lateral branch connector or coupling an interior of the lateral branch connector and the joint between the lateral branch template and the lateral branch connector.

2. The multilateral junction as recited in claim 1, wherein the lateral branch template has a first engagement member, and wherein the lateral branch connector has a second engagement member configured to engage the first engagement member, the first engagement member extending at least partially along a length of the lateral branch template, and the second engagement member extending at least partially along a length of the lateral branch connector.

3. The multilateral junction as recited in claim 2, wherein the one or more sealing elements configured to expand in volume are located proximate a joint between the first engagement member and the second engagement member.

4. The multilateral junction as recited in claim 2, wherein the one or more sealing elements configured to expand in volume is a single continuous sealing element configured to expand in volume encircling the joint between the first engagement member and the second engagement member.

5. The multilateral junction as recited in claim 1, wherein at least one of the one or more sealing elements configured to expand in volume is a metal sealing element configured to expand in volume in response to hydrolysis.

6. The multilateral junction as recited in claim 1, wherein at least one of the one or more sealing elements configured to expand in volume is a polymer sealing element configured to swell in volume in response to fluid sorption.

7. The multilateral junction as recited in claim 1, further including an inner tubular positioned within an inner bore of the lateral branch connector, the one or more sealing elements configured to expand in volume located radially outside of the inner tubular and proximate the joint between the lateral branch template and the lateral branch connector.

8. The multilateral junction as recited in claim 1, wherein the joint between the lateral branch template and the lateral branch connector is a non-parallel sealing element surface.

9. The multilateral junction as recited in claim 1, further including one or more valves coupling the interior and an exterior of the lateral branch template or the interior and an exterior of the lateral branch connector, the one or more valves configured to allow material from within the interior of the lateral branch template or the lateral branch connector to escape as reactive fluid encounters the one or more sealing elements.

10. A well system, comprising:

a main wellbore;

a lateral wellbore extending from the main wellbore; and a multilateral junction positioned at a junction of the main wellbore and the lateral wellbore, the multilateral junction including:

a lateral branch template having a lateral window for positioning proximate a junction between a lateral wellbore and a main wellbore;

a lateral branch connector, a portion of the lateral branch connector extending through the lateral window;

one or more sealing elements located in a seal groove in one of the lateral branch template or lateral branch connector, the one or more sealing elements configured to expand in volume from the seal groove into a space between the lateral branch template and the lateral branch connector to sealingly engage the lateral branch template and the lateral branch connector; and one or more fluid access ports coupling an interior of the lateral branch template and the joint between the lateral branch template and the lateral branch connector or coupling an interior of the lateral branch connector and the joint between the lateral branch template and the lateral branch connector.

11. The well system as recited in claim 10, wherein the lateral branch template has a first engagement member, and wherein the lateral branch connector has a second engagement member configured to engage the first engagement member, the first engagement member extending at least partially along a length of the lateral branch template, and the second engagement member extending at least partially along a length of the lateral branch connector.

12. The well system as recited in claim 11, wherein the one or more sealing elements configured to expand in volume are located proximate a joint between the first engagement member and the second engagement member.

13. The well system as recited in claim 11, wherein the one or more sealing elements configured to expand in volume is a single continuous sealing element configured to expand in volume encircling the joint between the first engagement member and the second engagement member.

14. The well system as recited in claim 10, wherein at least one of the one or more sealing elements configured to expand in volume is a metal sealing element configured to expand in volume in response to hydrolysis.

15. The well system as recited in claim 10, wherein at least one of the one or more sealing elements configured to expand in volume is a polymer sealing element configured to swell in volume in response to fluid sorption.

16. The well system as recited in claim 10, further including an inner tubular positioned within an inner bore of the lateral branch connector, the one or more sealing elements configured to expand in volume located radially outside of the inner tubular and proximate the joint between the lateral branch template and the lateral branch connector.

17. The well system as recited in claim 10, wherein the joint between the lateral branch template and the lateral branch connector is a non-parallel sealing element surface.

18. The well system as recited in claim 10, further including one or more valves coupling the interior and an exterior of the lateral branch template or the interior and an exterior of the lateral branch connector, the one or more valves configured to allow material from within the interior of the lateral branch template or the lateral branch connector to escape as reactive fluid encounters the one or more sealing elements.

19. A method, comprising:

forming a main wellbore and a lateral wellbore through one or more subterranean formations; and positioning a multilateral junction at a junction of the main wellbore and the lateral wellbore, the multilateral junction including:

a lateral branch template having a lateral window for positioning proximate a junction between a lateral wellbore and a main wellbore;

a lateral branch connector, a portion of the lateral branch connector extending through the lateral window;

one or more sealing elements located in a seal groove in one of the lateral branch template or lateral branch connector, the one or more sealing elements configured to expand in volume from the seal groove into a space between the lateral branch template and the lateral branch connector to sealingly engage the lateral branch template and the lateral branch connector; and one or more fluid access ports coupling an interior of the lateral branch template and the joint between the lateral branch template and the lateral branch connector or coupling an interior of the lateral branch connector and the joint between the lateral branch template and the lateral branch connector.

20. A multilateral junction, comprising:

a lateral branch template having a lateral window for positioning proximate a junction between a lateral wellbore and a main wellbore;

a lateral branch connector, a portion of the lateral branch connector extending through the lateral window;

one or more sealing elements located in a seal groove in one of the lateral branch template or lateral branch connector, the one or more sealing elements configured to expand in volume from the seal groove into a space between the lateral branch template and the lateral branch connector to sealingly engage the lateral branch template and the lateral branch connector; and one or more valves coupling an interior and an exterior of the lateral branch template or an interior and an exterior the lateral branch connector, the one or more valves configured to allow material from within the interior of the lateral branch template or the lateral branch connector to escape as reactive fluid encounters the one or more sealing elements.

* * * * *